US006100867A

United States Patent [19]

Gyouten

[11] Patent Number: 6,100,867

[45] Date of Patent: Aug. 8, 2000

[54] DEVICE AND METHOD FOR DRIVING LIQUID CRYSTAL DISPLAY APPARATUS

[75] Inventor: Seijirou Gyouten, Tenri, Japan

[73] Assignee: Sharp Kabushiki Kaisha, Osaka, Japan

[21] Appl. No.: 08/867,909

[22] Filed: Jun. 3, 1997

[30] Foreign Application Priority Data

| | | | |
|---|---|---|---|
| Jun. 11, 1996 | [JP] | Japan | 8-172967 |
| Aug. 23, 1996 | [JP] | Japan | 8-22773 |
| Nov. 8, 1996 | [JP] | Japan | 8-296896 |

[51] Int. Cl.[7] ..... G09G 3/36

[52] U.S. Cl. ..... 345/95; 345/210

[58] Field of Search ..... 345/58, 94, 95, 345/208, 210

[56] References Cited

U.S. PATENT DOCUMENTS 5,798,740 8/1998 Bitzakidis et al. ..... 345/58

FOREIGN PATENT DOCUMENTS 5-265402 10/1993 Japan .
8-286635 11/1996 Japan .
8-286644 11/1996 Japan .

*Primary Examiner*—Jeffery Brier

[57] ABSTRACT

A segment side drive circuit, which drives segment electrodes of a liquid crystal panel, compares present display data and display data of the previous scanning period. Only when both display data correspond, the segment side drive circuit corrects the output voltage to an intermediate level according to a correction clock. Because a change is added when there is no change in the display pattern, an effect of rounding of the waveform can be equalized regardless of the display pattern, making it possible to eliminate the luminance unevenness. When the display data changes, loss of effective voltage due to correction is prevented thus suppressing an increase in the current consumption. Further it is made possible to provide two correction periods to thereby reduce spikes superposed on the common side when the display data changes, as well as eliminate the luminance unevenness.

15 Claims, 85 Drawing Sheets

DEVICE AND METHOD FOR DRIVING LIQUID CRYSTAL DISPLAY APPARATUS

BACKGROUND OF THE INVENTION

1. Field of the Invention

The present invention relates to a device and method for driving a matrix type liquid crystal display apparatus, capable of improving the display quality thereof.

2. Description of the Related Art

A configuration for driving a typical simple matrix type liquid crystal display panel of a prior art is shown in FIG. 68. A liquid crystal panel 251 is connected with a segment side drive circuit 252 which is a segment driver and with a common side drive circuit 253 which is a common driver. The segment side drive circuit 252 and the common side drive circuit 253 are connected with a power circuit 254 which supplies electric power and a controller 255 which sends various control signals. The controller 255 supplies the segment side drive circuit 252 with display data, data latch clock for taking in the display data, horizontal synchronization signal and AC-converting signal for alternately driving the liquid crystal panel 251. The controller 255 supplies the common side drive circuit 253 with a horizontal synchronization signal, an AC-converting signal and a vertical synchronization signal for recognizing the start point of one screen. The power circuit 254 generates six voltages V0, V1, V2, V3, V4 and V5, having voltage levels increasing in this order, respectively, and supplies voltages V0, V2, V3, and V5 to the segment side drive circuit 252, and voltages V0, V1, V4 and V5 to the common side drive circuit 253. The liquid crystal panel 251 includes segment electrodes X1, X2, X3, X4, . . . , Xm and common electrodes Y1, Y2, Y3, Y4, . . . . , Yn which constitute a simple matrix while a liquid crystal cell located at the intersection of a segment electrode and a common electrode forms a pixel.

FIG. 69 shows an internal configuration of the segment side drive circuit 252. The segment side drive circuit 252 includes a shift register 261, a data latch 262, a line latch 263, a level shifter 264 and a liquid crystal drive output circuit 265, and is capable of driving, for example, 160 columns of segment electrodes. Display data for 160 columns is serially inputted to the shift register 261 in synchronization with data latch clock, thereby to be converted to parallel data in the shift register 261 and is latched and stored in the data latch 262. When an amount of data corresponding to one scan electrode has been accumulated, horizontal synchronization signal (LP) is added while the stored display data is latched in the line latch 263 then subjected to level shift in the level shifter 264, and is sent to the liquid crystal drive output circuit 265. The level shifter 264 converts the voltage levels of ordinary logic circuits such as the shift register 261, the data latch 262 and the line latch 263 to liquid crystal drive voltage level of the liquid crystal drive output circuit 265. The liquid crystal drive output circuit 265 outputs an output voltage for driving the segment electrodes of the liquid crystal panel 251 in accordance to an input supplied from the level shifter 264 and to the AC-converting signal.

FIG. 70 shows the operation of the prior art shown in FIG. 68. Although description that follows assumes that the liquid crystal panel 251 has seven scan electrodes for the convenience of description, actual liquid crystal panel 251 has greater number of scan electrodes. Common output voltage VY for the common electrodes which are scan electrodes successively selects, in accordance to the horizontal synchronization signal, the scanning lines to be displayed starting with the top line based on the vertical synchronization signal. For the common output voltage VY, one level is selected from among the four power voltages V0, V1, V4 and V5 according to a combination of the horizontal synchronization signal and the AC-converting signal, and is applied to the common side electrodes. As the segment output voltage VX for the segment electrodes which are data electrodes, one level is selected from among four liquid crystal drive power voltages V0, V2, V3, and V5 in accordance to the display data, while outputs for one scan electrode are applied in parallel to the segment side electrodes.

In the liquid crystal panel 251, potential difference between the segment side electrode and the common side electrode is applied to each pixel, while whether to display or not is determined according to the effective value of the potential difference over one frame period which is the time required to display one image frame. In the liquid crystal panel 251, there occur slight differences in the display color and the display density on the panel between a portion where identical display, for example ON display or OFF display, is given over the entire area and a portion where ON display and OFF display are repeated alternately every other line to give stripe display, for example, even when comparison is made between the ON display portions or between the OFF display portions.

(1) Assume a case of ON display given uniformly over the entire screen, then segment output voltage VXA from each segment side drive circuit 252 takes only either one of V0 and V5 which are ON display voltage levels, according to a combination with the AC-converting signal, to be output during one frame period, as shown in FIG. 71. Effective value Veff1 of voltage VA which is applied to a liquid crystal cell constituting each pixel of the liquid crystal panel 251 is given in terms of the difference of the segment output waveform and common output waveform.

(2) Assume a case of stripe display where display data alternately repeat ON and OFF on every other scanning line, then output waveform of the segment side drive circuit 252 alternately takes V0, V5 levels which are ON display voltage levels or V2, V3 levels which are OFF display voltage levels according to a combination with the AC-converting signal during one frame period, as shown in FIG. 72. Voltage VB which is applied to a liquid crystal cell is given in terms of the effective voltage Veff2 which is the difference of the segment output waveform and the common output waveform.

Difference between the cases (1) and (2) is that the frequency of changes in the output level of the segment output waveform is different. When the output level changes, output waveform is rounded due to capacitance of the liquid crystal cell, electrical resistance of the electrodes of the liquid crystal panel, output resistance of the drive circuit and other factors, and therefore a high frequency of changes causes the effective voltage to decrease. Frequency of changes in the output level of the segment output waveform in FIG. 71, for example, is less than the frequency of changes in the segment output waveform in FIG. 72 by 12 in one frame period. Let S represent the loss in the effective voltage applied to the liquid crystal cell due to rounding of the waveform caused in one change, then the effective voltage of the liquid crystal cell shown in FIG. 71 becomes higher by an amount corresponding to 12S than the effective voltage of the liquid crystal cell of FIG. 72. Consequently, Veff1 becomes greater than Veff2 (Veff1>Veff2) even for pixels of the same ON display, resulting in an unevenness in luminance called shadowing. When an output waveform of each drive circuit in the case of OFF display over the entire screen is considered, then the output waveform of the segment side drive circuit takes only either one of V2 and V3 during one frame period. Effective voltage Veff3 of voltage VC which is applied to a liquid crystal cell is given in terms of the difference of segment output waveform and common output waveform as shown in FIG. 73. When an output waveform of each drive circuit for OFF display in the case of stripe display is considered, segment output waveform alternately takes V0, V2 level or V3, V5 level upon every horizontal synchronization signal during one frame period, and is represented by effective voltage Veff4 of voltage VD which is applied to a liquid crystal cell as shown in FIG. 74. Similarly to the difference in the segment waveform during ON display, the effective voltages are related as Veff3>Veff4 also during OFF display, resulting in unevenness in luminance.

Prior art for reducing the unevenness in luminance of display which depends on the display pattern in a liquid crystal display apparatus where a simple matrix type liquid crystal panel is driven is disclosed, for example, in the Japanese Unexamined Patent Publication JP-A 5-265402 (1993) Publication. This prior art provides a method for driving the simple matrix type liquid crystal display apparatus wherein a correction period is provided for all outputs from column side drive circuit, which corresponds to the segment side drive circuit, in every period of scanning one line. In the correction period, instead of display voltage which is output from the column side drive circuit, a corrected voltage is output which is an intermediate voltage level between the ON display voltage level and the OFF display voltage level.

FIG. 75 shows a configuration for driving a liquid crystal panel according to prior art disclosed in the Japanese Unexamined Patent Publication JP-A 5-265402 (1993). Voltages V0 through V5 which are output from a power supply circuit 254 are given via a voltage selector 271 as VS1 through VS4 to a column side drive circuit 272 which drives segment electrodes of the liquid crystal panel 251. A row side drive circuit 273 which drives the common electrodes receives four voltages V0, V1, V4 and V5 similarly to the configuration shown in FIG. 68. Operation of the voltage selector 271 is switched according to the level of correction clock which is output by a counter 274 that counts the data latch clock and the horizontal synchronization signal.

FIGS. 76, 77 and 78 show the common output voltage VY and the segment output voltage VXm in the cases of stripe display, OFF display over the entire screen and ON display over the entire screen, respectively. Because the output waveforms of all segment side drive circuits change to the intermediate voltage level between the ON display voltage level and the OFF display voltage level for every scanning period regardless of the display pattern, frequencies of changes in the outputs of the segment side drive circuits become identical, thus variation in the effective voltage of the applied voltage which depends on the display pattern is reduced.

FIG. 79 shows the output waveform according to a technology proposed in the Japanese Patent Application No.7-89860 filed by the present applicant. This technology makes it possible to drive the segment side drive circuit with a low power voltage, for example a single power voltage of 5V. The segment side drive circuit outputs one of two voltages VSH and VSL in accordance to a combination of AC-converting signal and display data, thereby to determine whether the display is to be ON or OFF. The common side drive circuit selects one voltage from among three voltages VCH, VCM and VCL according to a combination of AC-converting signal and selection or non-selection, and outputs the selected voltage.

Comparison of FIG. 70 and FIG. 79 shows that the waveform applied to the liquid crystal cell is the same for both drive methods. Effective value of the applied voltage also becomes the same, provided the following equations hold. This method of driving will be called the 5V drive method.

$$V0-V5=VCH-VSL$$

$$V0-V4=VCH-VSM$$

$$V0-V3=VCH-VSH$$

$$(V4-V4=V1-V1)=(VCM-VSM)=0$$

$$(V4-V5,\ V1-V2)=VCM-VSL$$

$$(V4-V3,\ V1-V0)=VCM-VSH$$

$$V5-V2=VCL-VSL$$

$$V5-V1=VCL-VSM$$

$$V5-V0=VCL-VSH$$

However, even when the 5V drive method is employed, there is a possibility of luminance unevenness to occur due to the difference in the frequency of changes in the output level of the segment output waveform, similar to the prior art described previously. When the prior art disclosed in the Japanese Unexamined Patent Publication JP-A 5-265402 (1993) Publication is applied, frequency of changes in the output level of the segment side drive circuit becomes the same regardless of the display pattern and therefore variation in the applied voltage which depends on the display pattern can be mitigated. A timing chart in this case is shown in FIG. 80.

The present applicant also proposed a technology as the Japanese Patent Application No. 7-128008 where luminance unevenness is reduced by reversing the output of display data in periods when the correction clock is high, in case where the same display is given over consecutive scanning periods.

Shadowing may result from other causes as shown in FIGS. 81, 82, 83 and 84, where changes in the output waveform to the segment electrodes cause voltage variations in the common electrodes as spike noise, which may result in changes in the effective value of the voltage applied to the liquid crystal cell. This is because the segment electrodes and the common electrodes which constitute the liquid crystal panel have non-zero electric resistance and the liquid crystal layer existing between the electrodes acts as a dielectric material. FIG. 81 shows a case when the same drive method as that of the prior art shown in FIG. 68 and FIG. 75 is employed, and FIGS. 82 through 84 show timing charts in case where the 5V drive method similar to that of FIG. 79 is employed.

In the prior art disclosed in the Japanese Unexamined Patent Publication JP-A 5-265402 (1993), correction periods are provided for all drive waveforms of the segment electrodes thereby to output an intermediate voltage level between ON display voltage level and OFF display voltage level, and therefore the effective voltage applied to the liquid crystal cell changes the same number of times regardless of the display pattern, making it possible to eliminate the luminance unevenness due to rounding of the waveform caused by the change. However, because the intermediate level is output during the correction period, effective voltage becomes lower than the effective voltage applied to the liquid crystal cell in the case of ordinary drive method. Thus there arises such a problem that the contrast decreases as the result of decreasing effective voltage leading to lower display quality. That is, as shown in FIG. 85, effective value Veffm of voltage Vm applied to the liquid crystal cell decreases because the portion indicated by hatching is lost. To avoid degradation of the display quality due to such a loss of the effective voltage, it is necessary to have a higher bias ratio and increase the difference between the ON display voltage level and the OFF display voltage level. When bias ratio is increased, magnitude of change in the output voltage increases and an increase in current consumption due to the change in the display voltage level causes the power consumption to increase.

The technology proposed by the present applicant, which reduces the luminance unevenness by reversing the white and black of display data in the correction period in the case of same display, causes an increase in current consumption due to greater voltage changes, because voltage change is caused to occur between ON and OFF. Although it is necessary to decrease the pulse width of the correction clock in order to make optimum correction because of the greater voltage changes in the correction period, it is difficult to make such an adjustment. Also there is such a problem that the loss in the effective voltage applied to the liquid crystal cell is significant thus leading to degradation of the display quality, as described previously.

Today, liquid crystal panels of simple matrix type and active matrix type are required to give color display on larger screens at higher speed with lower voltage, and particularly they are required to be capable of effectively eliminating luminance unevenness and achieving low-voltage drive.

SUMMARY OF THE INVENTION

An object of the invention is to provide a drive device and a drive method for a liquid crystal display apparatus which are capable of minimizing the loss of effective voltage applied to liquid crystal cells, suppressing an increase in current consumption by minimizing change in bias ratio, and improving the display quality of a liquid crystal panel.

The invention provides a drive device for a liquid crystal display apparatus in which a segment side drive circuit to drive pixel columns arranged in a scanning direction according to display data, and a common side drive circuit to drive scanning lines selectively and sequentially in every scanning period are controlled by a controller, and in which display is performed on a matrix type liquid crystal panel, the drive device comprising:

display data comparison means for comparing display data for a pixel to be driven in one scanning period with display data in the previous scanning period, on a pixel column basis; and output control means, in response to a result of the comparison by the display data comparison means, for controlling a level of an output voltage of the segment side drive circuit, in case where the display data of the two scanning periods are identical, in a correction period predetermined in the one scanning period so as to be changed to an intermediate level between ON display voltage level and OFF display voltage level.

According to the invention, in the correction period predetermined in the one scanning period an output voltage of the segment side drive circuit is corrected to an intermediate level between the ON display voltage level and the OFF display voltage level only when the video data to be displayed on each pixel column does not change in the two scanning periods. This configuration makes the effective voltage applied to a liquid crystal cell identical regardless of whether there is a change in the display data or not, and eliminates the difference in the effect of a loss in the effective voltage due to rounding of voltage waveform caused by changes in the display data, thereby making it possible to reduce the luminance unevenness due to difference in the display pattern.

Further the invention is characterized in that the output control means controls the intermediate level to be changed during the correction period, so that different voltage levels are selected depending on whether the output voltage of the segment side drive circuit is at the ON display voltage level or at the OFF display voltage level.

According to the invention, the intermediate level to be changed during the correction period is set to different voltage levels depending on whether the output voltage from the segment side drive circuit is at the ON display voltage level or at the OFF display voltage level. Because the capacitance of the liquid crystal cell changes depending on the applied voltage level, a correction voltage is changed depending on ON or OFF to separately apply correction appropriate for each degree of rounding of the waveform, thus making it possible to further reduce the variation of effective voltage. Also the potential difference of the voltage to be changed is made smaller, thereby suppressing increase in the current consumption and enabling more precise adjustment of the correction voltage.

Further the invention is characterized in that the output control means controls the intermediate level which is to be changed during the correction period, so as to be a non-selective voltage which is used by the common side drive circuit to set the scanning lines in non-selected state.

According to the invention, because the non-selective voltage used by the common side drive circuit to set the scanning line in non-selected state is used as the intermediate level which becomes the correction voltage, it is made possible to achieve a low-cost drive device while suppressing cost increase which would be required when a separate voltage source is prepared.

Further the invention is characterized in that the output control means controls a length of the correction period so as to be different depending on whether the output voltage from the segment side drive circuit is at the ON display voltage level or at the OFF display voltage level.

According to the invention, because the length of the correction period is made different depending on whether the output voltage from the segment side drive circuit is the ON display voltage level or the OFF display voltage level, thus even when the capacitance of the liquid crystal cell changes depending on the applied voltage, adjustment is made independently according to the difference in rounding of the waveform, thereby making it possible to eliminate the unevenness in display more effectively.

Further the invention is characterized in that the output control means does not control the level of the output voltage of the segment side drive circuit so as to be changed to the intermediate level when an AC-converting signal used in alternate driving of the liquid crystal panel changes, even in case where the comparison by the display data comparison means results in that the display data are identical.

According to the invention, when the liquid crystal panel is alternately driven, correction to the intermediate voltage is not carried out because the output voltage of the segment side drive circuit changes even when the display data does not change. This makes it possible to eliminate the unevenness in display more effectively.

Further the invention is characterized in that the output control means controls the level of the output voltage of the segment side drive circuit so as to be changed to the intermediate level when an AC-converting signal used for alternate driving of the liquid crystal panel changes, in case where a comparison by the display data comparison means results in display data being different.

According to the invention, because the output voltage of the segment side drive circuit does not change in case where the display data are different when the AC-converting signal for alternate drive of the liquid crystal panel changes, the effective voltage applied to the liquid crystal cell can be made constant regardless of the type of display pattern by providing correction period and making correction to the intermediate voltage. This makes it possible to reduce the variation in the effective voltage applied to the liquid crystal cells due to the display pattern, thereby suppressing the luminance unevenness.

Further the invention is characterized in that the device further comprises voltage selecting means for selecting a voltage for displaying according to display data and a voltage which has been changed to the intermediate level during the correction period, and for supplying the selected voltages to the segment side drive circuit.

According to the invention, because the segment side drive circuit is supplied with the voltage selected by the voltage selecting means, number of power terminals required by the segment side drive circuit can be reduced. The segment side drive circuit is often constituted from a plurality of semiconductor integrated circuits. This configuration makes it possible to use the voltage selecting means in common while reducing the semiconductor integrated circuits in size and decreasing the chip area, thereby making the drive device efficiently at a low cost.

Further the invention is characterized in that the output control means sets two correction periods within each scanning period so that a first correction period of the two correction periods is nearer to a start point of the scanning period than a second correction period of the two correction periods, and changes the output voltage of the segment side drive circuit to the intermediate level in the first correction period in case where the display data are different, or to the intermediate level in the second correction period in case where the display data are identical, in response to the comparison result by the display data comparison means.

According to the invention, two correction periods are provided in one scanning period. When the display data are different between one scanning period and the previous scanning period, the intermediate level is once output as the output voltage of the segment side drive circuit in the first correction period at the time of changing. Because the output is changed two times, spike noise superposed on the common side can be dispersed. When there is no change in the display data, the output is changed to the intermediate level in the second correction period. Because the output is changed two times, spike noise superposed on the common side can be dispersed, making it possible to suppress luminance unevenness.

Further the invention is characterized in that when the AC-converting signal for alternate drive of the liquid crystal panel changes, the output control means changes the output voltage of the segment side drive circuit, to the intermediate level in the first correction period in case where the display data are identical, or to the intermediate level in the second correction period in case where the display data are different, in response to the comparison result by the display data comparison means.

According to the invention, because the output is once changed to the intermediate level when the output voltage of the segment side drive circuit changes, namely when the display data remain the same at the time the AC-converting signal is switched, spike noise superposed on the common side are dispersed, making it possible to suppress luminance unevenness.

Further the invention is characterized in that the output control means sets the second correction period to be longer than the first correction period.

According to the invention, the second correction period provided for eliminating the luminance unevenness is made longer than the first correction period provided for reducing the spike noise superposed on the common side, thereby reducing the variation in the output voltage during the second correction period, and enabling further reduction of the spike noise superposed on the common side.

Further the invention is characterized in that the segment side drive circuit has correction clock generating means for setting the correction period, which is incorporated therein.

According to the invention, since the correction clock generating means is incorporated in the segment side drive circuit, number of input terminals of the segment side drive circuit can be reduced and the circuit of the controller which supplies various control signals can be simplified, thereby making it possible to drive by means of the conventional controller which does not include the correction clock generating means and easily make the drive device of the liquid crystal display apparatus of improved display quality.

Further the invention provides a drive method for a liquid crystal display apparatus in which a segment side drive circuit drives pixel columns arranged in a scanning direction according to display data and a common side drive circuit selectively drives scanning lines in sequence in each scanning period to perform display on a matrix type liquid crystal panel, the drive method comprising the steps of:

comparing display data for a pixel to be driven in one scanning period with display data in the previous scanning period, on a pixel column basis; and changing an output voltage of the segment side drive circuit to an intermediate level between ON display voltage level and OFF display voltage level, in case where the display data of the two scanning periods are identical, in a correction period which is predetermined in the one scanning period.

According to the invention, since the output voltage level is changed to the intermediate level in the correction period when there is no change in the display data to be displayed in each period on each pixel column which is driven by the segment side drive circuit, the effective voltage applied to the liquid crystal cell can be made identical regardless of whether there is a change in the display data or not. This makes it possible to make the effect of waveform rounding due to the electrical resistance of the electrodes and the capacitance of the liquid crystal cells constant even when the display pattern changes, thereby eliminating the luminance unevenness and improving the display quality. Because correction is not applied when the display data changes, loss of the effective voltage can be minimized thereby minimizing the increase of current consumption and eliminating the luminance unevenness through proper correction.

The invention is characterized in that the output voltage of the segment side drive circuit is not changed to the intermediate level even when display data of two consecutive scanning periods are identical, in case where the AC-converting signal for alternate drive of the liquid crystal panel changes.

According to the invention, because the output voltage of the segment side drive circuit changes even when the display data of the consecutive scanning periods are identical in case where the AC-converting signal changes, correction is not applied and loss of effective voltage is avoided, thereby making it possible to eliminate luminance unevenness further more effectively.

Further the invention is characterized in that when the AC-converting signal for alternate drive of the liquid crystal panel changes, the output voltage of the segment side drive circuit is changed to the intermediate level when the comparison by the display data comparison means results in that the display data are different.

According to the invention, since the output voltage of the segment side drive circuit does not change when the display data of the consecutive scanning periods are different in case where the AC-converting signal for alternate drive changes, correction period is provided to correct the output to the intermediate voltage, thus making it possible to keep the effective voltage applied to the liquid crystal cell constant regardless of the type of display data. This configuration makes it possible to reduce the variations in the effective voltage applied to the liquid crystal cell due to the display pattern, and suppress the luminance unevenness further more effectively.

Further the invention is characterized in that two correction periods are provided in one scanning period, and when the comparison the display data are found to be different, the voltage is changed to the intermediate level in a first correction period of the two correction periods which is near the start point of the scanning period at the time of changing, and when the comparison of the display data is found to be identical, the voltage is changed to the intermediate level in a second correction period of the two correction periods which starts later than the first correction period.

According to the invention, because two correction periods are provided in one scanning period and the output voltage of the segment side drive circuit is once held at the intermediate level during the first correction period when the display data change, spikes superposed on the common side can be dispersed and reduced. In the second correction period, correction for the case when the display data does not change is applied, making it possible to reduce the luminance unevenness.

According to the invention, as described above, output voltage of the segment side drive circuit is corrected to the intermediate level between the ON display voltage level and the OFF display voltage level during a correction period which is set in advance within each scanning period, only when the video data to be displayed on each pixel column does not change in consecutive two scanning periods. This configuration causes the same effective voltage to be applied to the liquid crystal cell regardless of whether there is a change in the display data or not, and adjusts the loss in the effective voltage due to rounding of voltage waveform caused by the changes to similar degrees, thereby making it possible to reduce the luminance unevenness due to difference in the display pattern. Because correction is not applied when the display data changes, change in the bias voltage ratio is minimized and an increase in the current consumption can be suppressed.

According to the invention, different voltages levels are selected for the intermediate level to be changed in the correction period depending on whether the output voltage from the segment side drive circuit is ON display voltage level or OFF display voltage level. Because the capacitance of the liquid crystal cell changes with the applied voltage level, correction voltage is also changed depending ON or OFF thereby to separately apply correction for the degree of rounding of the waveform, making it possible to further reduce the variation of effective voltage. Also the potential difference from each display voltage of the correction voltage to be changed is made smaller, thereby to suppress the increase of the current consumption and enable it to easily reduce variations of the effective voltage by means of adjustment of the correction period and reduce the luminance unevenness.

According to the invention, because non-selective voltage, which is output by the common side drive circuit for setting the scanning line at non-selected state as the intermediate level, is used as the correction voltage, manufacturing cost can be suppressed and a low-cost drive device can be achieved.

According to the invention, because the length of the correction period is made different depending on whether the output voltage from the segment side drive circuit is ON display voltage level or OFF display voltage level, even when the capacitance of the liquid crystal cell changes due to the voltage applied thereto, adjustment is made independently according to the difference in rounding of the waveform, thereby making it possible to eliminate the luminance unevenness more effectively.

Also according to the invention, when the liquid crystal panel is alternately driven, correction to the intermediate voltage is not carried out because the output voltage of the segment side drive circuit changes even when the display data does not change, thus it is made possible to eliminate the unevenness in display more effectively.

Also according to the invention, because the output voltage of the segment side drive circuit does not change when the display data are different in case the AC-converting signal for alternate drive changes, a correction period is provided to apply the correction to the intermediate voltage. The effective voltage applied to the liquid crystal cell can be kept constant regardless of the type of display pattern, and it is made possible to reduce the variations in the effective voltage and suppress the luminance unevenness.

Also according to the invention, because the voltage selecting means can be used commonly for a plurality of segment side drive circuits or the number of wirings can be reduced, semiconductor integrated circuit size and chip area can be reduced and the number of input terminals can be reduced, thereby making it possible to reduce the manufacturing cost.

Also according to the invention, two correction periods are provided in one scanning period and, when the display data are different between one scanning period and the previous scanning period, the intermediate level is once output as the output voltage of the segment side drive circuit in the first correction period which is near to the start point of the scanning period at the time of changing. Therefore spike noise superposed on the common side can be dispersed. When there is no change in the display data, the output is changed to the intermediate level in the second correction period, and therefore luminance unevenness due to the display pattern can be suppressed.

Also according to the invention, because the output voltage of the segment side drive circuit is once changed to the intermediate level when the display data does not change at the time the AC-converting signal is switched, namely when the output waveform changes, spike noise superposed on the common side can be dispersed and luminance unevenness can be reduced.

Also according to the invention, the second correction period provided for eliminating the luminance unevenness is made longer than the first correction period provided for reducing the spike noise superposed on the common side, and the amount of change in the output voltage in the second correction period is made smaller, thus making it possible to further reduce the spike noise superposed on the common side during correction for reducing the luminance unevenness.

Also according to the invention, because the correction clock generating means is incorporated in the segment side drive circuit, the number of input terminals of the segment side drive circuit can be reduced and, at the same time, the drive device can be made with the configuration of the conventional controller, thereby making the configuration of the drive device simple.

Further according to the invention, because the output voltage level during the correction period is changed to the intermediate voltage level when there is no change in the display data to be displayed in each scanning period on each pixel column which is driven by the segment side drive circuit, the effective voltage applied to the liquid crystal cell can be made identical regardless of whether there is a change in the display data or not. This makes it possible to make the effect of waveform rounding due to the electrical resistance of the electrodes and the capacitance of the liquid crystal cells constant even when the display pattern changes, and thereby eliminating the luminance unevenness and improving the display quality. Because correction is not applied when the display data changes, loss of the effective voltage can be minimized thereby suppressing the increase of current consumption to the minimum and eliminating the unevenness in display through proper correction of timing.

Also according to the invention, because the output voltage of the segment side drive circuit changes even when the display data of the consecutive scanning periods are the same in case the AC-converting signal changes, correction is not applied and decrease of effective voltage is minimized by avoiding unnecessary correction, thereby making it possible to eliminate unevenness in display further more effectively.

Also according to the invention, because output voltage of the segment side drive circuit does not change when the display data are different at the time the AC-converting signal for alternate drive changes, a correction period is provided to apply correction to the intermediate voltage. The effective voltage applied to the liquid crystal cell can be made constant regardless of the type of display pattern, while variations in the effective voltage can be reduced and luminance unevenness can be suppressed.

Also according to the invention, two correction periods are provided in one scanning period and the output voltage of the segment side drive circuit is once held at the intermediate level in the first correction period which is near to the start point of the scanning period when the display data changes, so that spikes superposed on the common side can be dispersed and reduced. In the second correction period, correction for the case when the display data does not change is applied, making it possible to reduce the luminance unevenness.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
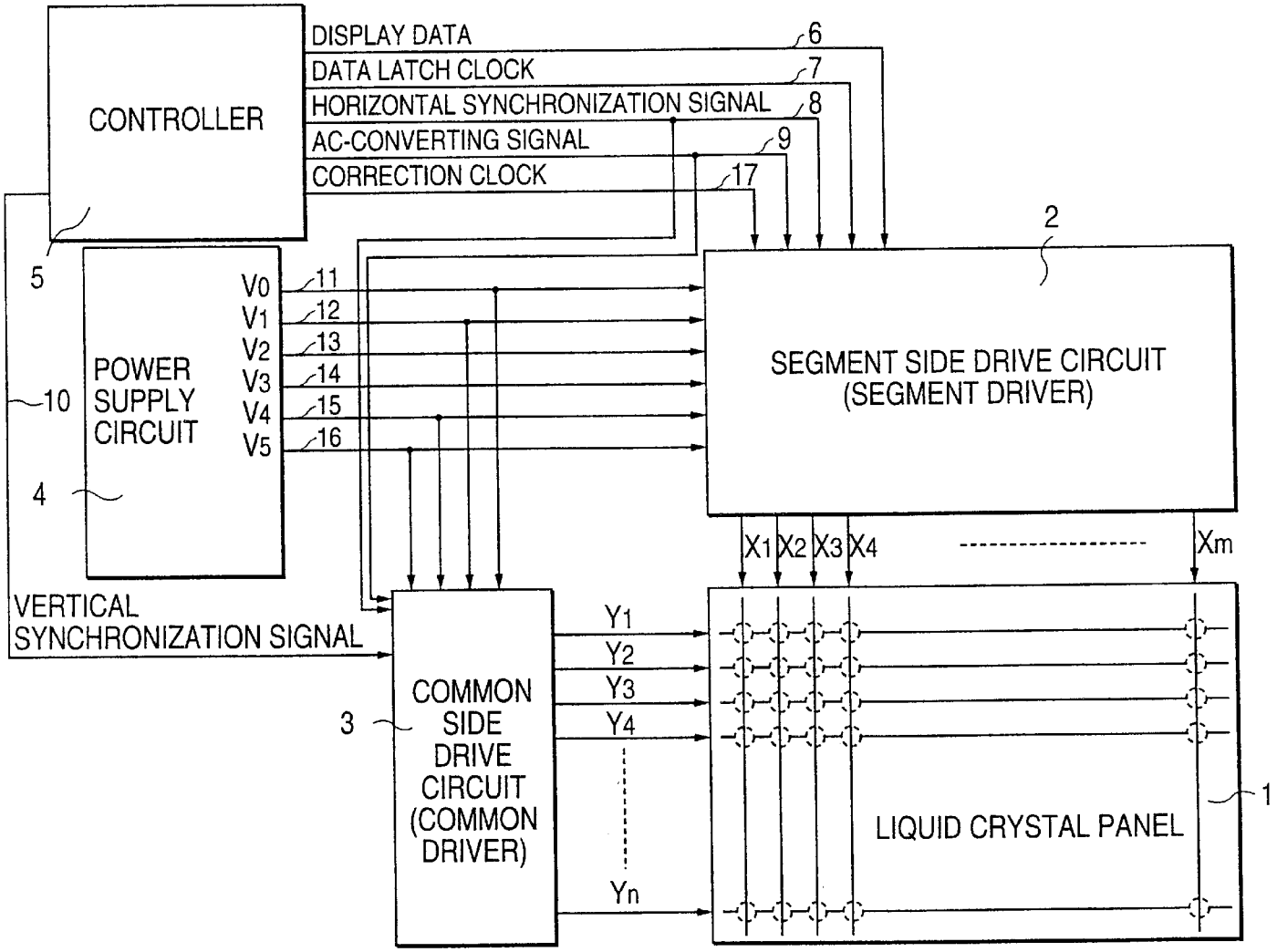
FIG. 1 is a block diagram showing a schematic electrical configuration for driving a liquid crystal panel of a first embodiment of the invention.

Now referring to the drawings, preferred embodiments of the invention are described below.

FIG. 1 shows the schematic electrical configuration of a drive device of a liquid crystal panel of a first embodiment of the invention. Segment electrodes of a liquid crystal panel 1, wherein a simple matrix is constituted of columns of segment electrodes X1, X2, X3, X4, . . . , Xm and rows of common electrodes Y1, Y2, Y3, Y4, . . . , Yn, are driven by a segment side drive circuit 2 and common electrodes are driven by a common side drive circuit 3. The segment side drive circuit 2 and the common side drive circuit 3 are supplied with power voltage and control signals from a power circuit 4 and a controller 5. The controller 5 supplies the segment side drive circuit 2 with display data via a display data line 6, data latch clock via data latch clock line 7, horizontal synchronization signal via a horizontal synchronization signal line 8 and AC-converting signal via an AC-converting signal line 9. The controller 5 supplies the common side drive circuit 3 with horizontal synchronization signal via the horizontal synchronization signal line 8, AC-converting signal via the AC-converting signal line 9 and vertical synchronization signal via a vertical synchronization signal line 10. The common side drive circuit 3 selects the common electrode Y1 of the first column when the vertical synchronization signal is given, and selects the common electrodes Y2, Y3, . . . that follow successively every time the horizontal synchronization signal is given. The power circuit 4 supplies six voltages V0, V1, V2, V3, V4 and V5 to the segment side drive circuit 2 via power voltage lines 11, 12, 13, 14, 15 and 16. These voltages V0 through V5 are related by inequality V0>V1>V2>V3>V4>V5. The common side drive circuit 3 is supplied with four voltages V0, V1, V4 and V5. The controller 5 supplies the segment side drive circuit 3 with a correction clock via a correction clock line 17. The segment side drive circuit 2 has an output control circuit incorporated therein, and corrects the output voltage only when there is no change in the output level over consecutive scanning periods according to the correction clock.

Figure 2:
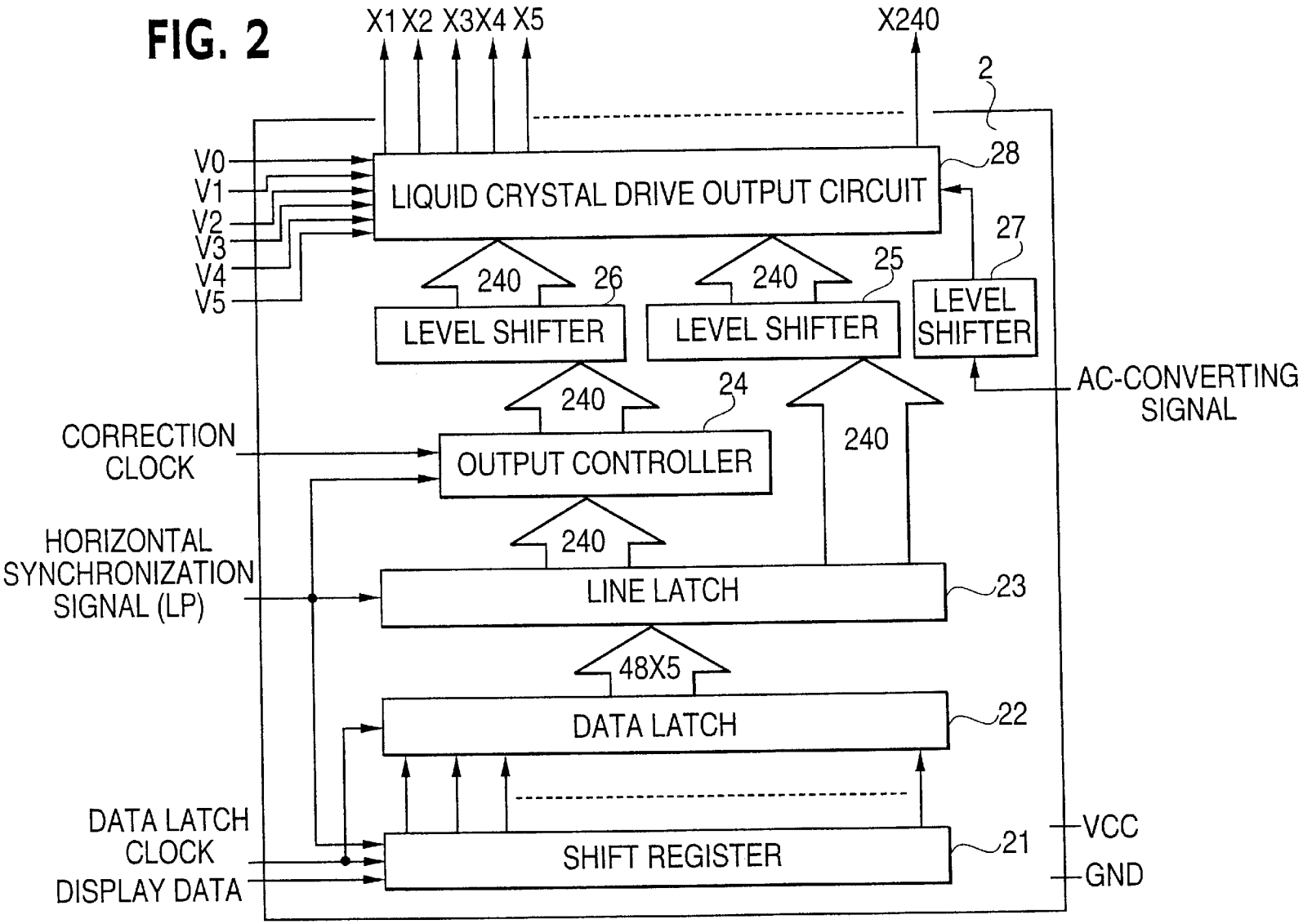
FIG. 2 is a block diagram showing an inner electrical configuration of a segment side drive circuit 2 of FIG. 1.

FIG. 2 shows the internal configuration of the segment side drive circuit 2 of FIG. 1. The segment side drive circuit enables it to drive 240 segment electrodes X1 through X240, for example. Of course any number of outputs other than the above can be driven. Display data for this number of outputs is supplied to a shift register 21 as serial signals. A data latch 22 latches the display data which has been converted to parallel signals in synchronization with a data latch clock. A line latch 23 latches the data held in the data latch 22 in synchronization with the horizontal synchronization signal (LP) and supplies the latched display data to an output controller 24 and a level shifter 25. The output controller 24, in response to the horizontal synchronization signal and the correction clock, determines whether the display data has changed from that at the time of a previous scanning or not. Output of the output controller 24 is given to a level shifter 26. The AC-converting signal is also given to a level shifter 27. The level shifters 25, 26 and 27 are used to convert the signal level from a power voltage Vcc which is, for example, 5V used for the operation of logic circuit of the segment side drive circuit 2, to a high voltage level required for driving the liquid crystal. Outputs from the level shifters 25, 26 and 27 are given to a liquid crystal drive output circuit 28. The liquid crystal drive output circuit 28 supplies an output voltage selected from among V0 through V5 to the segment electrodes X1 through X240 according to the display data, AC-converting signal and output control signal.

Figure 3:
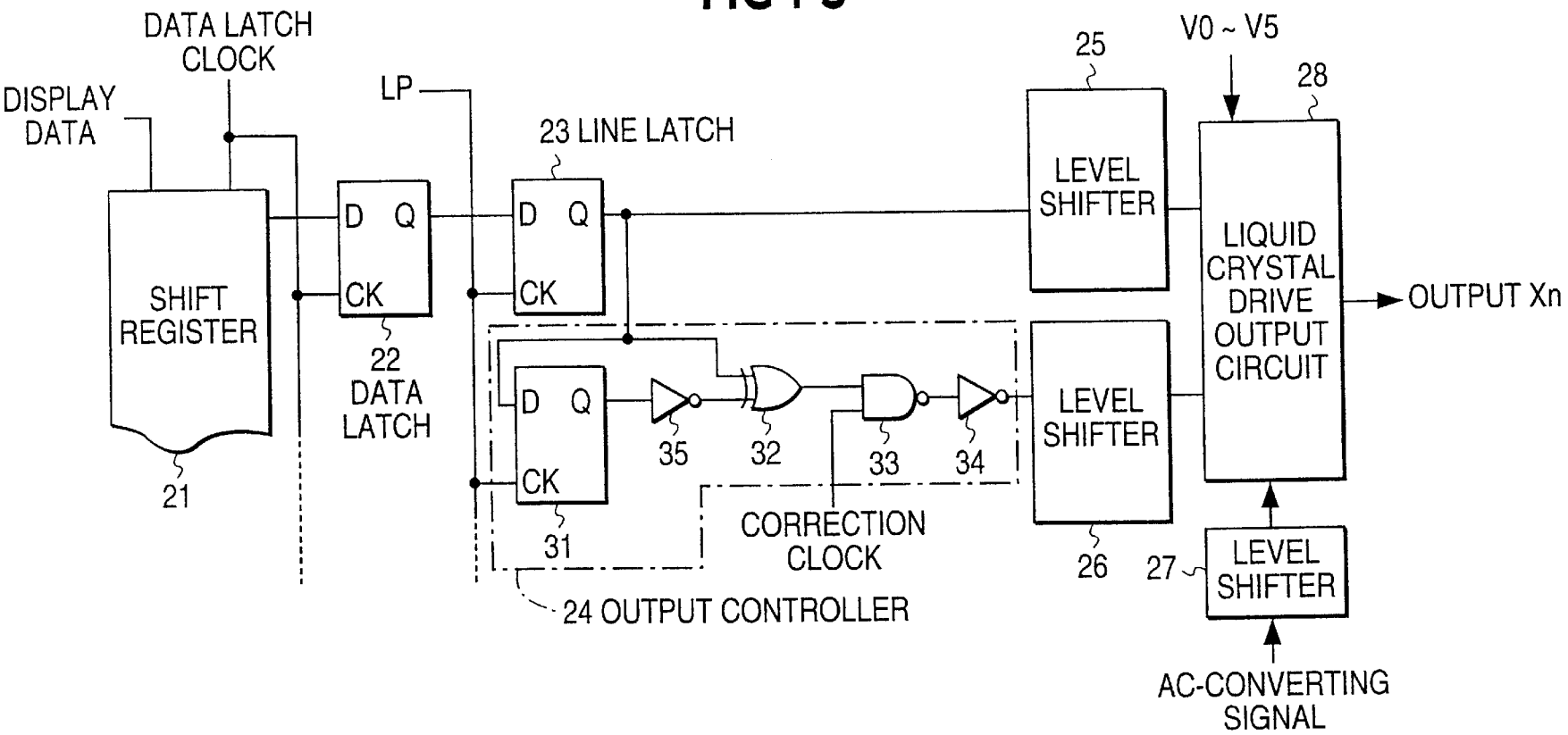
FIG. 3 is a block diagram showing a logical configuration related to an output controller 24 of FIG. 2.

FIG. 3 shows a more detailed configuration of the output controller 24 shown in FIG. 2 and a related circuit configuration. The data latch 22 and the line latch 23 are constituted of D flipflop circuits. The output controller 24 comprises a D flipflop circuit 31, an EXOR circuit 32, a NAND circuit 33 and inverter circuits 34, 35. The D flipflop circuit 31 receives output Q of the line latch circuit 23 being input to a data input D thereof. Supplied to a clock input CK of the D flipflop circuit 31 is horizontal synchronization signal (LP). Consequently, output of the D flipflop circuit 31 becomes output data of the line latch circuit 23 which precedes by one horizontal synchronization period. The EXOR circuit 32 which is display data comparison means receives the output Q of the line latch circuit 23 and output of the inverter circuit 35 which inverts the output Q of the D flipflop circuit 31 being input thereto. When the display data of the timing one horizontal synchronization period earlier and the present data are the same, output of the EXOR circuit 32 turns to high level and one of the inputs to the NAND circuit 33 turns to high level, and therefore output of the NAND circuit 33 turns to low level provided that the correction clock is at high level. This output is inverted by the inverter circuit 34 and is given to the level shifter 26.

Figure 4:
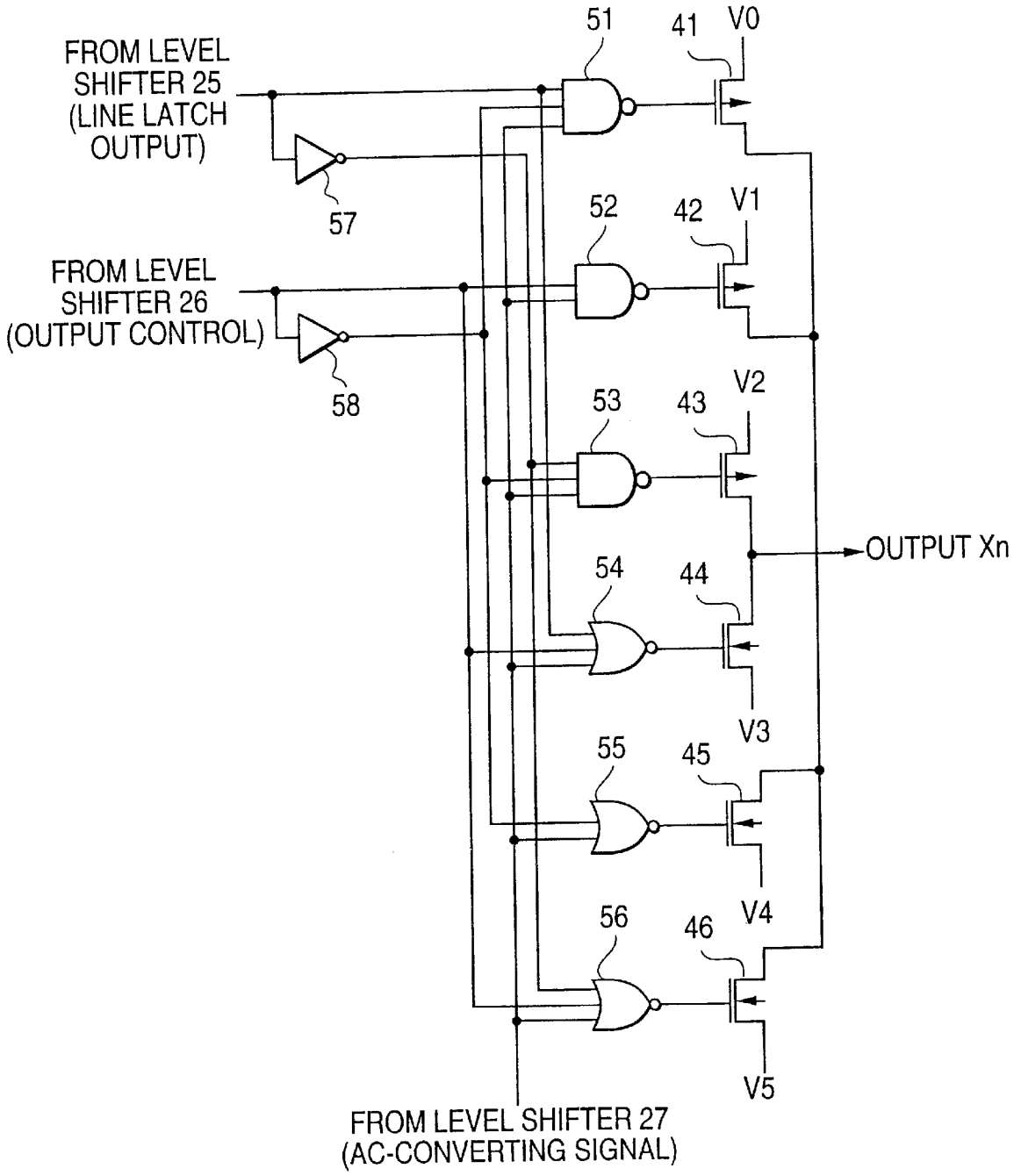
FIG. 4 is an electric circuit diagram of a liquid crystal drive output circuit 28 of FIG. 2.

FIG. 4 shows a configuration for one output circuit of the liquid crystal drive output circuit 28 shown in FIGS. 2 and 3. Output Xn is connected to drain electrodes of P channel MOS transistors 41, 42, 43 of which source electrodes are connected to power voltage V0 of ON level, power voltage V1 of correction voltage level and power voltage V2 of OFF level, respectively. Output Xn is also connected to drain electrodes of N channel MOS transistors 44, 45, 46 of which source electrodes are connected to power voltage V3 of OFF level, power voltage V4 of correction voltage level and power voltage V5 of ON level, respectively. Connected to the gate electrodes of the P channel MOS transistors 41, 42, 43 are output terminals of NAND circuits 51, 52, 53, respectively. Connected to the gate electrodes of N channel MOS transistors 44, 45, 46 are output terminals of NOR circuits 54, 55, 56, respectively. Input terminals of the NAND gates 51, 52, 53 receive output from the level shifter 25 or inversion thereof fed via an inverter circuit 57, and output from the level shifter 26 or inversion thereof fed via an inverter circuit 58, and output from the level shifter 27 supplied thereto. Truth values of the operation of the liquid crystal drive output circuit 28 are shown in Table 1.

TABLE 1

| Line latch output | Output control | AC-converting signal | Output Xn |
|---|---|---|---|
| H | L | H | V0 ON level |
| — | H | H | V1 Correction voltage level |
| L | L | H | V2 OFF level |
| L | L | L | V3 OFF level |
| — | H | L | V4 Correction voltage level |
| H | L | L | V5 ON level |

Figure 5:
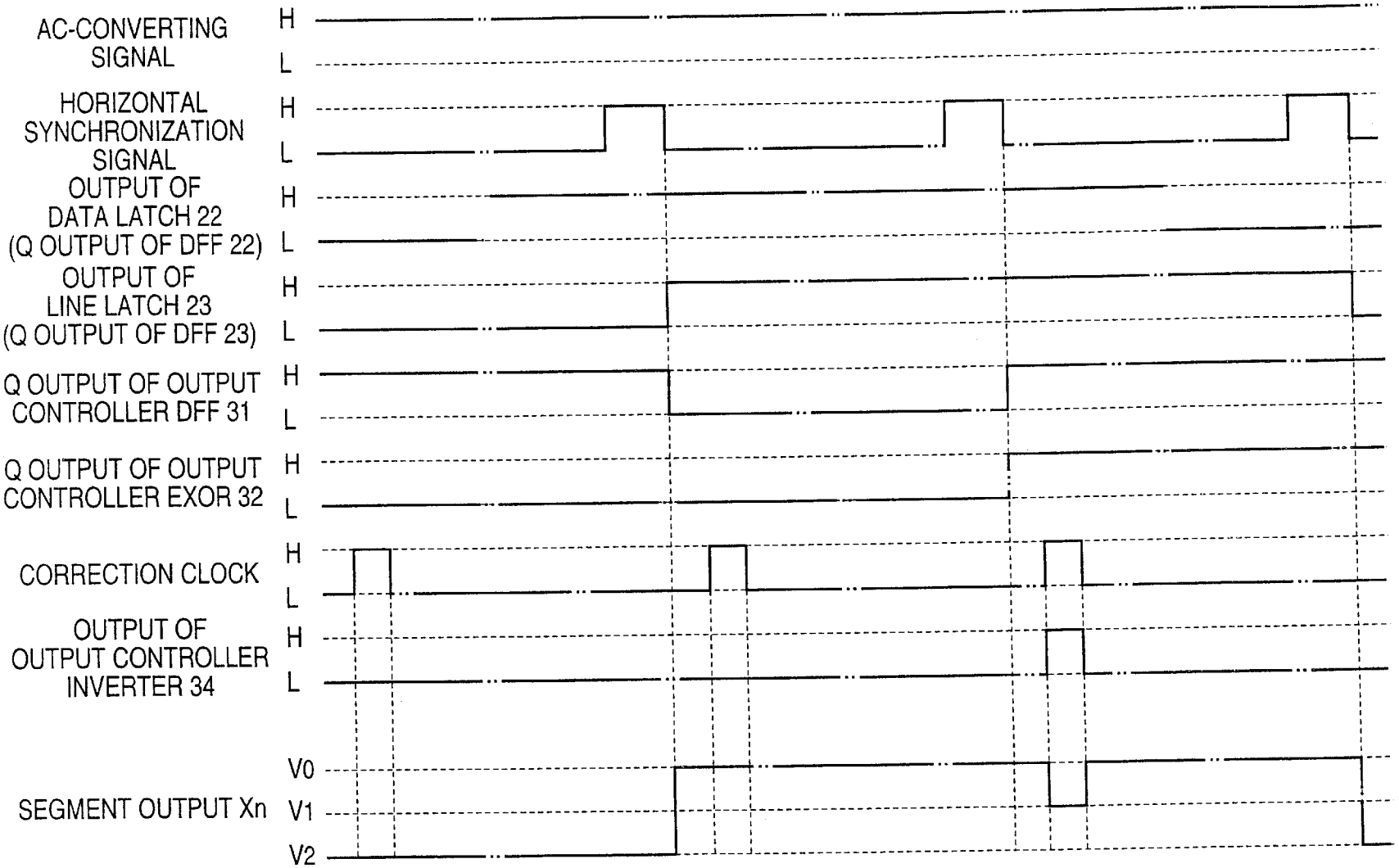
FIG. 5 is a timing chart showing an operation of a circuit shown in FIG. 3.

FIG. 5 shows more detailed configuration of the output controller 24 shown in FIG. 3, operation of a related circuit configuration and a timing chart of the operation of the liquid crystal drive output circuit 28 of FIG. 4. Liquid crystal drive voltage of each segment electrode is determined by the outputs of the level shifters 25, 26, 27 as shown in Table 1. Voltage V1 or V4 of the correction level is output only during such periods as the output of the level shifter 26 is high. Because the intermediate level V1 or V4 is the same as non-selective voltage given to the common side drive circuit 3, no special power source is required.

Figure 6:
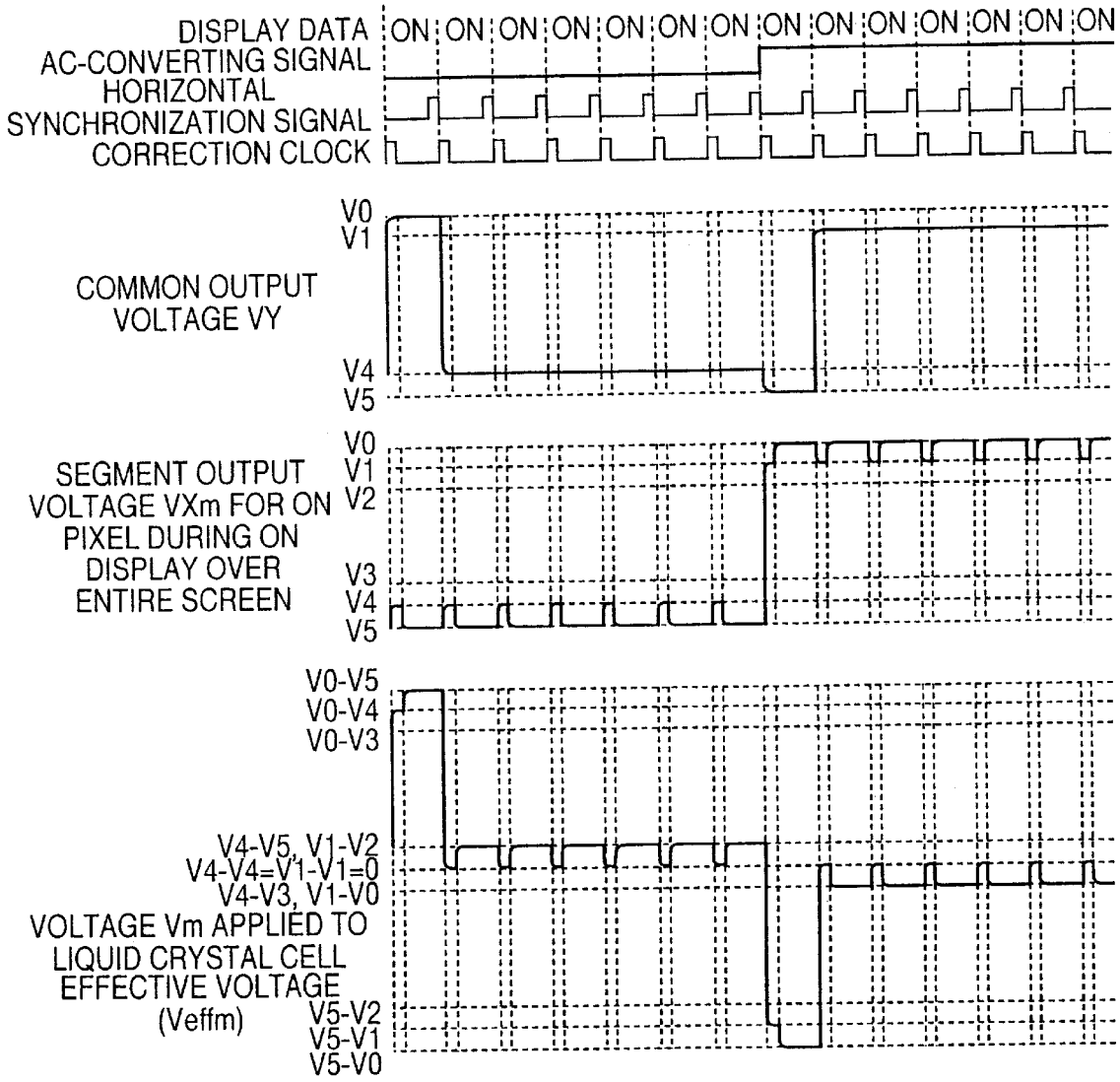
FIG. 6 is a timing chart showing changes in voltage at various portions of a drive circuit of FIG. 1.
Figure 7:
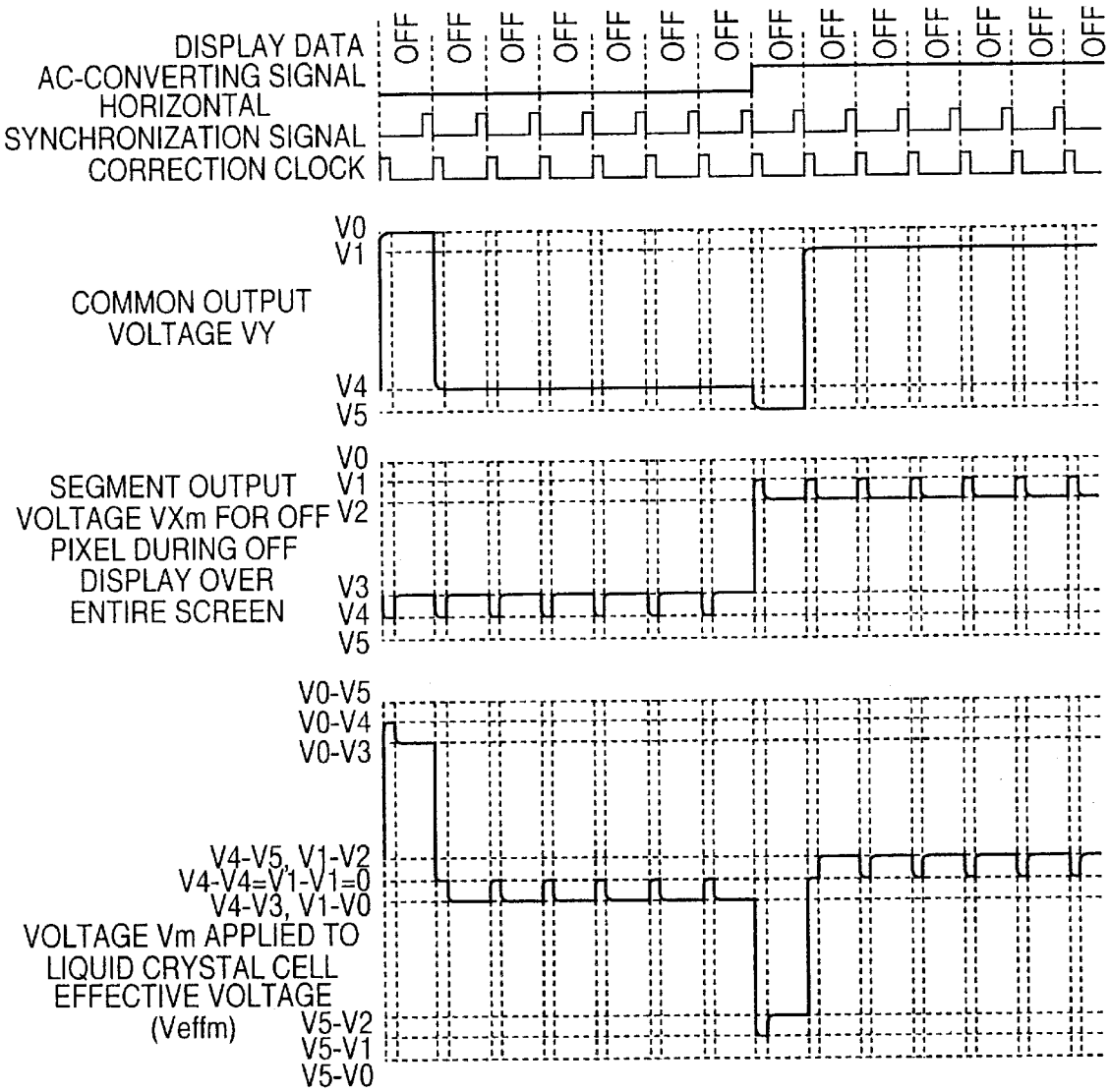
FIG. 7 is a timing chart showing changes in voltage at various portions of the drive circuit of FIG. 1.
Figure 8:
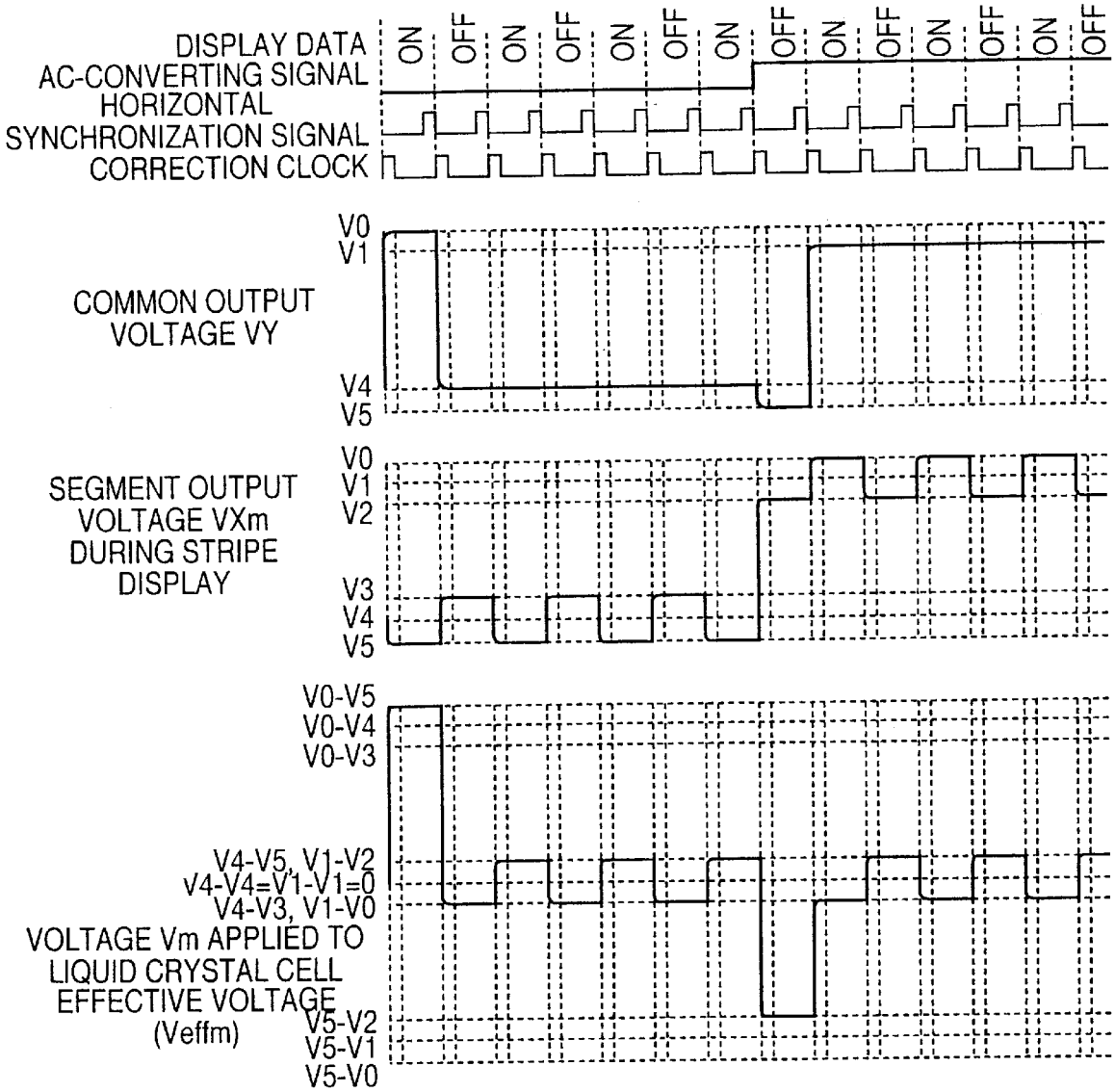
FIG. 8 is a timing chart showing changes in voltage at various portions of the drive circuit of FIG. 1.

FIG. 6, FIG. 7 and FIG. 8 show output waveforms of the drive circuits and waveforms applied to the liquid crystal cell in the cases of ON display over the entire screen, OFF display over the entire screen and stripe display, respectively. In these waveforms, the correction clock turns to high level immediately after the horizontal synchronization signal, but similar operation can be achieved with the correction clock turning to high at any timing provided that it is within the scanning period between horizontal synchronization signals. Although the number of scanning lines is assumed to be 7 for the convenience of description, the actual number is greater. Luminance unevenness due to the variation in the display pattern can be reduced by adjusting the effective voltage applied to the liquid crystal cell during ON display of FIGS. 6 and 8 and the effective voltage applied to the liquid crystal cell during OFF display of FIGS. 7 and 8 by means of the pulse width of the correction clock thereby equalizing the effective voltages. Although the correction voltage level is assumed to be the voltage at the time of non- selection supplied to the common side drive circuit, it may be another voltage level as far as it is an intermediate level between ON display level and OFF display level. Although D flipflop circuits are used for the data latch circuit 22, the line latch circuit 23 and the output controller circuit 24, these circuits may also be constituted by other type of latch circuits, such as half-latch circuit. According to this embodiment, during stripe display as shown in FIG. 8, correction is not applied to the segment output voltage and the effective value of voltage applied to the liquid crystal cell does not decrease.

Figure 9:
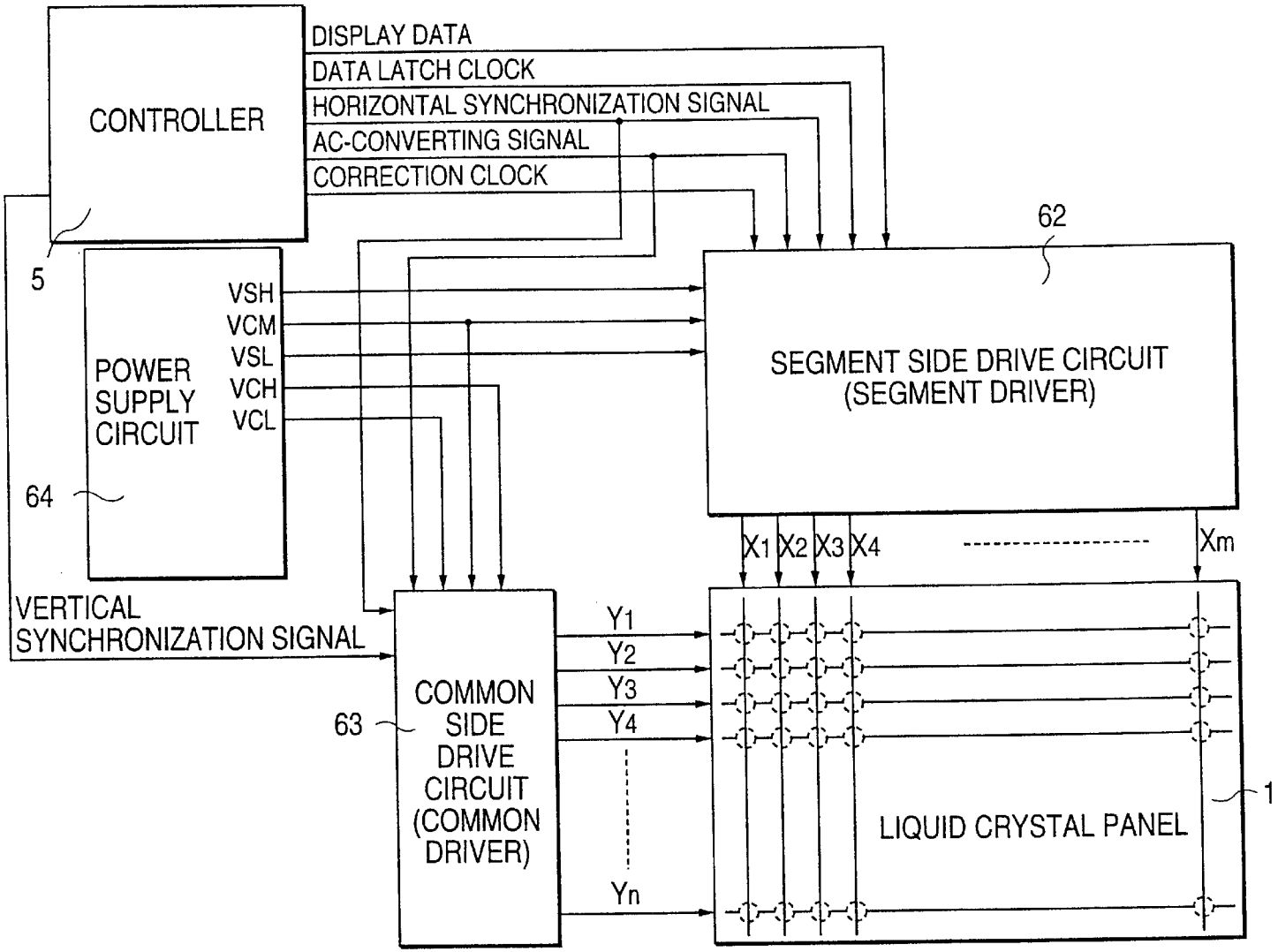
FIG. 9 is a block diagram showing a schematic electrical configuration for driving a liquid crystal panel of a second embodiment of the invention.

FIG. 9 shows the schematic electrical configuration of a drive device for the liquid crystal panel of a second embodiment of the invention. In this embodiment, a segment side drive circuit 62, a common side drive circuit 63 and a power circuit 64 achieve the 5V drive method. The power circuit 64 supplies the common side drive circuit 63 with three voltages VCH, VCM and VCL and the segment side drive circuit 62 with three voltages VSH, VCM and VSL. Components of this embodiment which correspond to those of the first embodiment will be identified with the same numerals and description thereof will be omitted.

Figure 10:
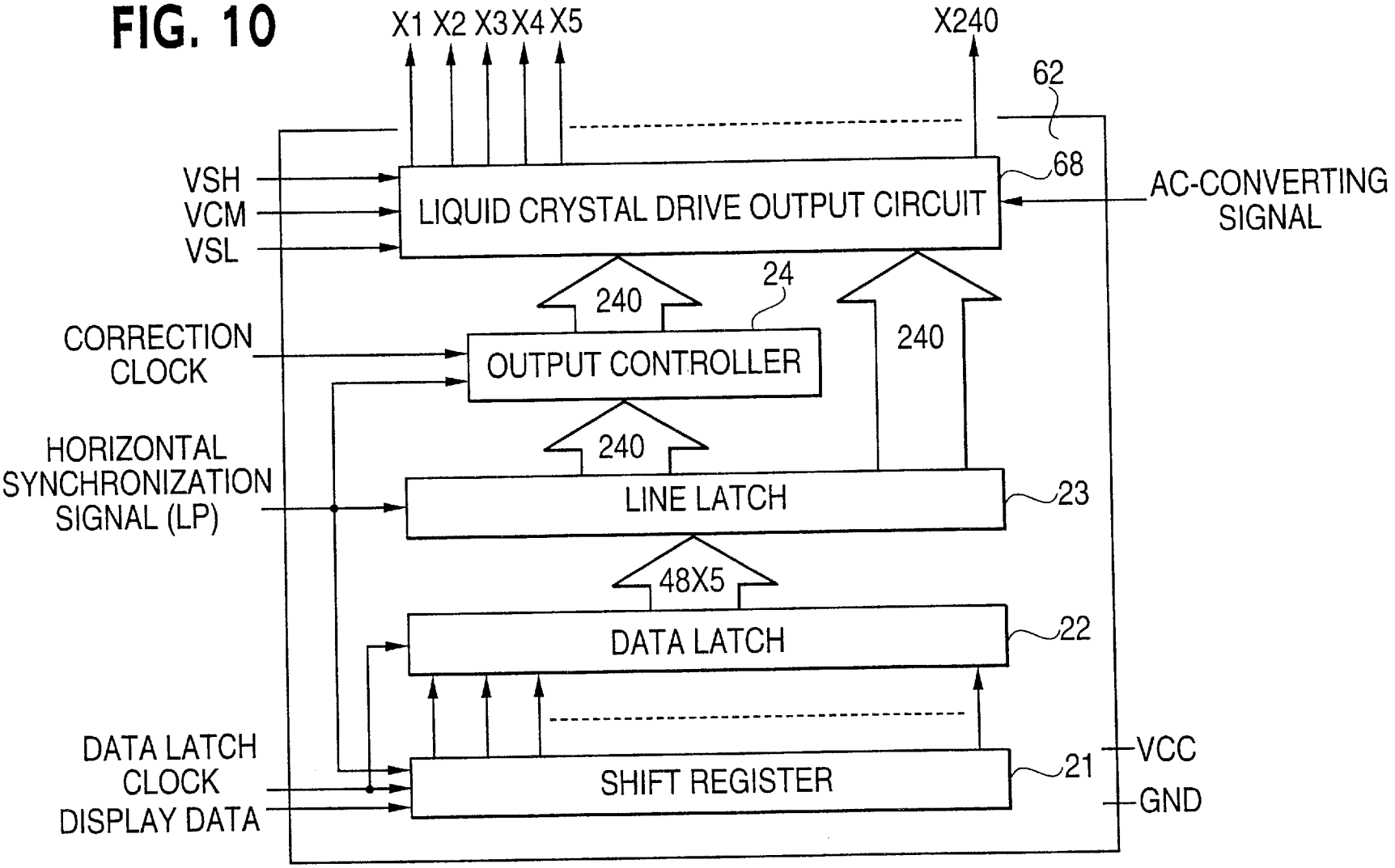
FIG. 10 is a block diagram showing an inner electrical configuration of a segment side drive circuit 62 of FIG. 9.
Figure 11:
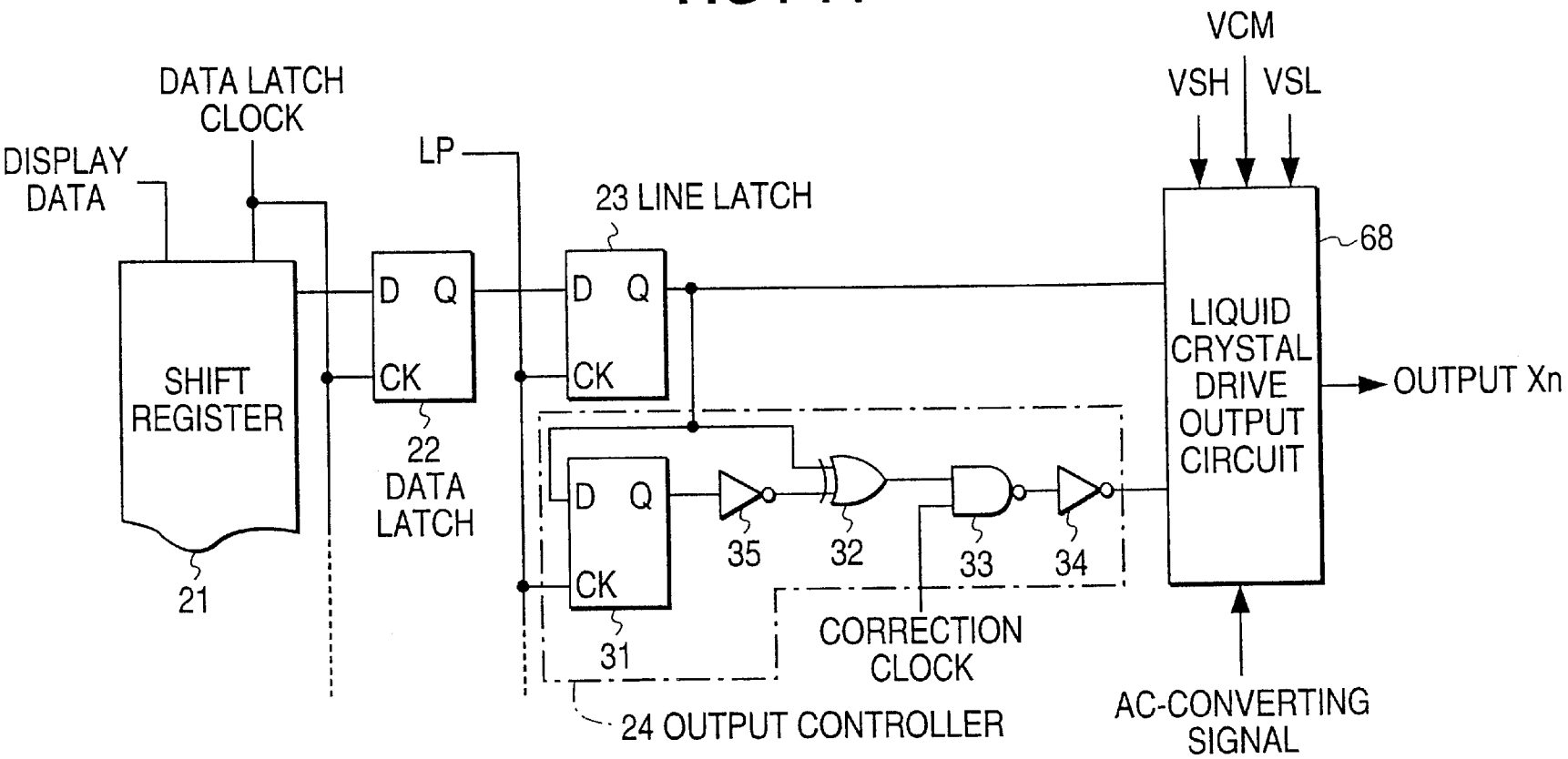
FIG. 11 is a block diagram showing a logical configuration related to an output controller 24 of FIG. 10.

FIG. 10 shows the inner configuration of the segment side drive circuit 62 of FIG. 9. This configuration is almost the same as the segment side drive circuit 2 of the first embodiment, except for whether the level shifters 25, 26, 27 are provided or not. This is because the segment side is driven with 5V, thus making level shift unnecessary and the output of the line latch 23 or the output controller 24 can be directly connected to the liquid crystal drive output circuit 68. As shown in FIG. 11, logic of the signals given to the liquid crystal drive output circuit 68 is similar to that shown in FIG. 3.

Figure 12:
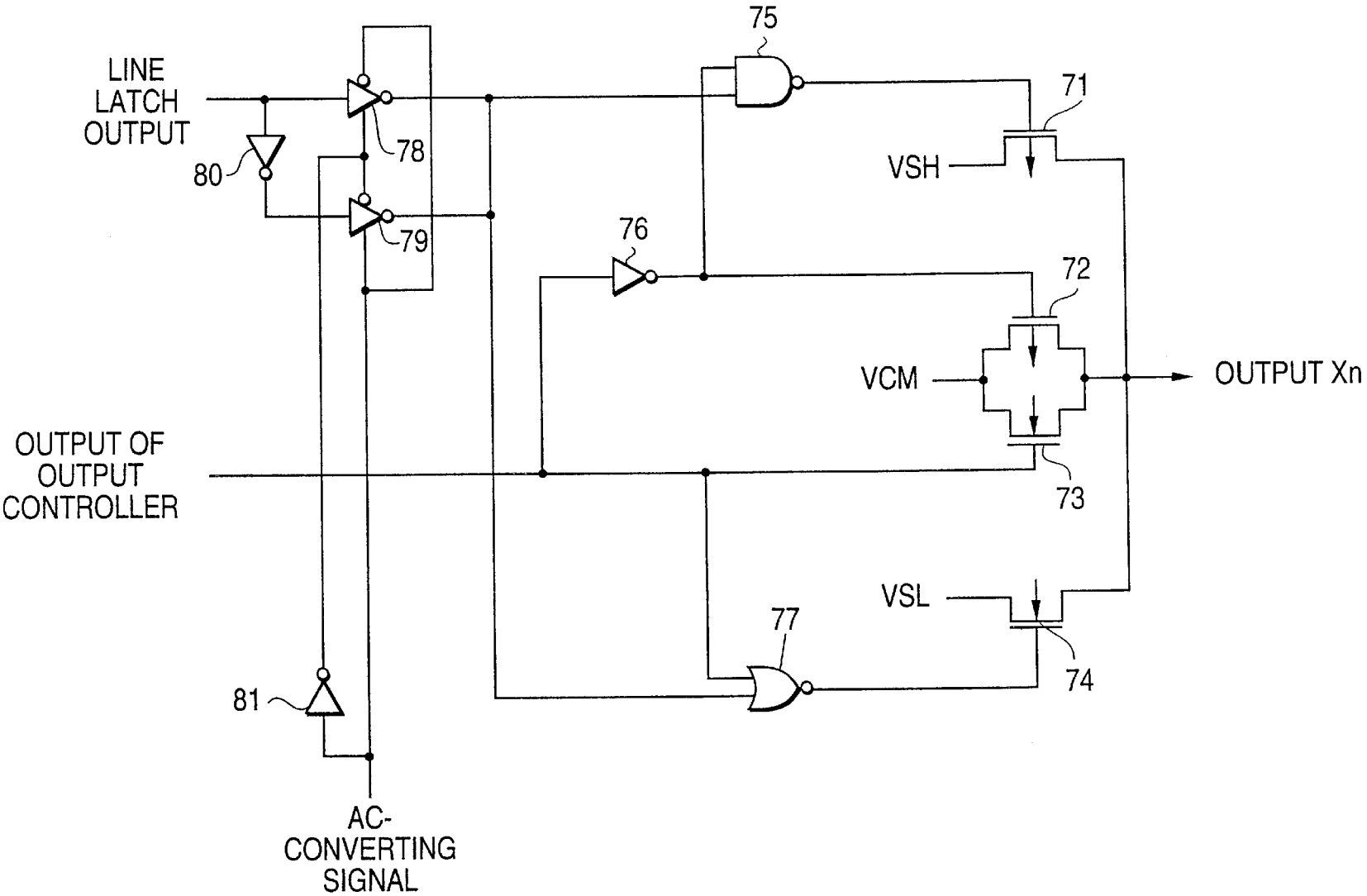
FIG. 12 is an electric circuit diagram of a liquid crystal drive output circuit 68 of FIG. 10.

FIG. 12 shows a circuit configuration for one segment electrode of the liquid crystal drive output circuit 68. Drain electrode of a P channel MOS transistor 71 of which source electrode is connected to VSH which is OFF or ON voltage level, drain electrode of a P channel MOS transistor 72 of which source electrode is connected to VCM which is correction voltage level, drain electrode of an N channel MOS transistor 73 of which source electrode is connected to correction voltage level VCM and drain electrode of an N channel MOS transistor 74 of which source electrode is connected to VSL which is ON or OFF voltage level are connected in common to the segment electrode of the output Xn. The gate electrodes of the P channel MOS transistors 71, 72 and the N channel MOS transistors 73, 74 receive line latch output, output of the output controller and AC-converting signal being input thereto via a logic circuit constituted of a NAND circuit 75, an inverter circuit 76, a NOR circuit 77, clocked inverter circuits 78, 79 and inverter circuits 80, 81. Truth values of the operations of these logic circuits are shown in Table 2.

TABLE 2

| Line latch output | Output control | AC-converting signal | Output Xn |
|---|---|---|---|
| H | L | H | VSH |
| L | L | H | VSL |
| L | L | L | VSH |
| H | L | L | VSL |
| — | H | — | VCM |

Figure 13:
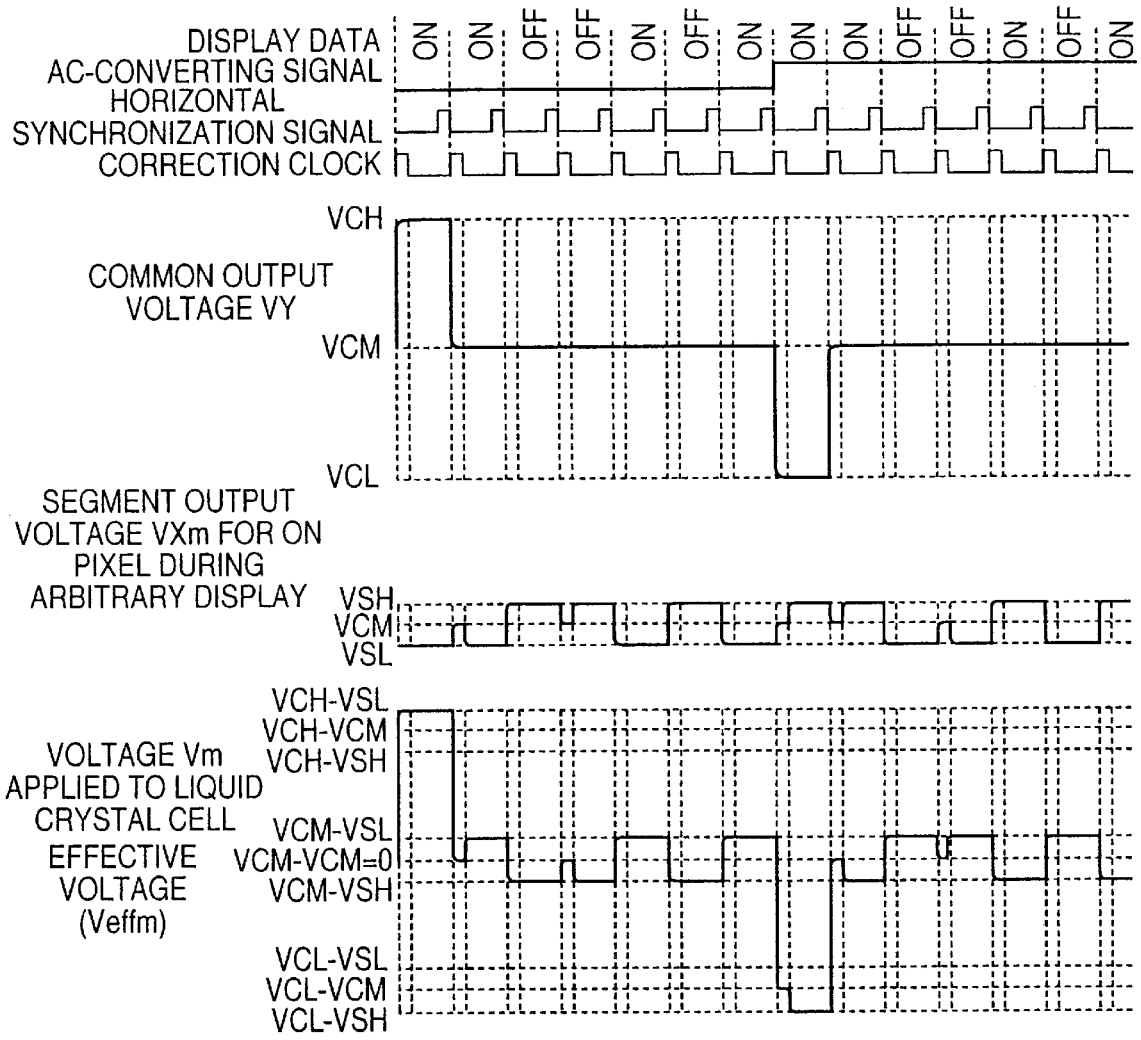
FIG. 13 is a timing chart showing waveforms at various portions of the embodiment of FIG. 9.

FIG. 13 shows output waveforms of the drive circuits and waveform applied to the liquid crystal cell in this embodiment. Although the period when correction is executed by means of the correction clock is provided immediately after the horizontal synchronization signal, similar operation can be achieved with the correction period provided at any timing provided that it is within the scanning period. Shadowing, which is luminance unevenness due to the variation in the display pattern, can be reduced by adjusting the effective voltage applied to the liquid crystal cell during ON display and the effective voltage applied to the liquid crystal cell during OFF display by means of the pulse width of the correction clock thereby equalizing the effective voltages. Because correction is not applied when the display data are not the same and switches between ON and OFF, loss of the effective voltage applied to the liquid crystal cell is small.

Although the configuration of this embodiment shown in FIGS. 10 and 11 does not include a level shifter, it is possible to constitute level shifters between the output controller 24 and the line latch 23, the liquid crystal drive output circuit 68 and at the input side of the AC-converting signal to the liquid crystal drive output circuit 68, thereby achieving 5V drive method wherein a control logic section which is the circuit from the output controller 24 to the line latch 23 and the liquid crystal drive output circuit 68 are driven by separate power sources. For example, it is possible to drive the control logic section with 3V and drive the liquid crystal drive output circuit with 5V. When such a configuration is employed, a liquid crystal drive device of lower power consumption can be achieved.

Figure 14:
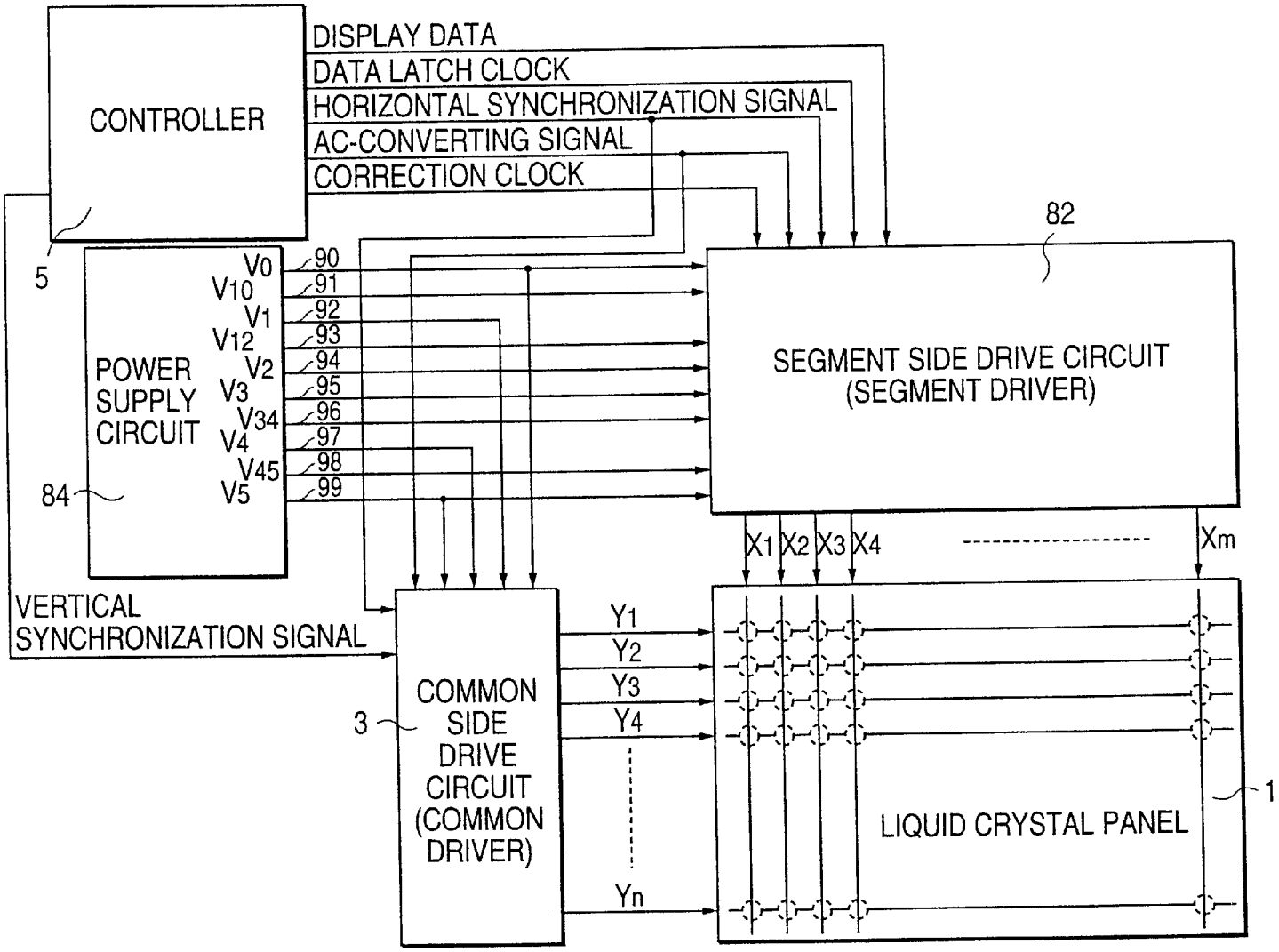
FIG. 14 is a block diagram showing a schematic electrical configuration for driving a liquid crystal panel of a third embodiment of the invention.

FIG. 14 shows a configuration for driving the liquid crystal panel of a third embodiment of the invention. In this embodiment, the segment side drive circuit 82 and the power circuit 84 are different from those of the first embodiment shown in FIG. 1, but other portions are the same and description thereof will be omitted. The power circuit 84 supplies the segment side drive circuit 82 with correction voltage levels V10, V45 for ON display, correction voltage levels V12, V34 for OFF display, ON display voltage levels V0, V5, and OFF display voltage levels V2, V3; 8 voltages in all. These 8 levels of voltage and voltages V1, V4 supplied to the common side drive circuit 3 are related by inequality V0>V10>V1>V12>V2>V3>V34>V4>V45>V5. These voltages are derived via power voltage lines 90, 91, 92, 93, 94, 95, 96, 97, 98 and 99, while V0, V10, V12, V2, V3, V34, V45 and V5 among these are supplied to the segment side drive circuit 82. What is different from the first embodiment shown in FIG. 1 is that the correction voltage level during ON display and the voltage level during OFF display are different. Usually, because the dielectric constant of the liquid crystal cell when ON and the dielectric constant when OFF are different, correction is applied by setting the correction voltage during ON and the correction voltage during OFF display at different levels. In effect, reduction of luminance unevenness due to shadowing can be controlled separately depending on whether the display is ON display or OFF display.

By setting the correction voltage during ON and the correction voltage during OFF at different levels thereby to reduce the voltage change in a correction period, it is made possible to reduce the current consumption and apply finer adjustment of the correction voltage, thereby reducing the luminance unevenness further.

Figure 15:
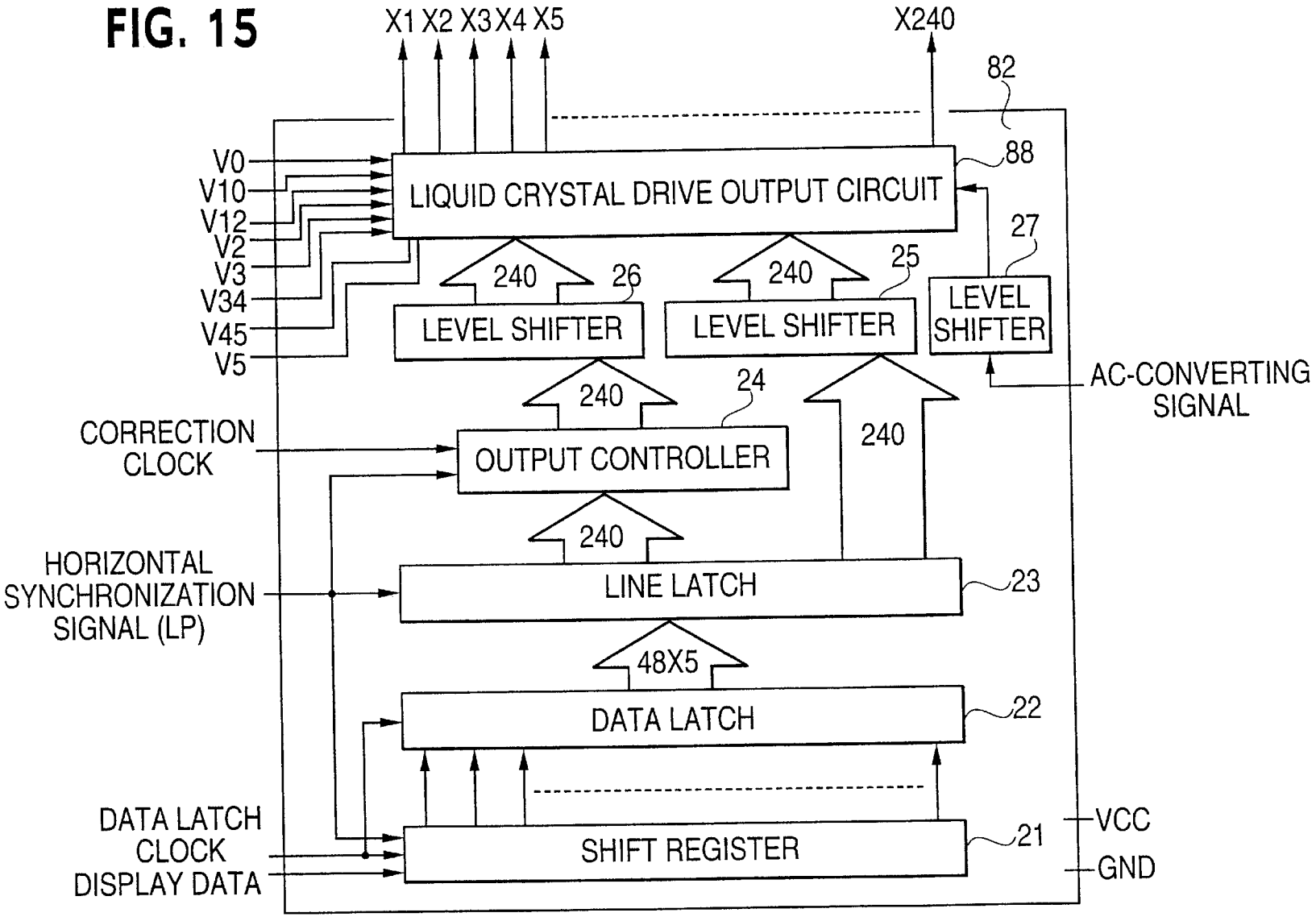
FIG. 15 is a block diagram showing an inner electrical configuration of a segment side drive circuit 82 of FIG. 14.

FIG. 15 shows the configuration of the segment side drive circuit 82 shown in FIG. 14. This configuration is similar to that of the segment side drive circuit 2 of the first embodiment shown in FIG. 2, with only the portion of liquid crystal drive output circuit 88 is different.

Figure 16:
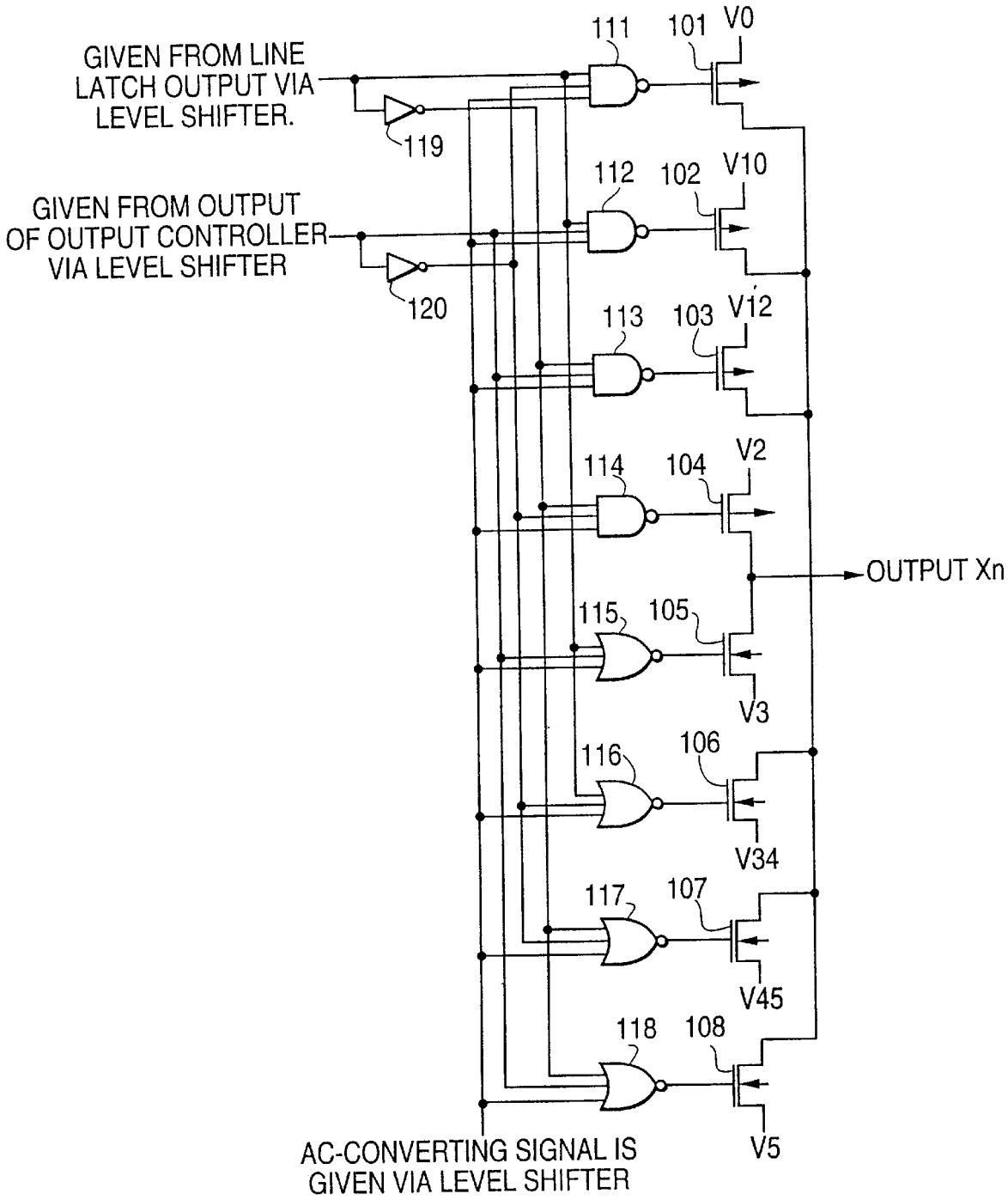
FIG. 16 is an electric circuit diagram of a liquid crystal drive output circuit 88 of FIG. 15.

FIG. 16 shows a configuration for one segment electrode of the liquid crystal drive output circuit 88 shown in FIG. 15. Drain electrodes of P channel MOS transistors 101, 102, 103 and 104 of which source electrodes are connected to V0, V10, V12 and V2, respectively, and drain electrodes of N channel MOS transistors 105, 106, 107 and 108 of which source electrodes are connected to V3, V34, V45 and V5, are connected in common to each segment electrode Xn. Gate electrodes of the P channel MOS transistors 101, 102, 103 and 104 are connected to the output terminals of the NAND circuits 111, 112, 113 and 114, respectively. Gate electrodes of the N channel MOS transistors 105, 106, 107 and 108 are connected to the output terminals of the NOR circuits 115, 116, 117 and 118, respectively. Input sides of the NAND circuits 111, 112, 113 and 114 and the NOR circuits 115, 116, 117 and 118 receive signal by passing the output of the line latch 23 through the level shifter 25, inverted signal obtained by passing the former signal through an inverter circuit 119, signal by passing the output of the output controller 24 through the level shifter 26, inverted signal obtained by passing the former signal through an inverter circuit 120 and a signal obtained by passing the AC-converting signal through the level shifter 27 being input thereto. Truth values of these logic operations are shown in Table 3.

TABLE 3

| Line latch output | Output control | AC-converting signal | Output Xn |
|---|---|---|---|
| H | L | H | V0 |
| H | H | H | V10 |
| L | H | H | V12 |
| L | L | H | V2 |
| L | L | L | V3 |
| L | H | L | V34 |
| H | H | L | V45 |
| H | L | L | V5 |

Figure 17:
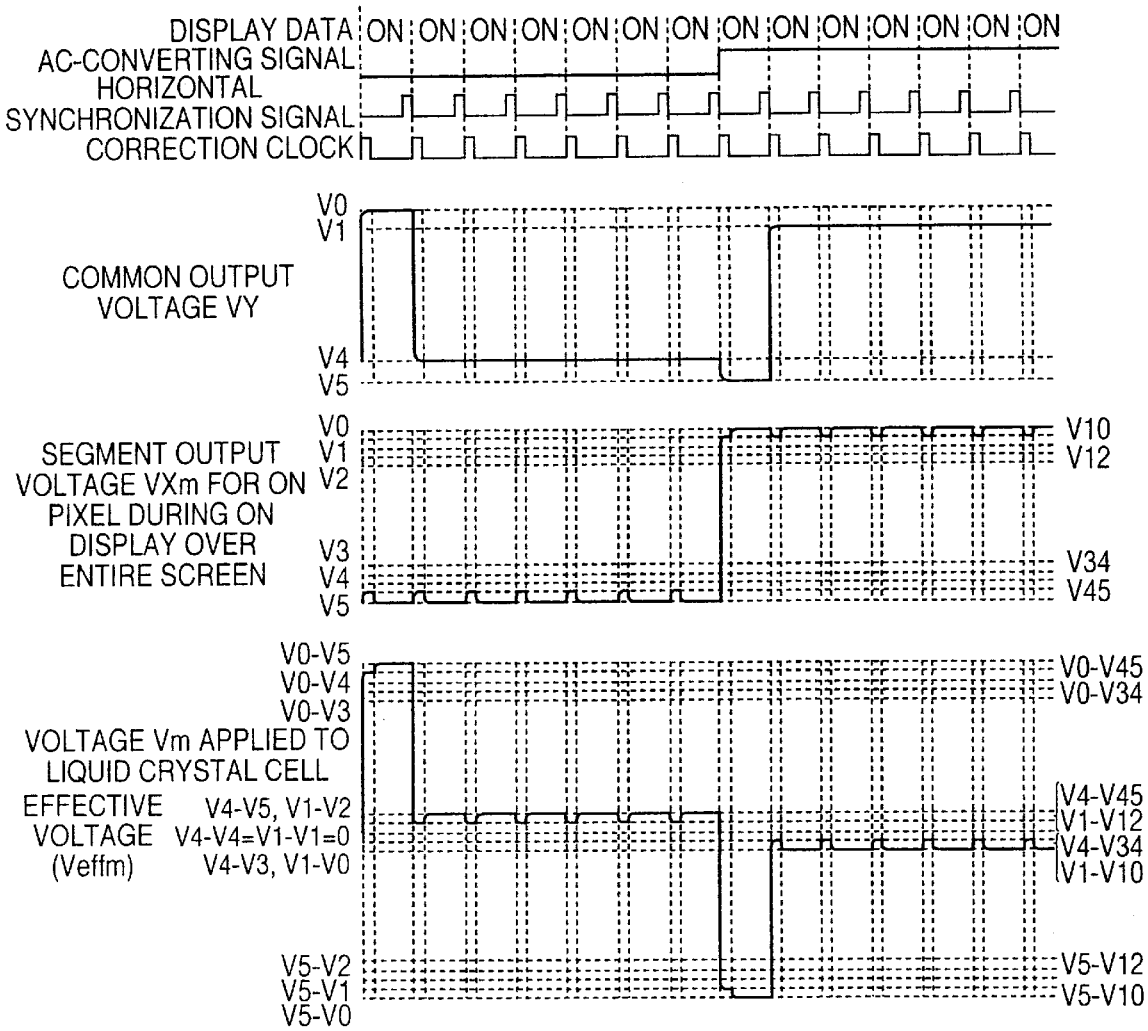
FIG. 17 is a timing chart showing voltage waveforms at various portions of the embodiment of FIG. 14.
Figure 18:
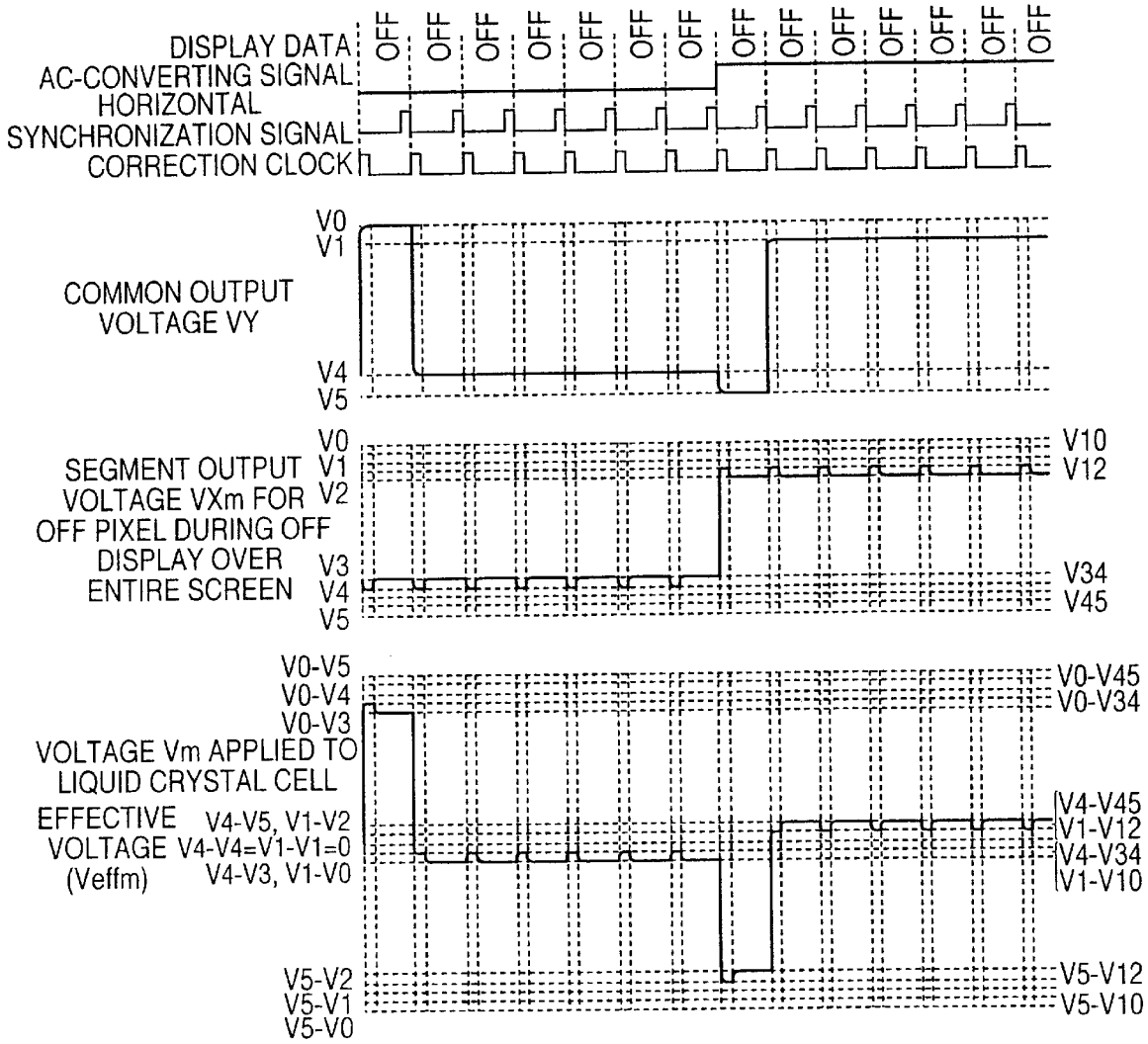
FIG. 18 is a timing chart showing voltage waveforms at various portions of the embodiment of FIG. 14.
Figure 19:
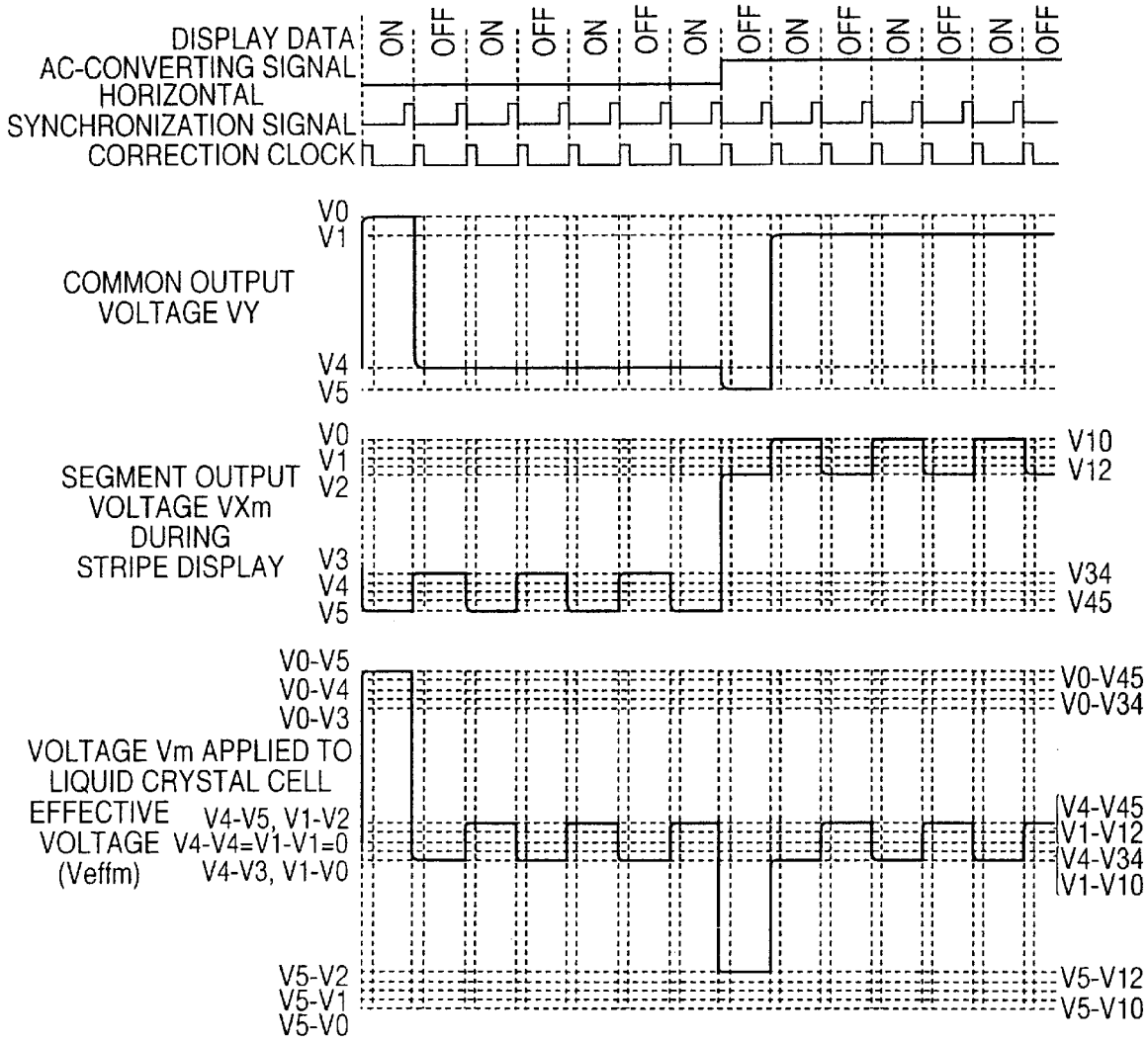
FIG. 19 is a timing chart showing voltage waveforms at various portions of the embodiment of FIG. 14.

FIGS. 17, 18 and 19 show output waveforms during ON display over the entire screen, OFF display over the entire screen and stripe display and waveform applied to the liquid crystal cell, respectively, in this embodiment. Similarly to the previous embodiment, the period during which the correction clock is applied and the number of scan electrodes may be different. Luminance unevenness due to the variation in the display pattern can be reduced by adjusting the effective voltage applied to the liquid crystal cell during ON display of FIGS. 17 and 19 and the effective voltage applied to the liquid crystal cell during OFF display of FIGS. 18 and 19 by means of the pulse width of the correction clock, thereby equalizing the effective voltages.

Figure 20:
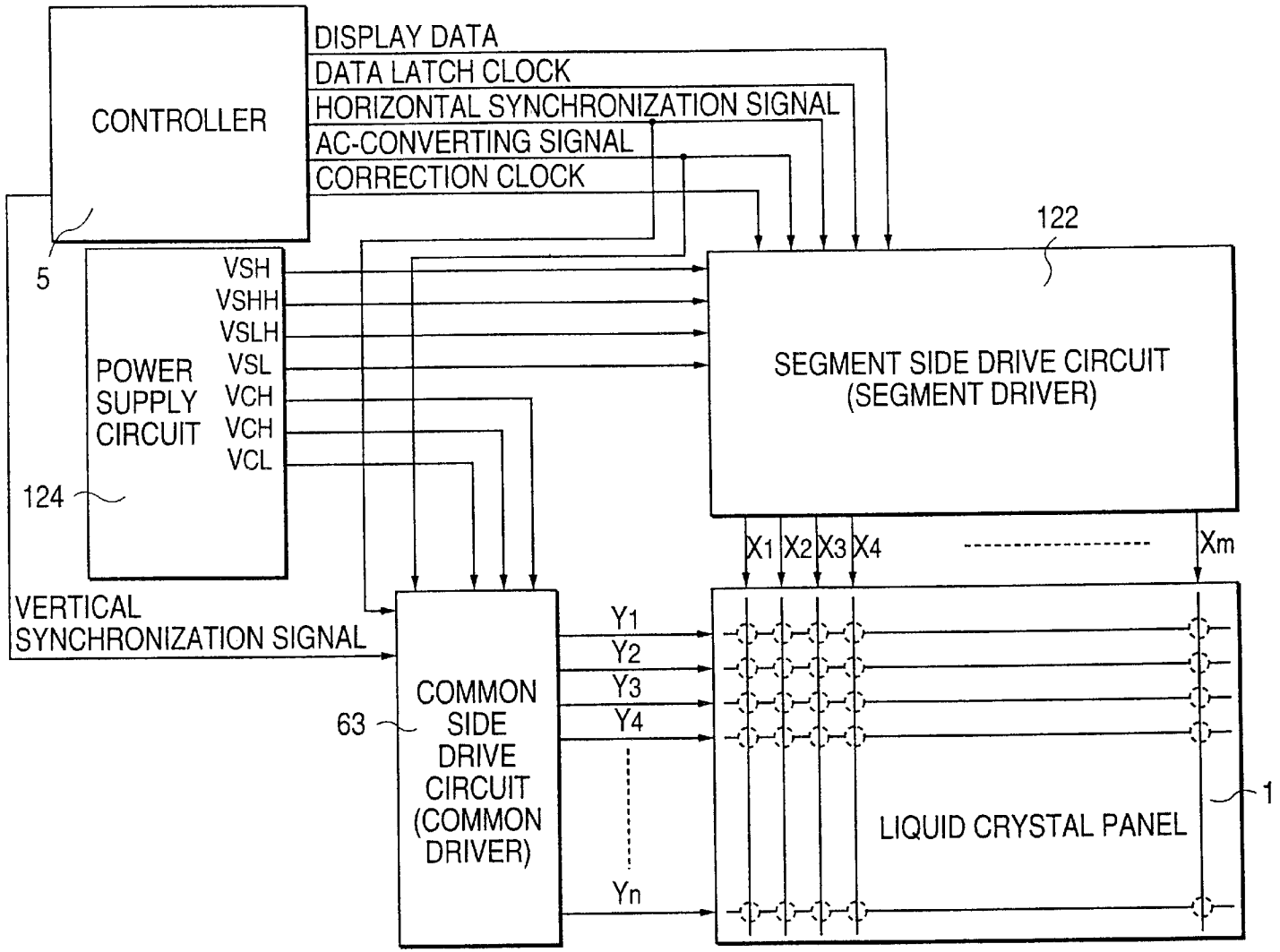
FIG. 20 is a block diagram showing a schematic electrical configuration for driving a liquid crystal panel of a fourth embodiment of the invention.

FIG. 20 shows a configuration in a case where the third embodiment is applied to the 5V drive method of a fourth embodiment of the invention. A segment side drive circuit 122, a power circuit 124 and a common side drive circuit 63 are modified for 5V drive method. This configuration is similar to the segment side drive circuit 82 shown in FIG. 15 except that the segment side drive circuit 122 does not include a level shifter and the configuration of the liquid crystal drive output circuit 128 is different because the type of power voltage is different, as shown in FIG. 21.

Figure 21:
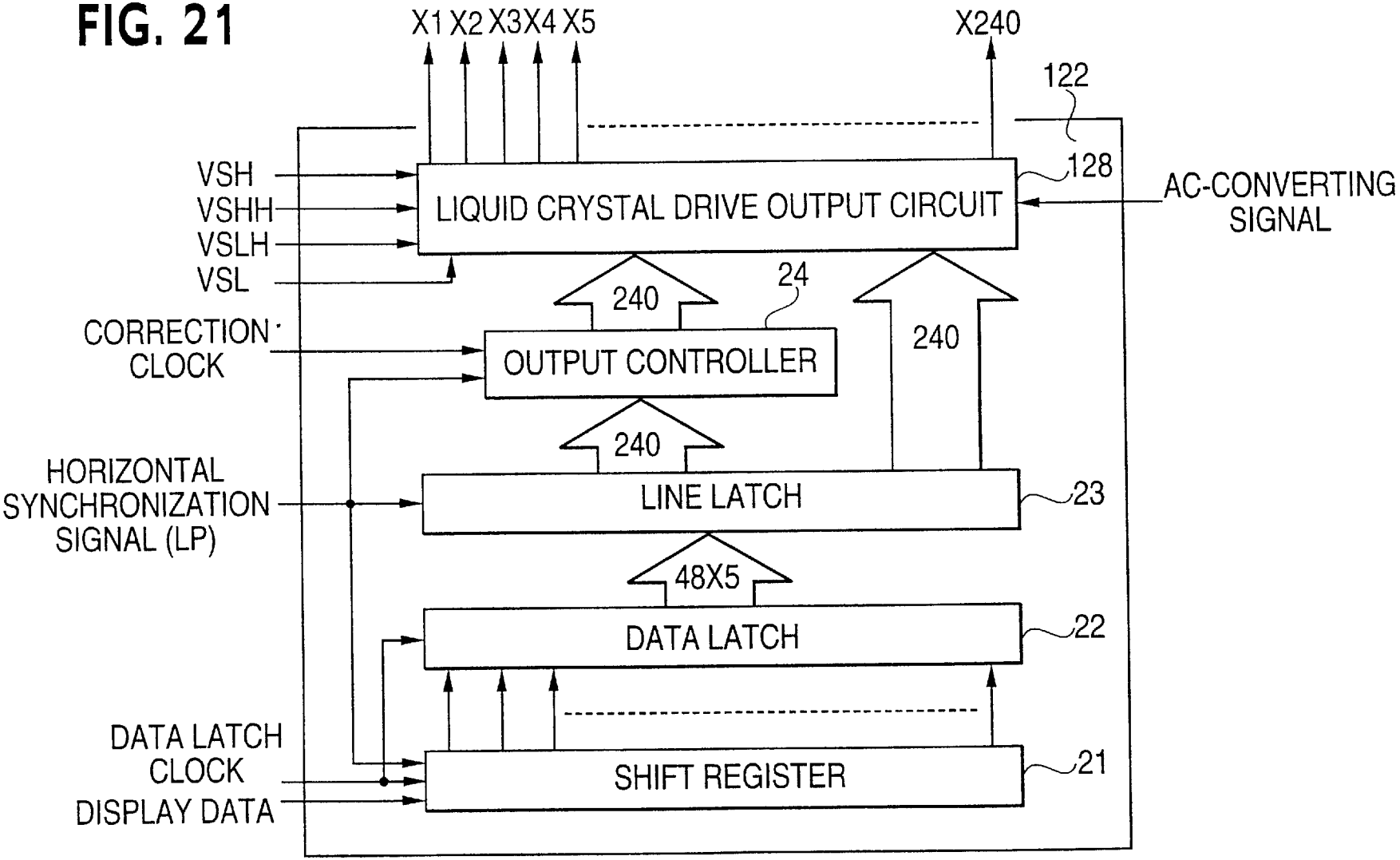
FIG. 21 is a block diagram showing an inner electrical configuration of a segment side drive circuit 122 of FIG. 20.
Figure 22:
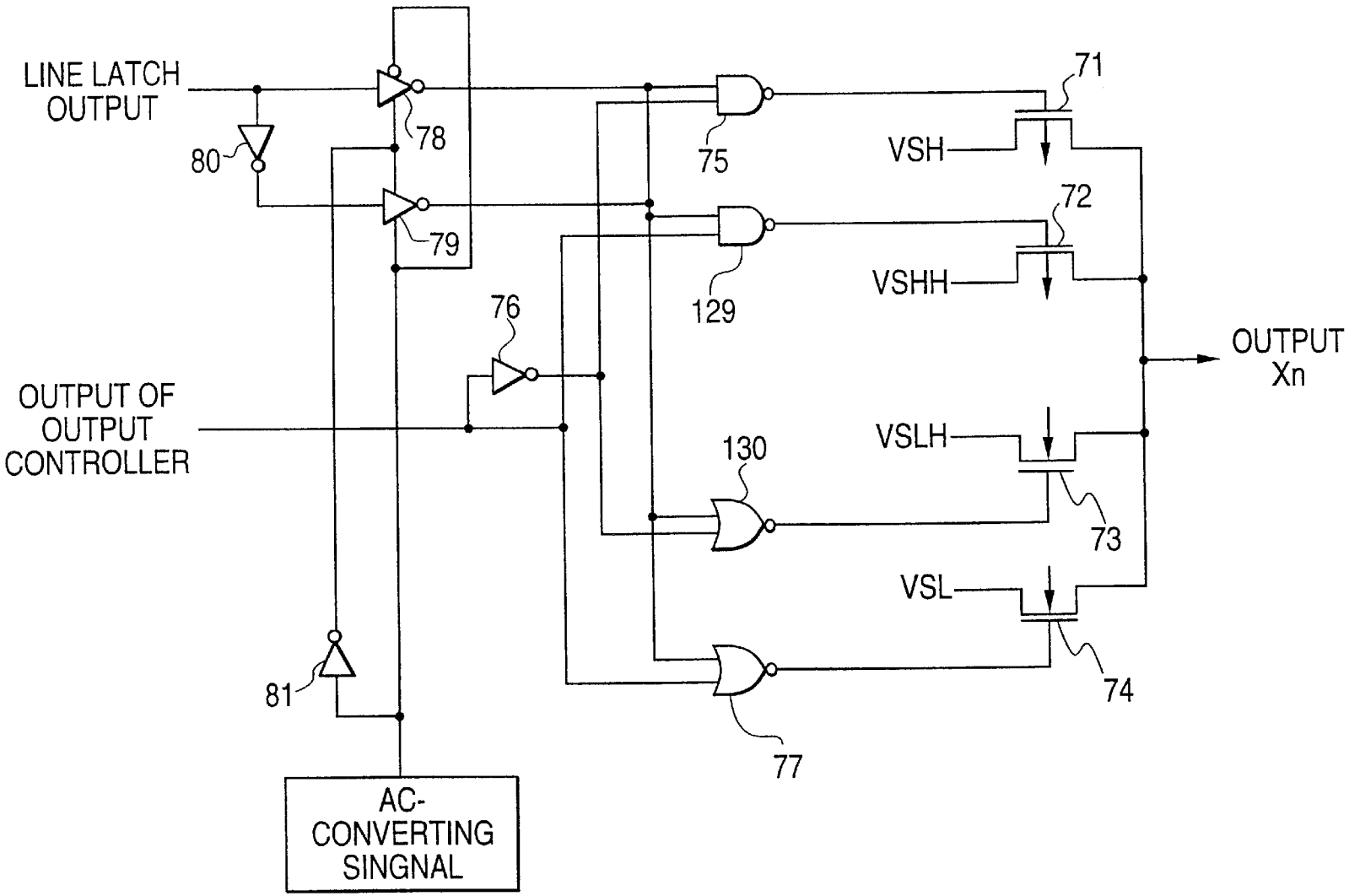
FIG. 22 is an electric circuit diagram of a liquid crystal drive output circuit 128 of FIG. 21.

FIG. 22 shows the configuration of one segment electrode of the liquid crystal drive output circuit 128 of FIG. 21. The operation is roughly the same as that of the configuration of the second embodiment shown in FIG. 12, except that source electrode of the P channel MOS transistor 72 is connected to VSHH voltage and source electrode of the N channel MOS transistor 73 is connected to VSLH voltage. The logic circuit which drives the gate electrodes of the P channel MOS transistors 71, 72 and the N channel MOS transistors 73, 74 includes a NAND circuit 129 and a NOR circuit 130 added thereto in addition to the NAND circuit 75, the inverter circuit 76, the NOR circuit 77, the clocked inverter circuits 78, 79 and the inverter circuits 80, 81. Truth values of the operations of these logic circuits are shown in Table 4.

TABLE 4

| Line latch output | Output control | AC-converting signal | Output Xn |
|---|---|---|---|
| H | L | H | VSH |
| H | H | H | VSHH |
| L | H | H | VSLH |
| L | L | H | VSL |
| L | L | L | VSH |
| L | H | L | VSHH |
| H | H | L | VSLH |
| H | L | L | VSL |

Figure 23:
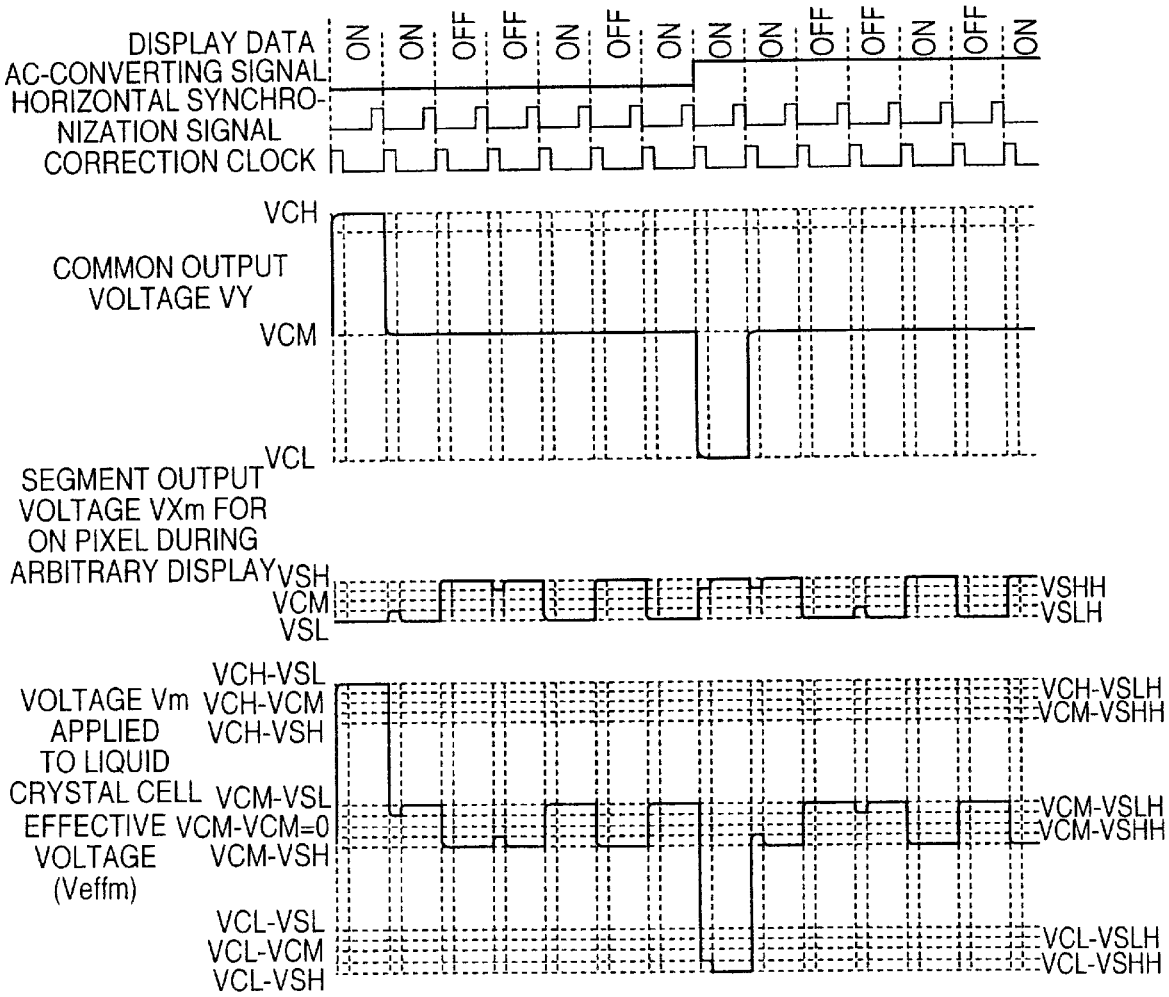
FIG. 23 is a timing chart showing voltage waveforms at various portions of the embodiment of FIG. 20.

FIG. 23 shows output waveforms and voltage waveform applied to the liquid crystal cell in this embodiment. Although the voltage waveforms applied to the liquid crystal cell is basically the same as those of FIGS. 6 through 8, the correction voltage level selected by the liquid crystal drive output circuit is different.

Although the configuration of this embodiment does not include a level shifter similar to the second embodiment, it is possible to achieve the 5V drive method such as the control logic section which is the circuit from the output controller 24 to the line latch 23 and the liquid crystal drive output circuit are driven by separate power sources. For example, it is possible to drive the control logic section with 3V and drive the liquid crystal drive output circuit with 5V.

Figure 24:
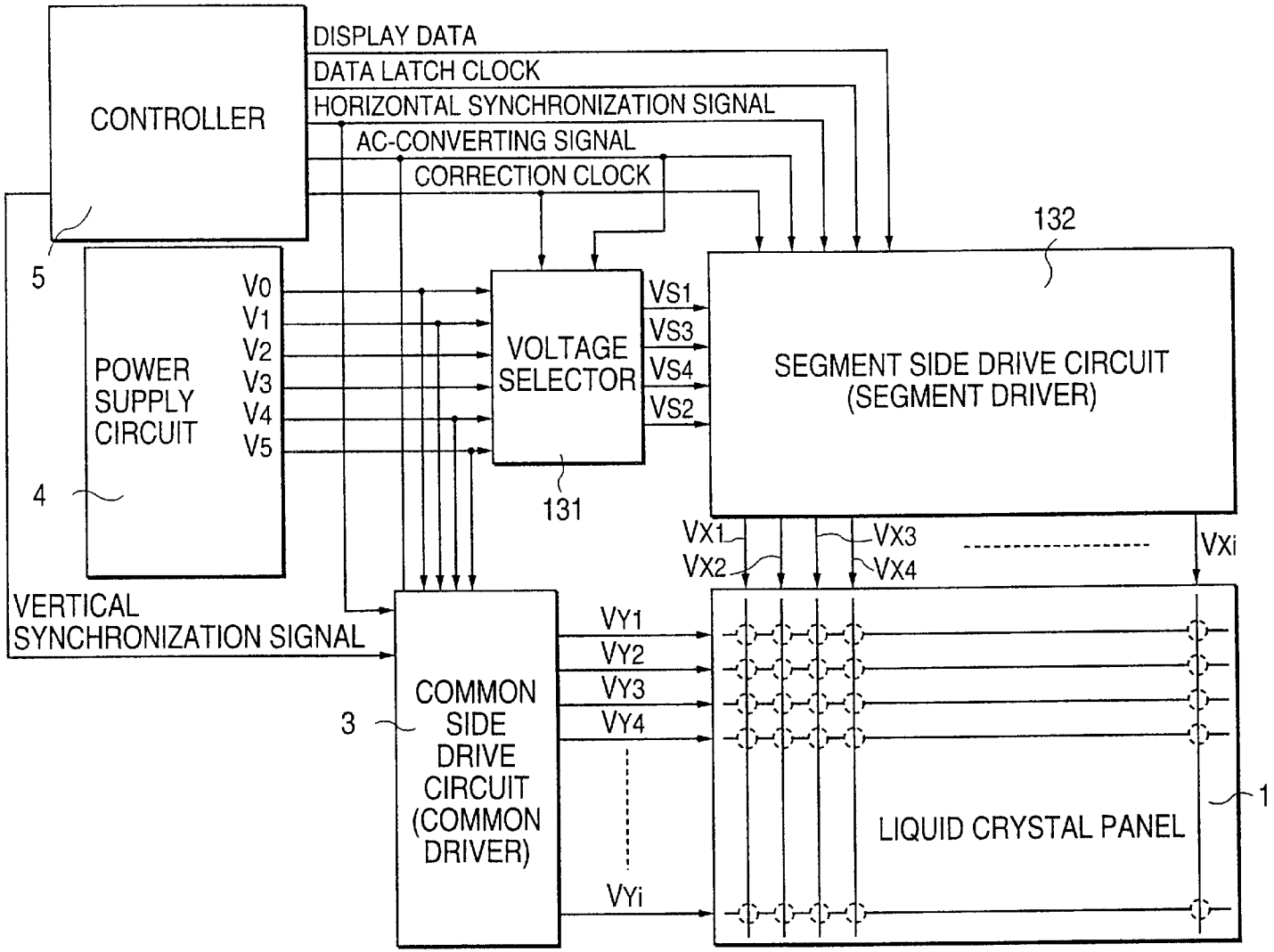
FIG. 24 is a block diagram showing a schematic electrical configuration for driving a liquid crystal panel according to fifth embodiment of the invention.

FIG. 24 shows the configuration for driving the liquid crystal panel of a fifth embodiment of the invention. Although the liquid crystal panel 1, the common side drive circuit 3, the power circuit 4 and the controller 5 used in this embodiment are similar to those of the first embodiment shown in FIG. 1, a voltage selector 131 which is voltage selecting means is provided outside a segment side drive circuit 132 in this embodiment. The liquid crystal panel 1 of large screen size requires a large number of segment electrodes and a plurality of segment side drive circuits 132. Because voltages VS1, VS3, VS4 and VS2 selected by the voltage selector 131 are supplied to the segment side drive circuit 132 of this embodiment, a number of necessary power voltage lines can be reduced by 2 compared with the segment side drive circuit 2 of FIG. 1. This makes it possible to reduce the number of input terminals of the segment side drive circuit 132 and make the semiconductor integrated circuit (abbreviated as IC) smaller, while the drive device can be made efficient and low-cost by providing the voltage selector 131 on the outside.

Figure 25:
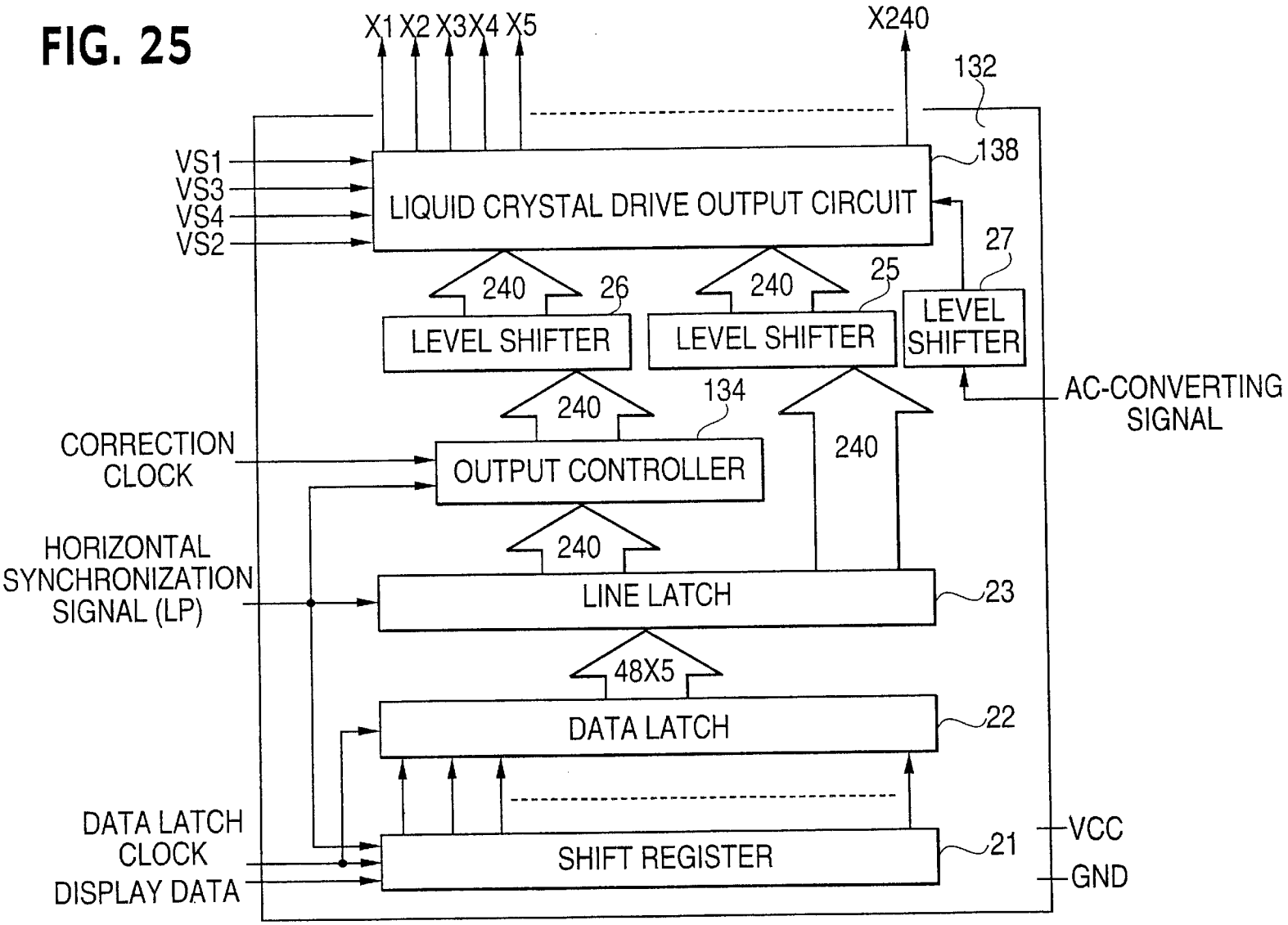
FIG. 25 is a block diagram showing an inner electrical configuration of a segment side drive circuit 132 of FIG. 24.
Figure 26:
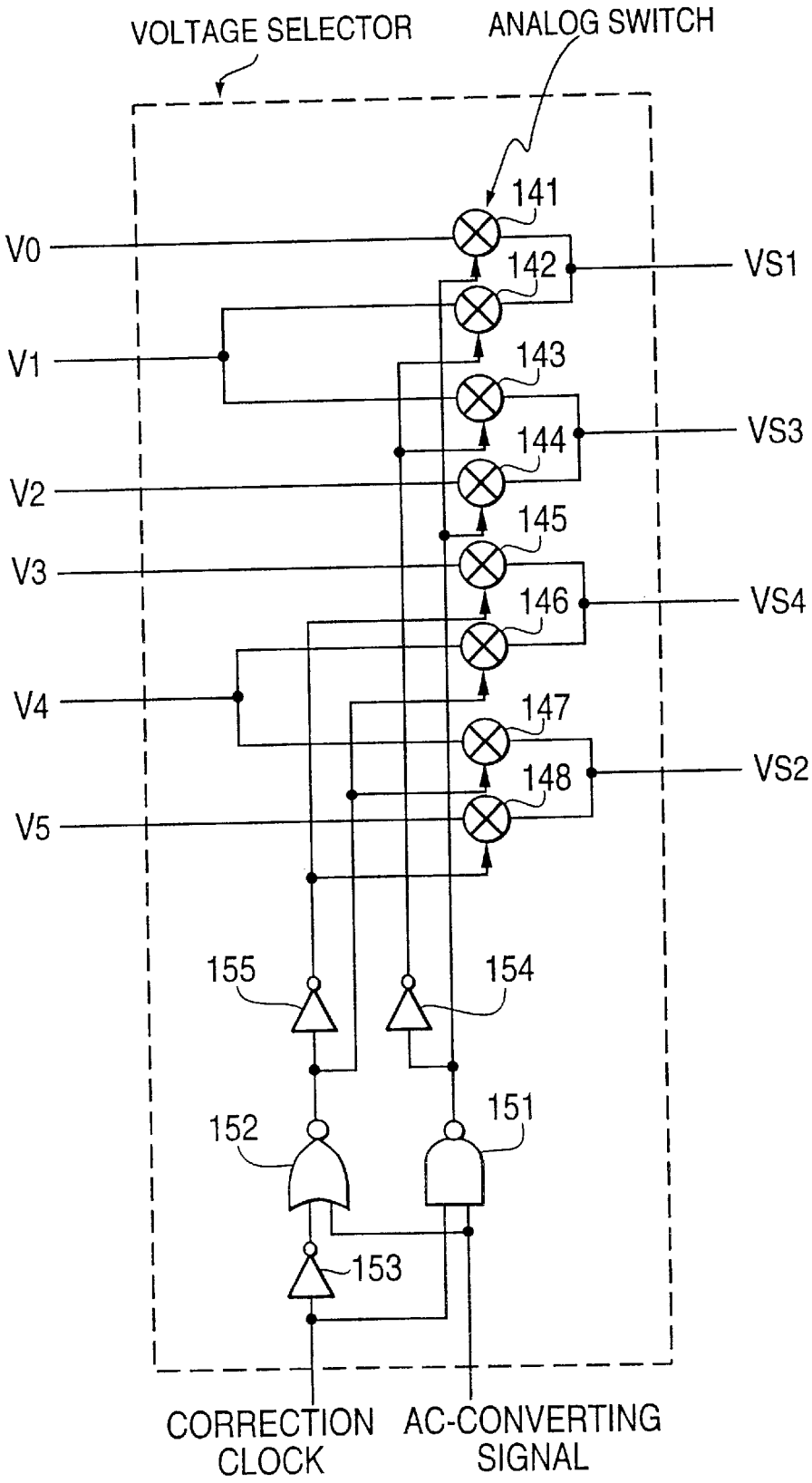
FIG. 26 is a logic circuit diagram showing a logical configuration of a voltage selector 131 of FIG. 24.

FIG. 25 shows the internal configuration of the segment side drive circuit 132 of FIG. 24. Components of this embodiment which correspond to those of the first embodiment shown in FIG. 1 will be identified with the same numerals and similar description will be omitted. The segment side drive circuit 132 of this embodiment is different in that voltage selected by the voltage selector 131 is supplied to the liquid crystal drive output circuit 138. FIG. 26 shows the configuration of the voltage selector 131. In order to select four voltages VS1, VS3, VS4 and VS2 from the voltages V0 through V5 of six levels, analog switches 141, 142, 143, 144, 145, 146, 147 and 148 are provided. For the purpose of controlling the analog switches 141 through 148, a NAND circuit 151, a NOR circuit 152 and inverter circuits 153, 154, 15 are provided. This logic circuit receives the correction clock and the AC-converting signal being input thereto, and carries out logic operations according to the truth table shown in Table 5.

TABLE 5

| Correction clock | AC-converting signal | VS1 | VS3 | VS4 | VS2 |
|---|---|---|---|---|---|
| H | H | V1 | V1 | V3 | V5 |
| L | H | V0 | V2 | V3 | V5 |
| H | L | V0 | V2 | V4 | V4 |
| L | L | V0 | V2 | V3 | V5 |

Figure 27:
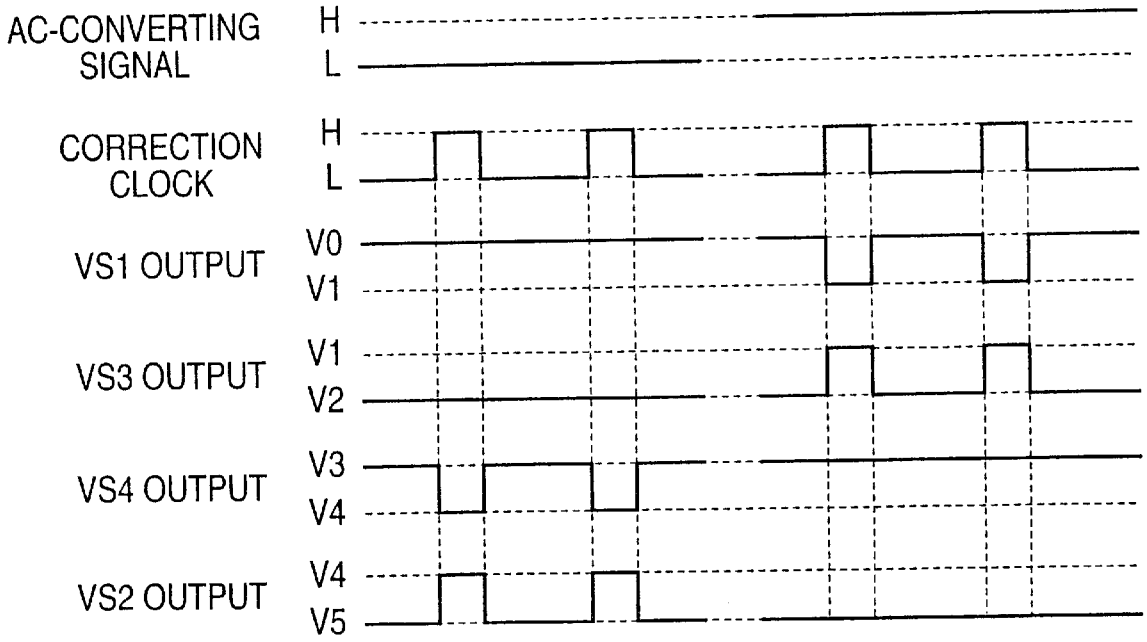
FIG. 27 is a timing chart showing an operation of the voltage selector shown in FIG. 26.
Figure 28:
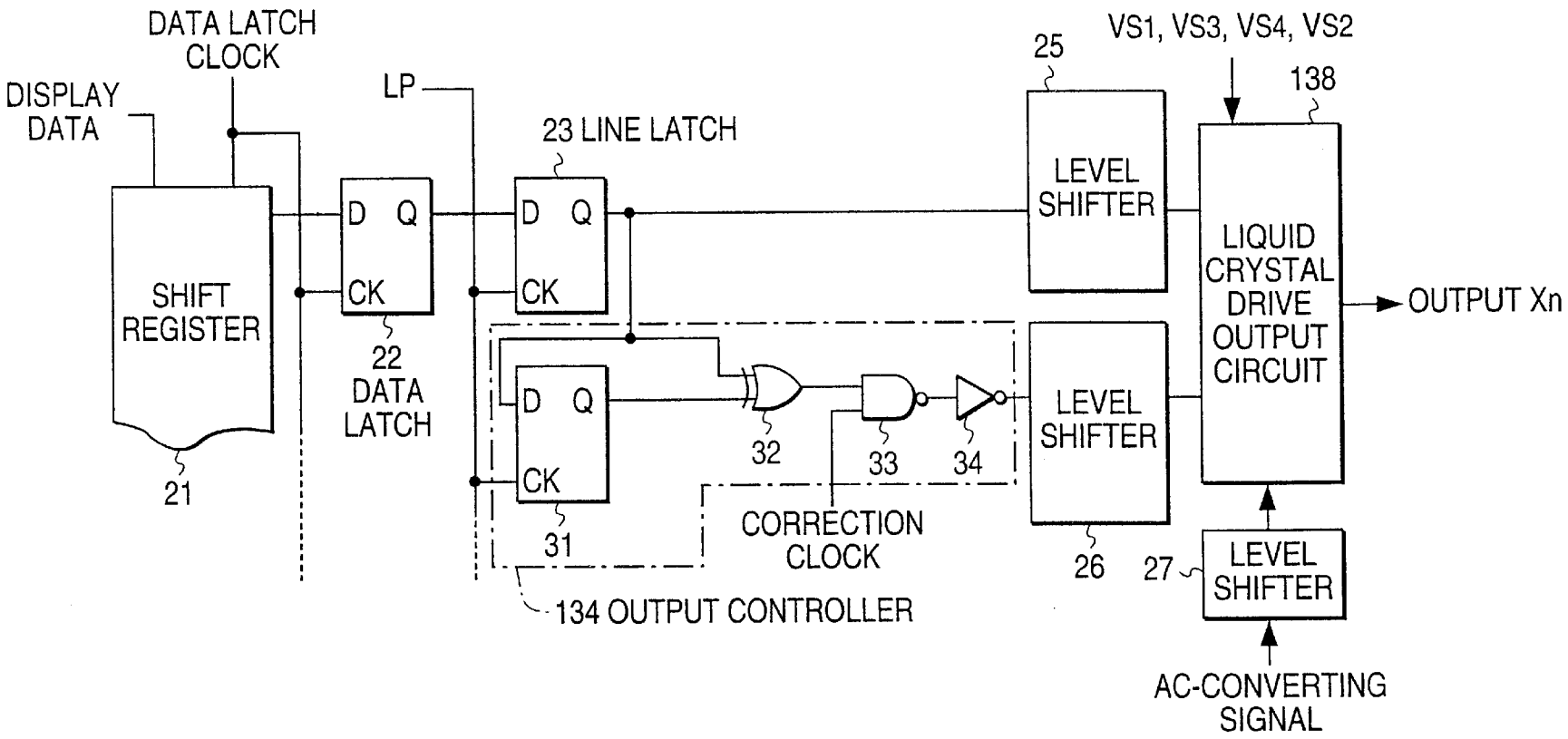
FIG. 28 is a block diagram showing a logical configuration related to an output controller 134 of FIG. 25.

FIG. 27 shows the operation of the voltage selector 131 shown in FIG. 26, and FIG. 28 shows the configuration related to the output controller 134. Although the output controller 134 is similar to the output controller 24 of the embodiment of FIG. 1, no inverter circuit is provided between the output Q of the D flipflop circuit 31 and the input of the EXOR circuit 32, and the output derived from the inverter circuit 34 turns to high only when the display data of two consecutive scanning periods are different and the correction clock is high.

Figure 29:
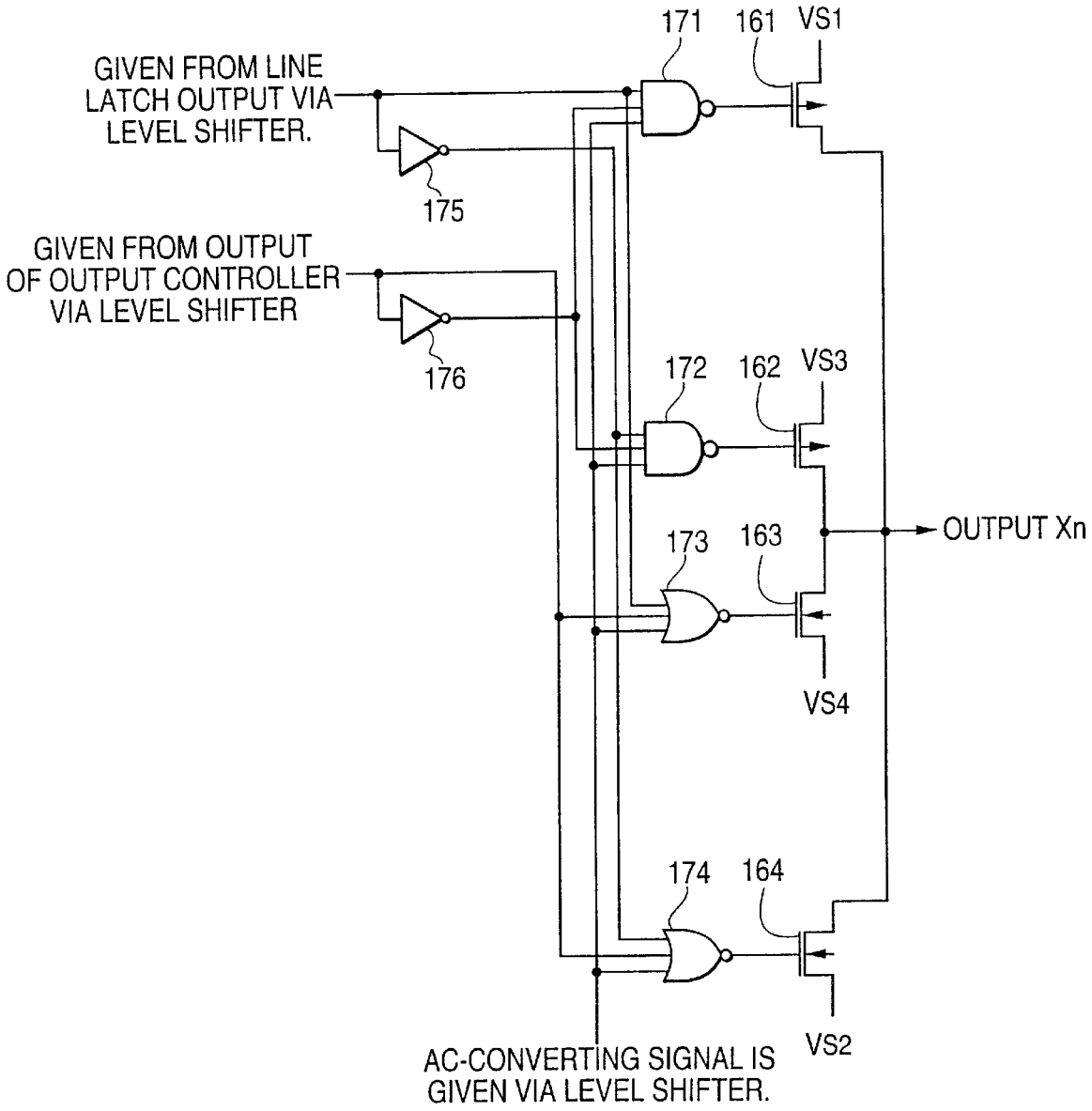
FIG. 29 is an electric circuit diagram of a liquid crystal drive output circuit 138 of FIG. 25.

FIG. 29 shows a configuration for one segment electrode Xn of the liquid crystal drive output circuit 138 of this embodiment. Connected to the segment electrode Xn are drain electrodes of P channel MOS transistors 161 and 162 of which source electrodes are connected to VS1 and VS3, respectively, and drain electrodes of N channel MOS transistors 163 and 164 of which source electrodes are connected to VS4 and VS2, respectively. Gate electrodes of the P channel MOS transistors 161 and 162 are connected to the outputs of the NAND circuits 171 and 172, respectively, and gate electrodes of the N channel IMOS transistors 163 and 164 are connected to the outputs of the NOR circuits 173 and 174, respectively. The NAND circuits 171 and 172 and the NOR circuits 173 and 174 are provided with inverter circuits 175 and 176 installed at the inputs thereof, and receive line latch output, output control signal and AC-converting signal supplied thereto via the level shifters 25, 26 and 27, while operating according to the truth table of Table 6. What should be noted here is that, when the output control signal is high, all MOS transistors 161, 162, 163 and 164 turn to OFF and the output turns to high impedance state. When the output to the segment electrode Xn turns to high impedance state, the voltage is maintained by the charge stored in the liquid crystal cell connected to the segment electrode, and is not affected by the change in the voltage level of the voltage selector 131. For the segment electrodes of which outputs are not at the high impedance state, voltages selected by the voltage selector 131 are selected and output according to the logic shown in Table 6.

TABLE 6

| Line latch output | Output control | AC-converting signal | Output Xn |
|---|---|---|---|
| H | L | H | VS1 |
| L | L | H | VS3 |
| L | L | L | VS4 |
| H | L | L | VS2 |
| — | H | — | High impedance |

Figure 30:
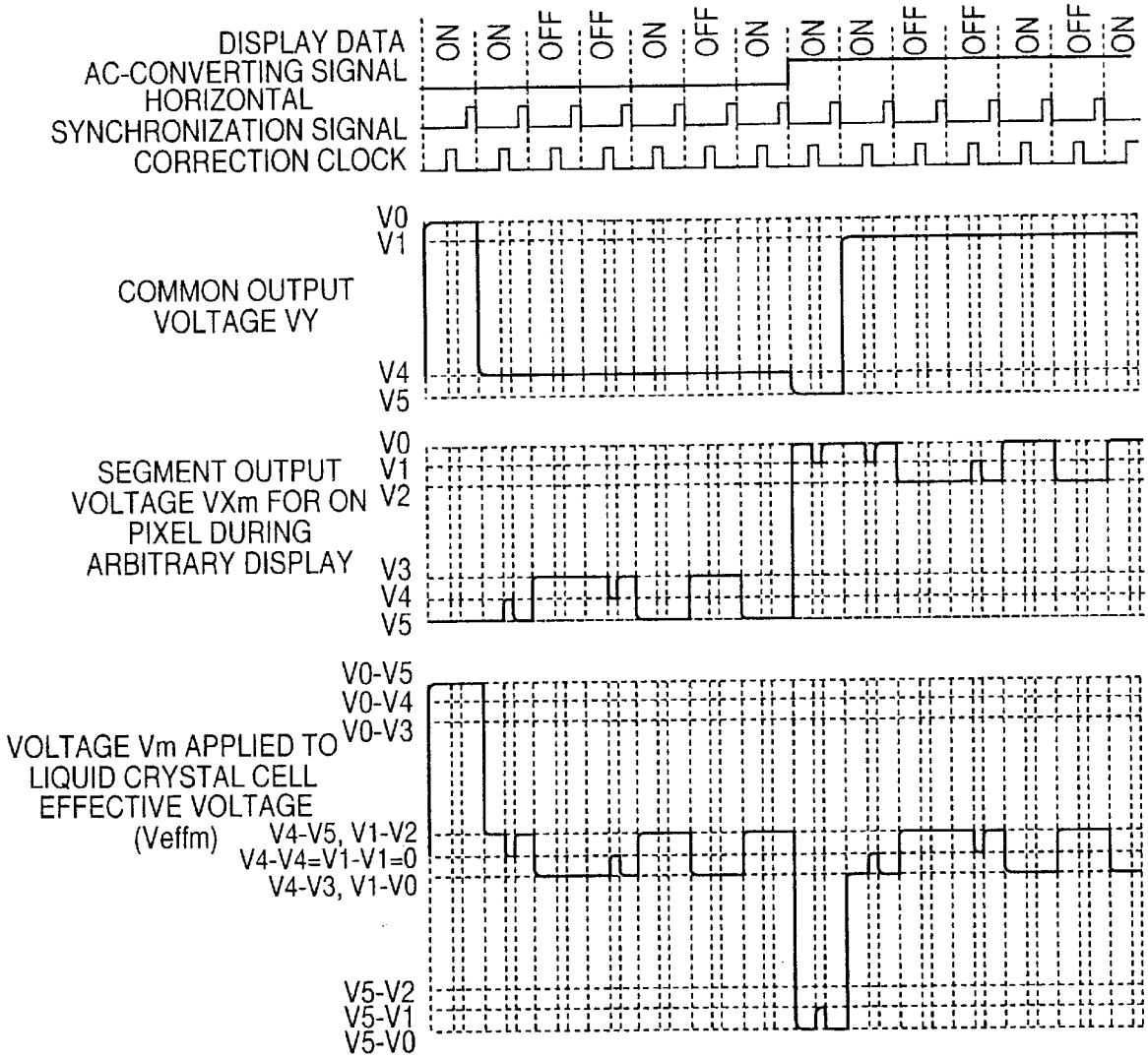
FIG. 30 is a timing chart showing voltage waveforms at various portions of FIG. 24.

FIG. 30 shows output waveforms of the drive circuits and voltage waveform applied to the liquid crystal cell in this embodiment. In this embodiment, too, similar effects as those of the first and the second embodiment can be achieved, and luminance unevenness such as shadowing can be reduced by adjusting the pulse width of the correction clock. Although it is assumed that the correction voltages which are output during the correction period are V1 and V4 in this embodiment, they may be other voltages as a matter of fact. It is also possible to set different voltages for ON display and OFF display. Further it may be applied to the 5V drive method described previously. In such a case, it is possible to omit the level shifters 25, 26 and 27 of FIGS. 25 and 28, make the liquid crystal drive output circuit a 2-value output circuit having high impedance during correction period, and make such a power circuit that changes the voltage level to the correction voltage during the correction period. When applied to the 5V drive method, such a configuration can be employed that includes level shifters. In this case, similar to the level shifters 25, 26 and 27 of FIGS. 25 and 28, level shifters are provided between the output controller and the line latch, the liquid crystal drive output circuit and at the input section of the AC-converting signal to the liquid crystal drive output circuit.

Figure 31:
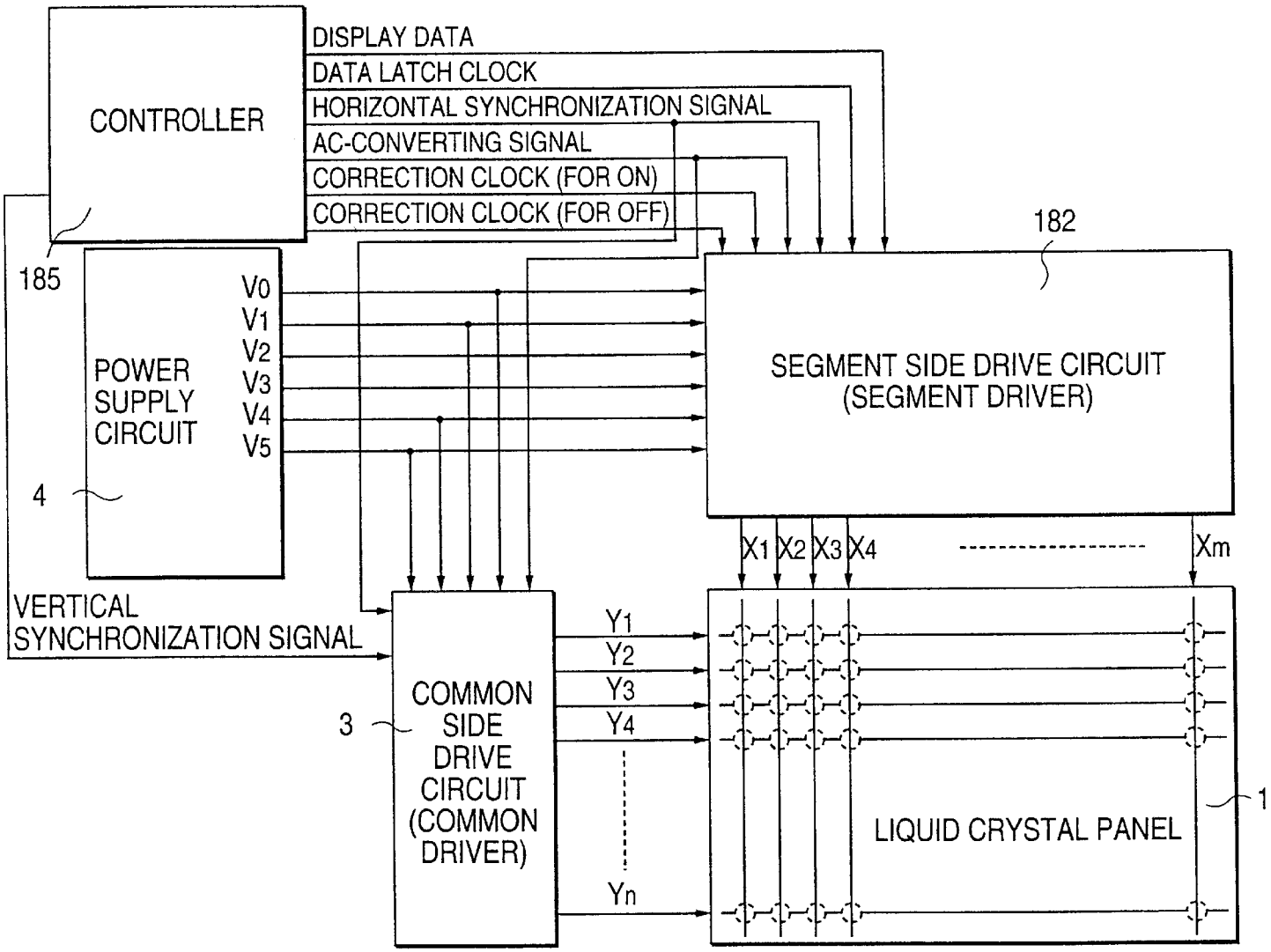
FIG. 31 is a block diagram showing a schematic electrical configuration for driving a liquid crystal panel of a sixth embodiment of the invention.
Figure 32:
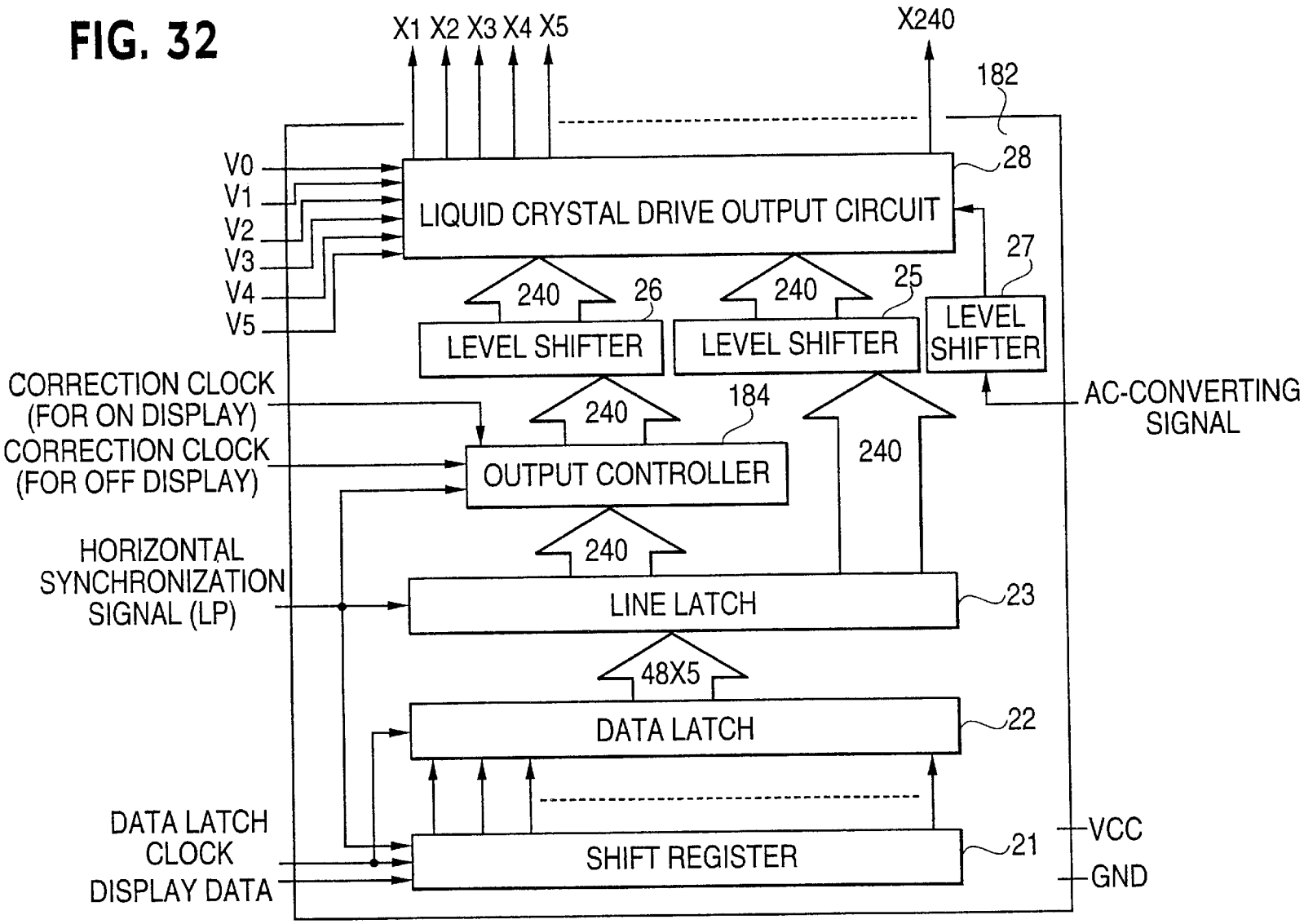
FIG. 32 is a block diagram showing an inner electrical configuration of a segment side drive circuit 182 of FIG. 31.

FIG. 31 shows a configuration for driving a liquid crystal panel of a sixth embodiment of the invention. Components of this embodiment which correspond to those of the first embodiment shown in FIG. 1 will be identified with the same numerals and similar description will be omitted. In this embodiment, the segment side drive circuit 182 is supplied with correction clock signal for ON display and correction clock signal for OFF display separately from a controller 185. FIG. 32 shows the inner configuration of the segment side drive circuit 182 shown in FIG. 31. This configuration differs from the inner configuration of the segment side drive circuit 2 shown in FIG. 2 in the output controller 184.

Figure 33:
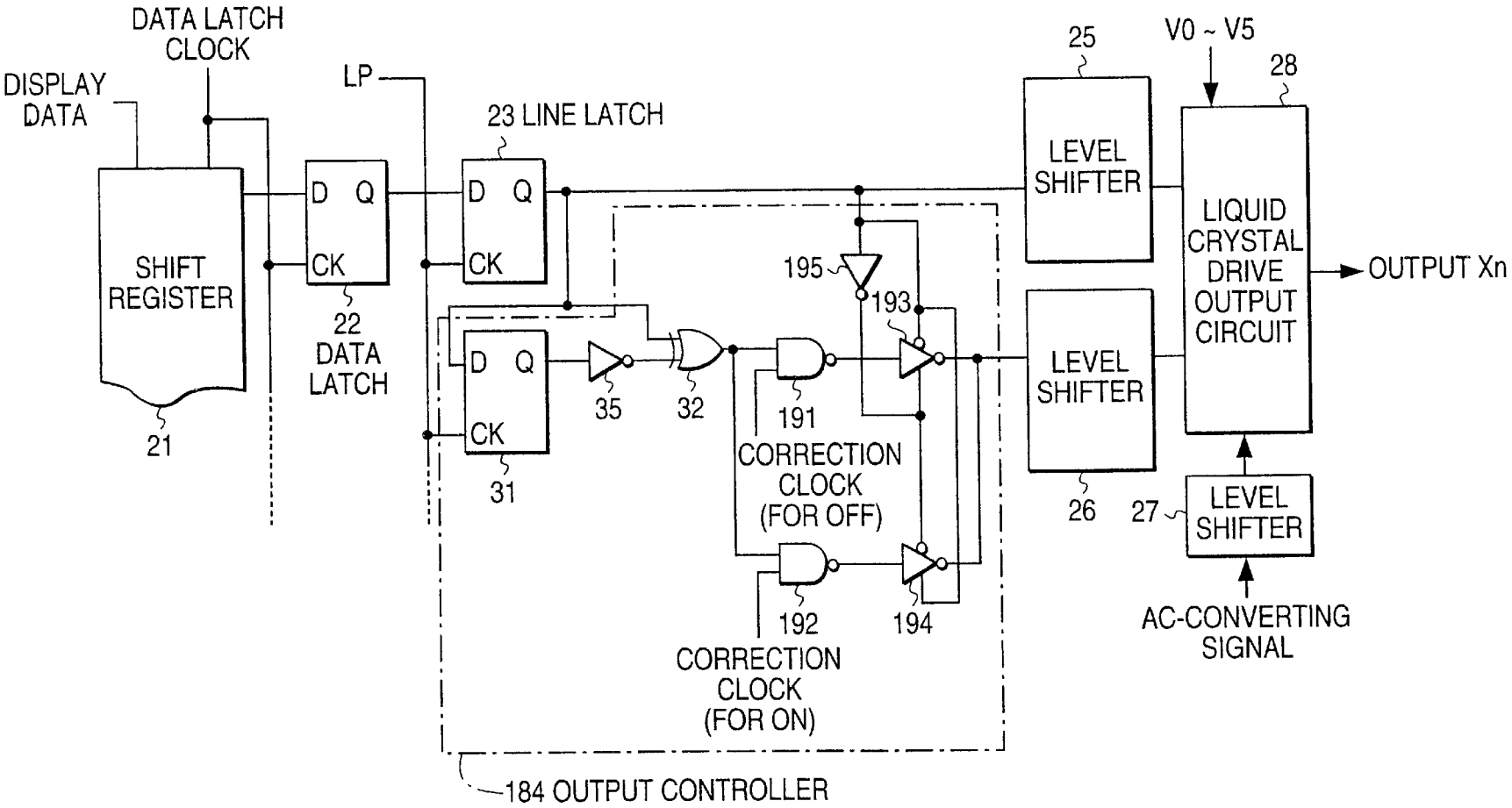
FIG. 33 is a logic circuit diagram showing a configuration related to an output controller 184 of FIG. 32.

FIG. 33 shows the configuration related to the output controller 184. In the output controller 184 of this embodiment, output side of the EXOR circuit 32 is connected with one of inputs of each of 2-input NAND circuits 191 and 192. Other inputs of the 2-input NAND circuits 191 and 192 receive correction clock for OFF display and correction clock for ON display input thereto, respectively. Outputs of the 2-input NAND circuits 191 and 192 are supplied to the level shifter 26 via clocked inverters 193 and 194. For the purpose of controlling the clocked inverters 193, 194, output of the line latch 23 is supplied via an inverter circuit 195. The output controller 184 of this embodiment switches the clocked inverter circuits 193 and 194 depending on whether the output Q of the latch circuit 23 is for OFF display or ON display, and supplies different correction clocks to the level shifter 26. When ON display data is supplied two times successively, for example, correction clock for ON display is selected and supplied to the level shifter 26, while when OFF display data is supplied twice successively correction clock for OFF display is selected and supplied to the level shifter 26.

Figure 34:
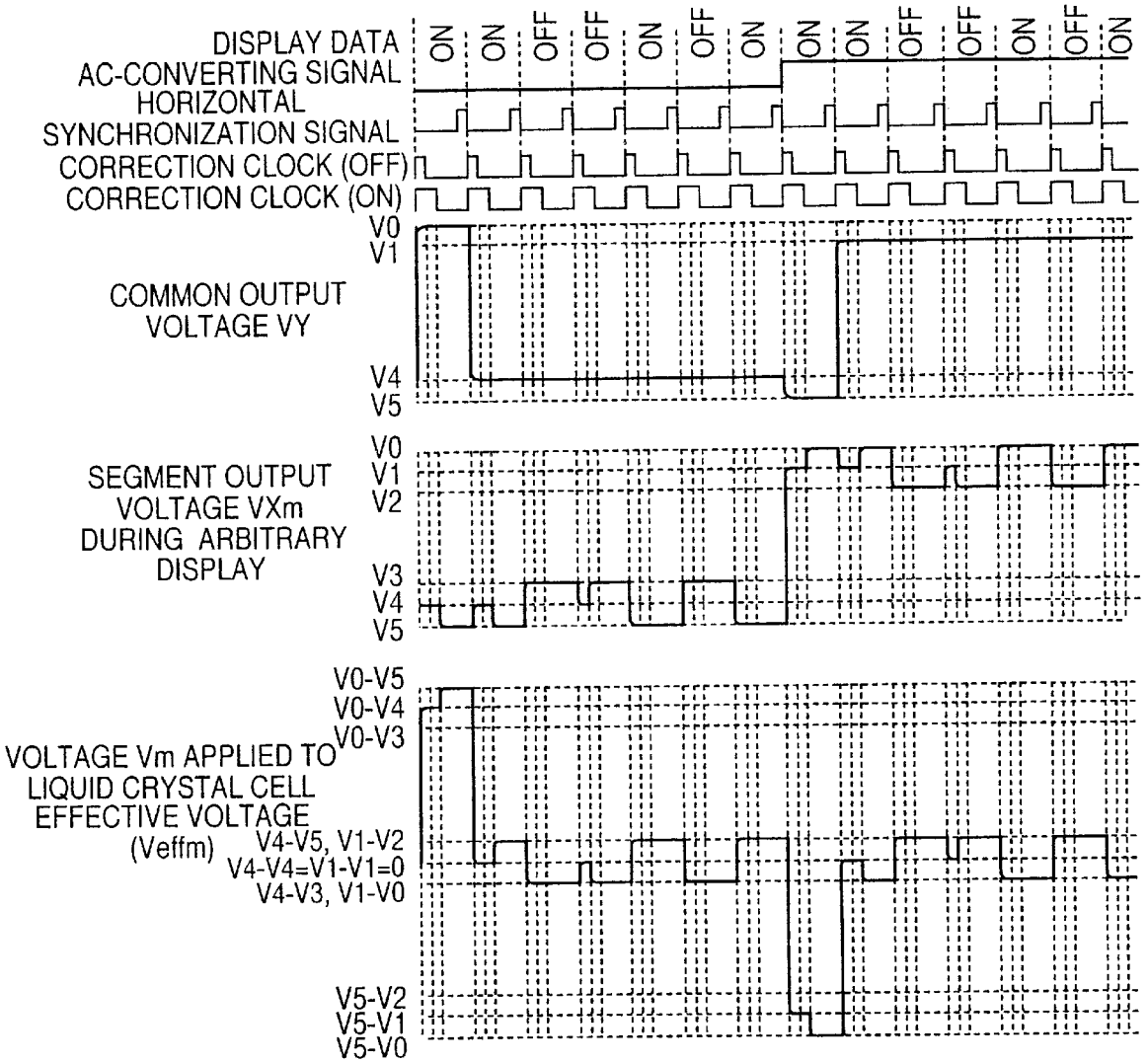
FIG. 34 is a timing chart showing voltage waveforms at various portions during the operation of the embodiment of FIG. 31.

FIG. 34 shows output waveforms of the drive circuits and voltage waveform applied to the liquid crystal cell in this embodiment. Dielectric constant of the liquid crystal cell changes as the voltage applied thereto are different between ON display and OFF display, and therefore the capacitance also changes. Therefore because the degree of rounding of the signal becomes different, pulse widths of the correction clocks are made different between ON display and OFF display and are independently adjusted to make the effective voltage identical regardless of the display pattern, making it possible to reduce the luminance unevenness.

Figure 35:
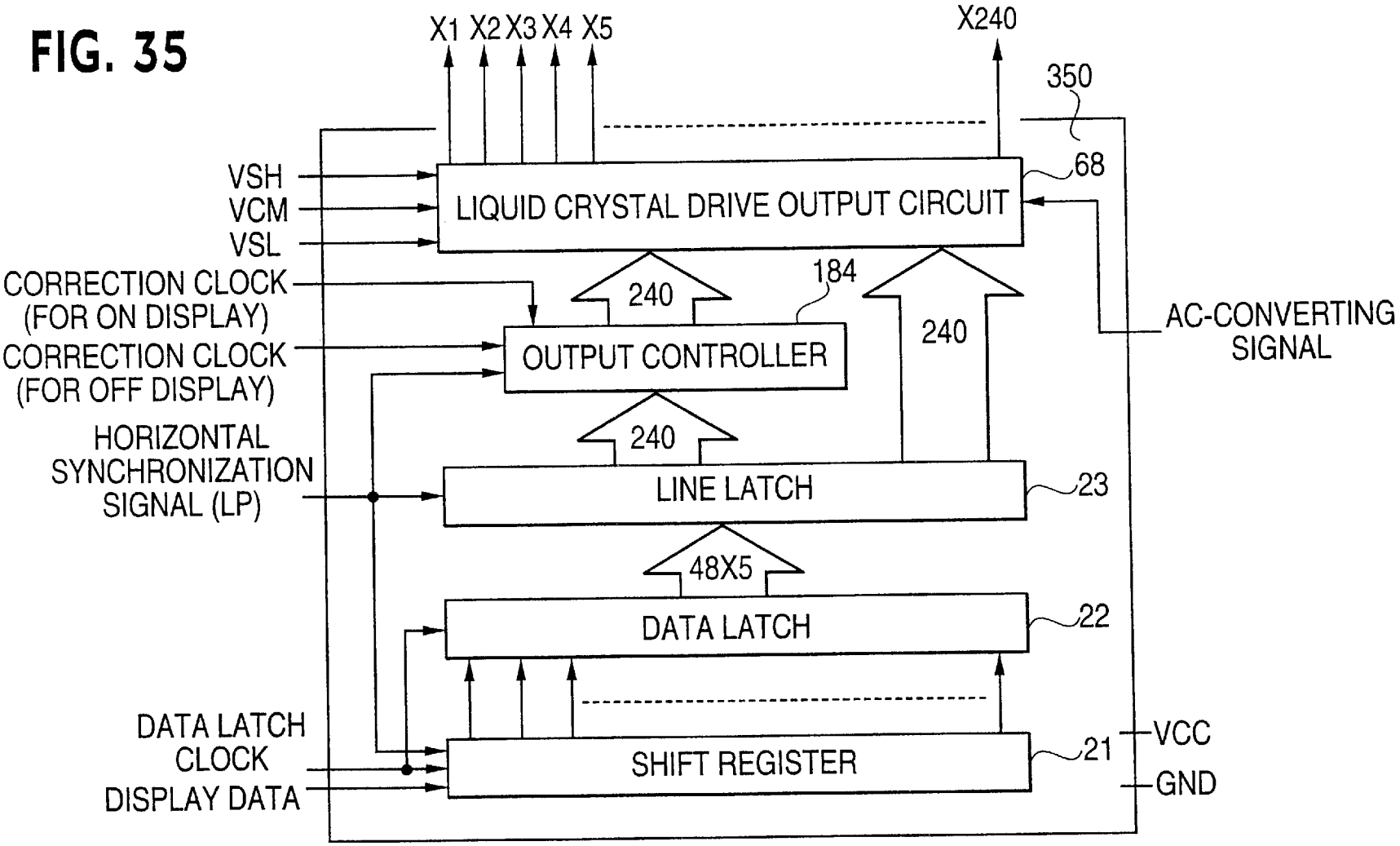
FIG. 35 is a block diagram showing an inner electrical configuration of a segment side drive circuit 350 in case 5V drive method is applied to the embodiment of FIG. 31.
Figure 36:
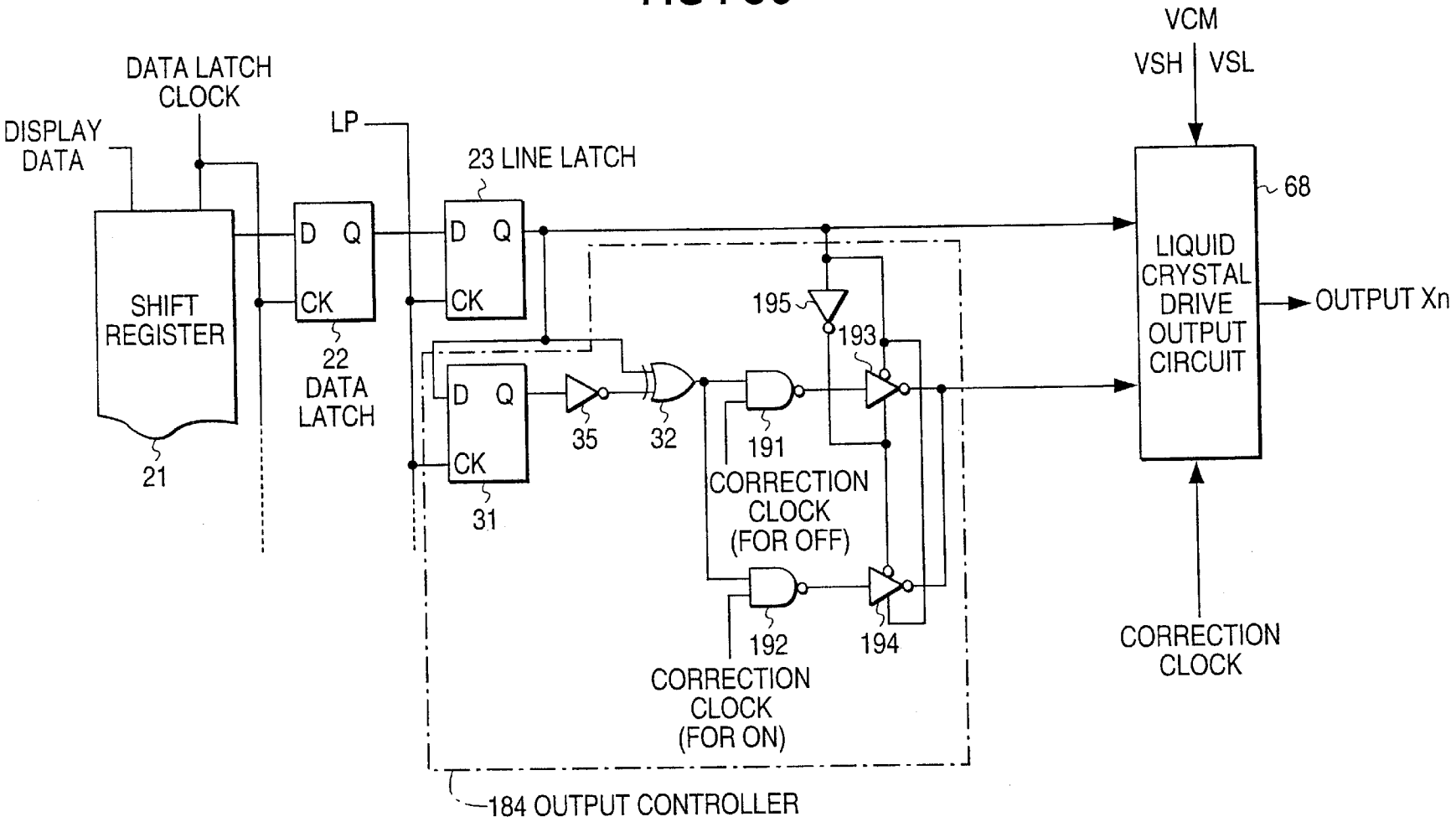
FIG. 36 is a logic circuit diagram showing the configuration related to the output controller 184 of FIG. 35.
Figure 37:
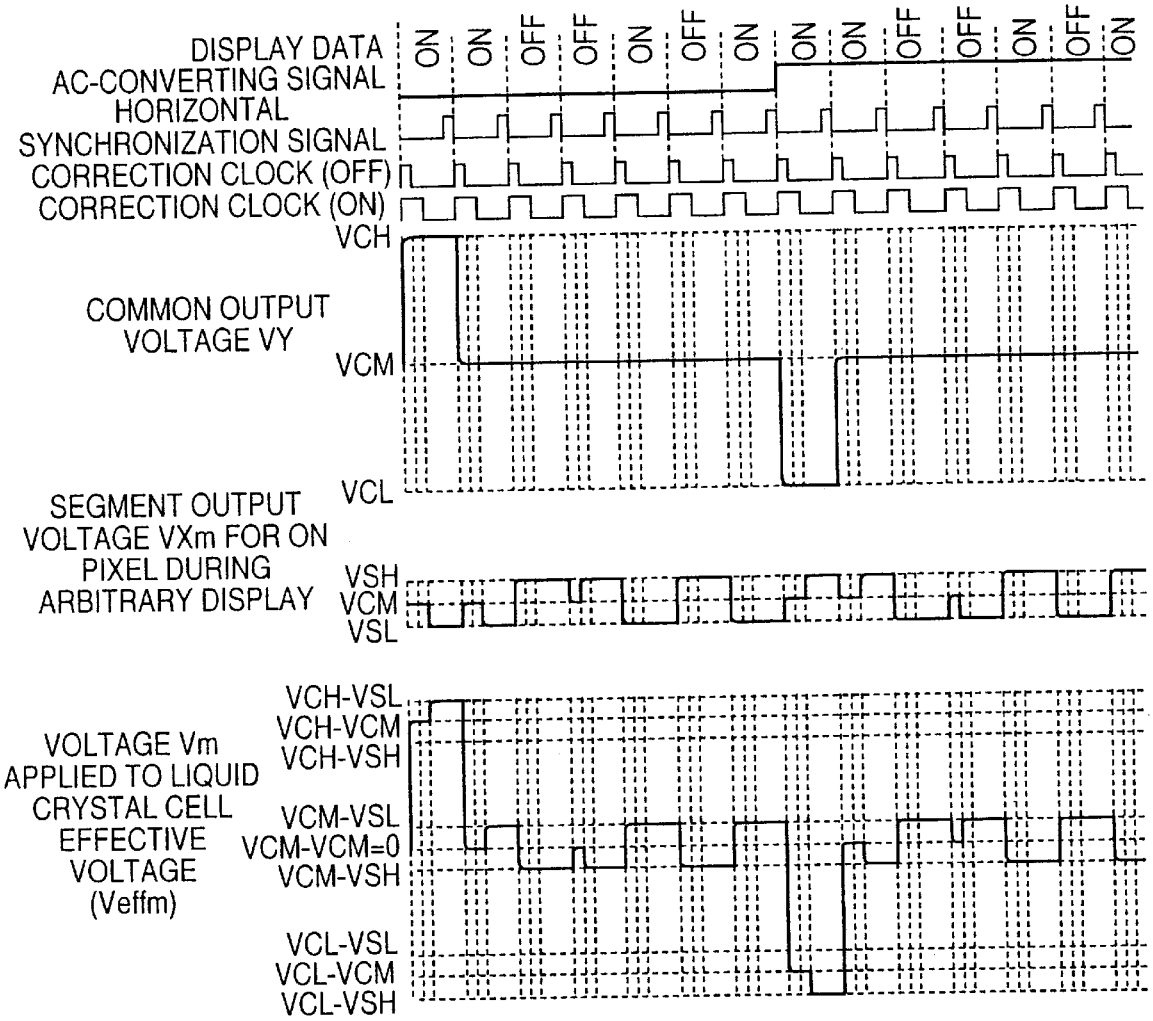
FIG. 37 is a timing chart showing voltage waveforms at various portions during the operation in the case of FIG. 35.

This embodiment can also be achieved by means of the 5V drive method. Inner configuration of a segment side drive circuit 350 of such a case is shown in FIG. 35 and the configuration related to the output controller 184 is shown in FIG. 36. Circuit configuration for one segment of the liquid crystal drive output circuit 68 is identical with that of FIG. 12. Components corresponding to those of the embodiments described above will be identified with the same numerals. Configuration of FIG. 22 may be employed instead of FIG. 12. FIG. 37 shows output waveforms of the drive circuits and voltage waveform applied to the liquid crystal cell. Voltage waveform applied to the liquid crystal cell is the same in FIG. 34 and FIG. 37, achieving the same effect. Detailed description of the circuit and description of the operation will be omitted here because a large part thereof is the same as described previously. Also such a configuration is possible as level shifters are provided between the output controller 184 of FIGS. 35 and 36 and the line latch 23, the liquid crystal drive output circuit 68 and at the input section of the AC-converting signal to the liquid crystal drive output circuit 68.

Figure 38:
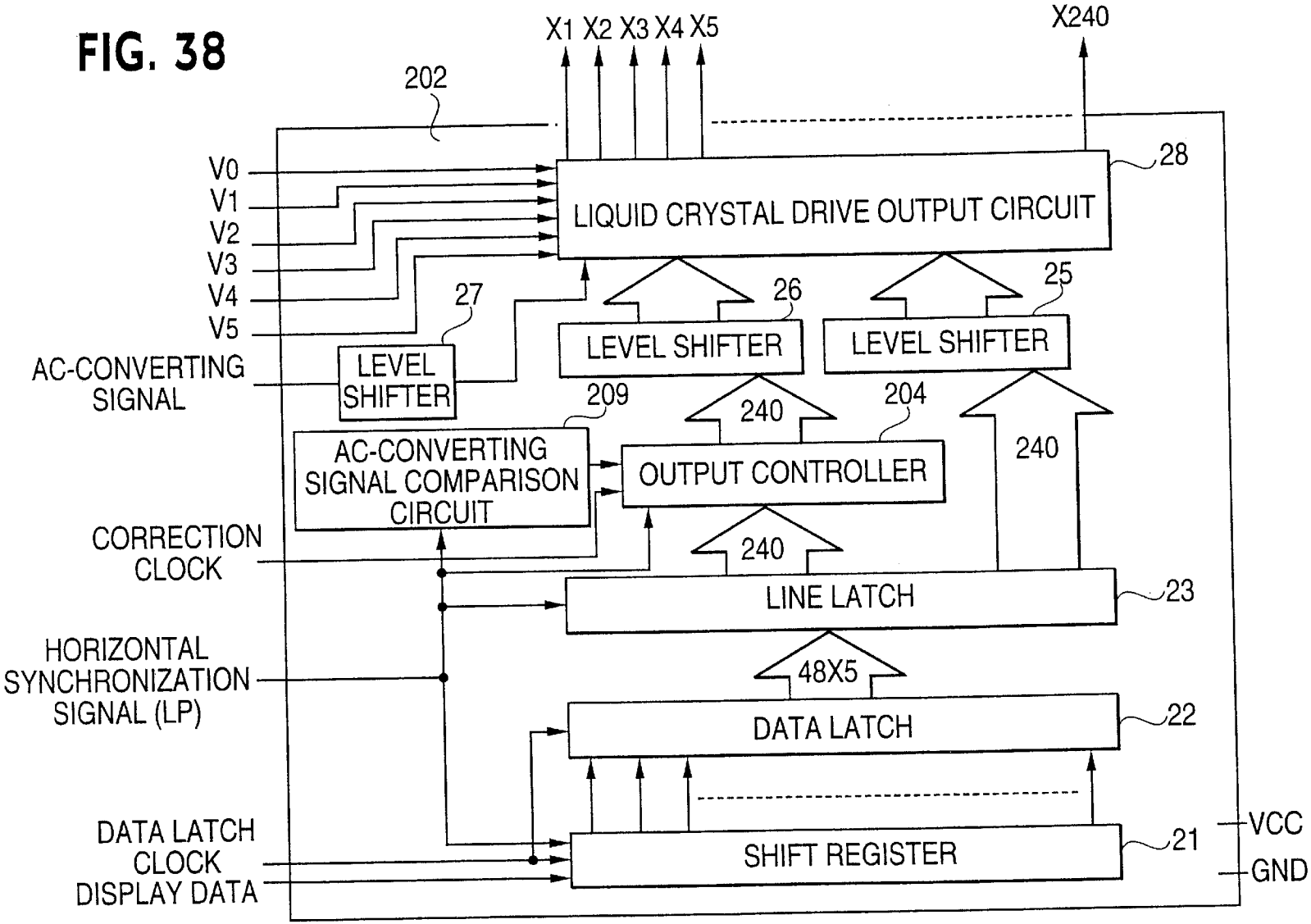
FIG. 38 is a block diagram showing an inner electrical configuration of a segment side drive circuit 202 of a seventh embodiment of the invention.

FIG. 38 shows the inner configuration of a segment side drive circuit 202 of a seventh embodiment of the invention. In this embodiment, overall configuration for driving the liquid crystal panel 1 is similar to the first embodiment shown in FIG. 1, and therefore components which correspond to those of the first embodiment will be identified with the same numerals while similar description will be omitted. In this embodiment, for consideration of the effect during change of the AC-converting signal, an AC-converting signal comparison circuit 209 is incorporated in the segment side drive circuit 202. The output controller 204 does not apply voltage correction by means of the correction clock when the AC-converting signal changes, even when identical display data continues.

Figure 39:
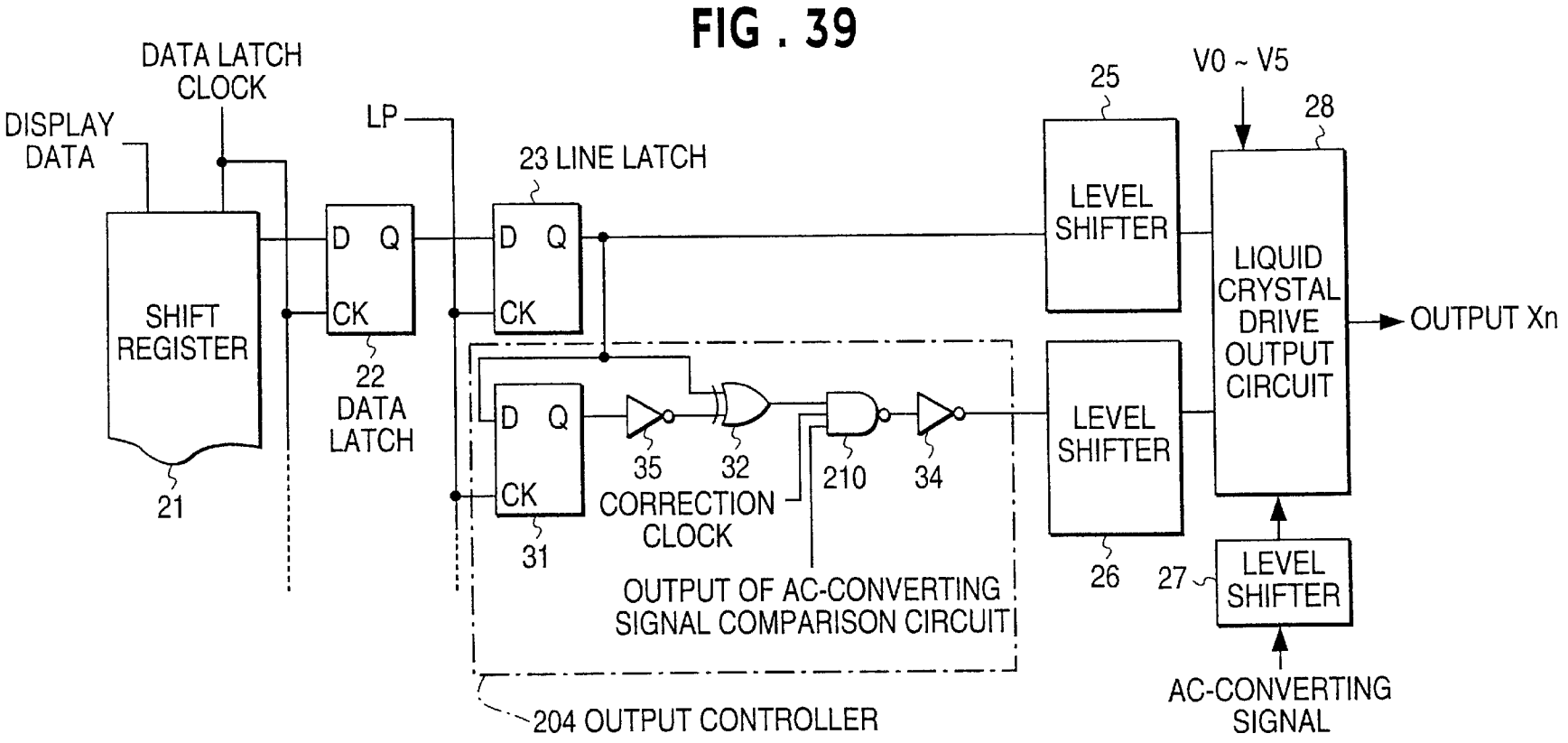
FIG. 39 is a block diagram showing a logical configuration related to an output controller 204 of FIG. 38.

FIG. 39 shows more detailed configuration up to the level shifter for one output of FIG. 38. The output controller 204 is provided with a 3-input NAND circuit 210 inserted between output of the EXOR circuit 32 and input of the inverter circuit 34. One of inputs of the 3-input NAND circuit 210 is connected to the output of the EXOR circuit 32 and other two inputs receive the correction clock and the output of the AC-converting signal comparison circuit.

Figure 40:
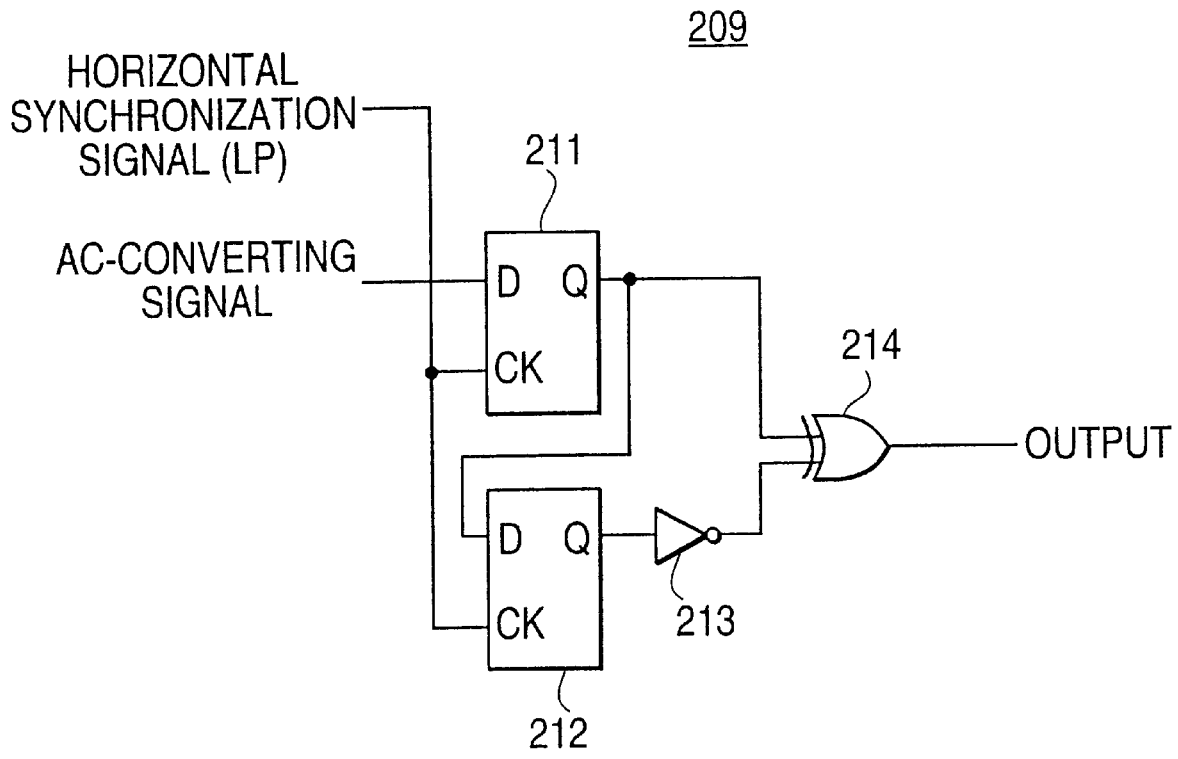
FIG. 40 is a logic circuit diagram showing a logical configuration of an AC-converting signal comparison circuit 209 of FIG. 38.

FIG. 40 shows an example of inner configuration of the AC-converting signal comparison circuit 209. In the AC-converting signal comparison circuit 209, two D flipflop circuits 211 and 212 operate both using the horizontal synchronization signal (LP) as clock signal CK. One D flipflop circuit 211 receives the AC-converting signal given to data input D thereof, and data input D of the other D flipflop circuit 212 is connected to output Q of the D flipflop circuit 211. Output Q of the D flipflop circuit 212 is inverted by an inverter circuit 213. One of the inputs of the EXOR circuit 214 receives output Q of the D flipflop circuit 211 and the other input of the EXOR circuit 214 receives output of the inverter 213. The AC-converting signal comparison circuit 209 compares the states of the AC-converting signal in one scanning period and that of the previous scanning period, and derives low output in one scanning period immediately after the AC-converting signal changes.

Output of the segment side drive circuit changes as the AC-converting signal changes, regardless of the state of display data signal. Consequently, because the output voltage changes when the AC-converting signal changes even when display data of two consecutive scanning periods are the same, the voltage level changes without voltage correction. In this embodiment, such a configuration is employed that, when the AC-converting signal comparison circuit 209 detects a change, output signal from the output controller 204 is turned to low and correction voltage is not output to the liquid crystal drive output circuit 28 regardless of the state of display data, so that the correction voltage is not output when the AC-converting signal changes.

Figure 41:
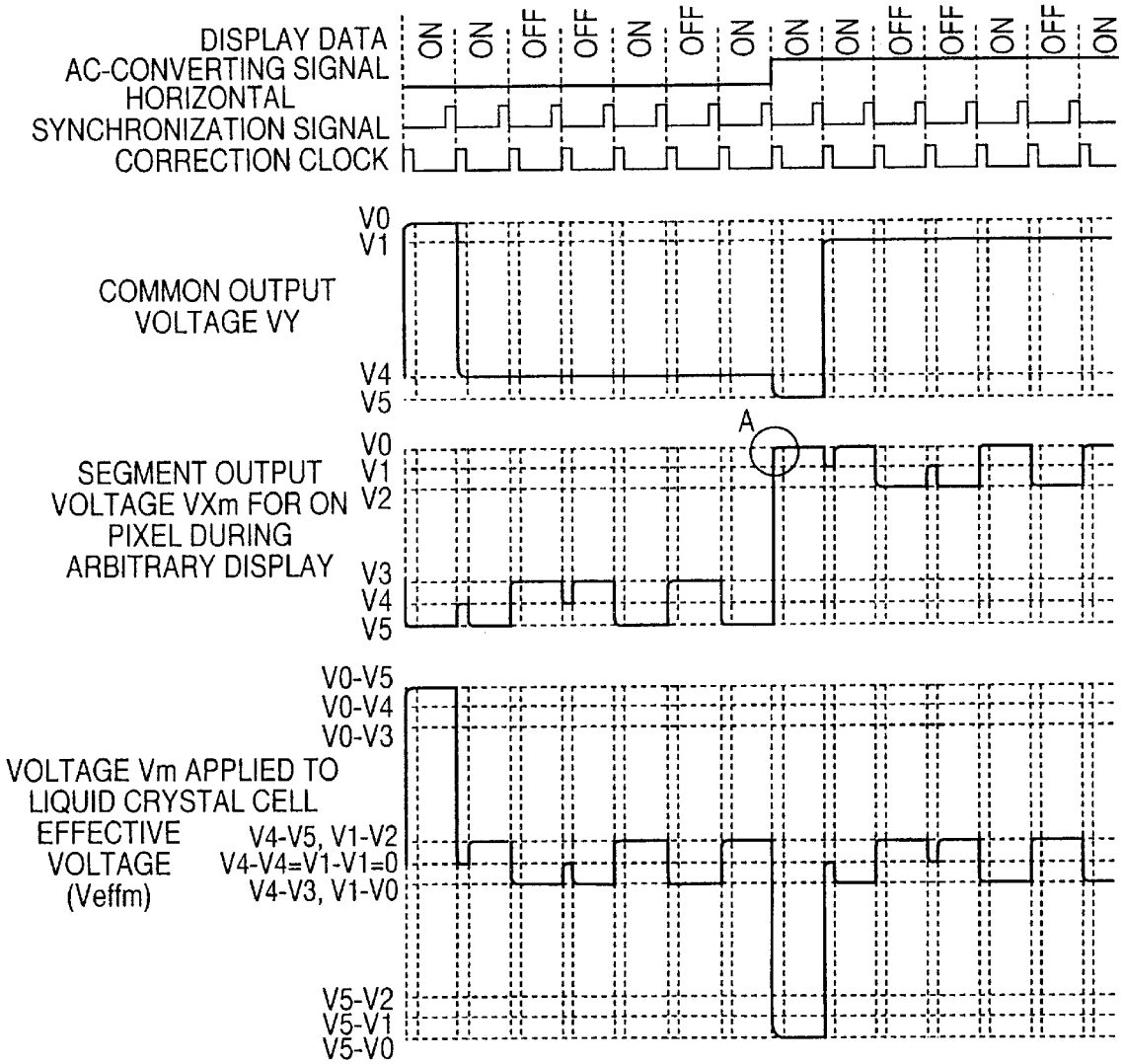
FIG. 41 is a timing chart showing voltage waveforms at various portions of the embodiment of FIG. 38.

FIG. 41 shows output waveforms of the drive circuits and voltage waveform applied to the liquid crystal cell. In case the AC-converting signal changes, for example, correction is not applied to the segment output voltage as indicated by A even when the display data continues to be ON. Thus loss in the effective voltage due to excessive voltage change can be prevented. Such a scheme of omitting the correction when the AC-converting signal changes may also be effectively applied in combination with the first to the sixth embodiment.

Figure 42:
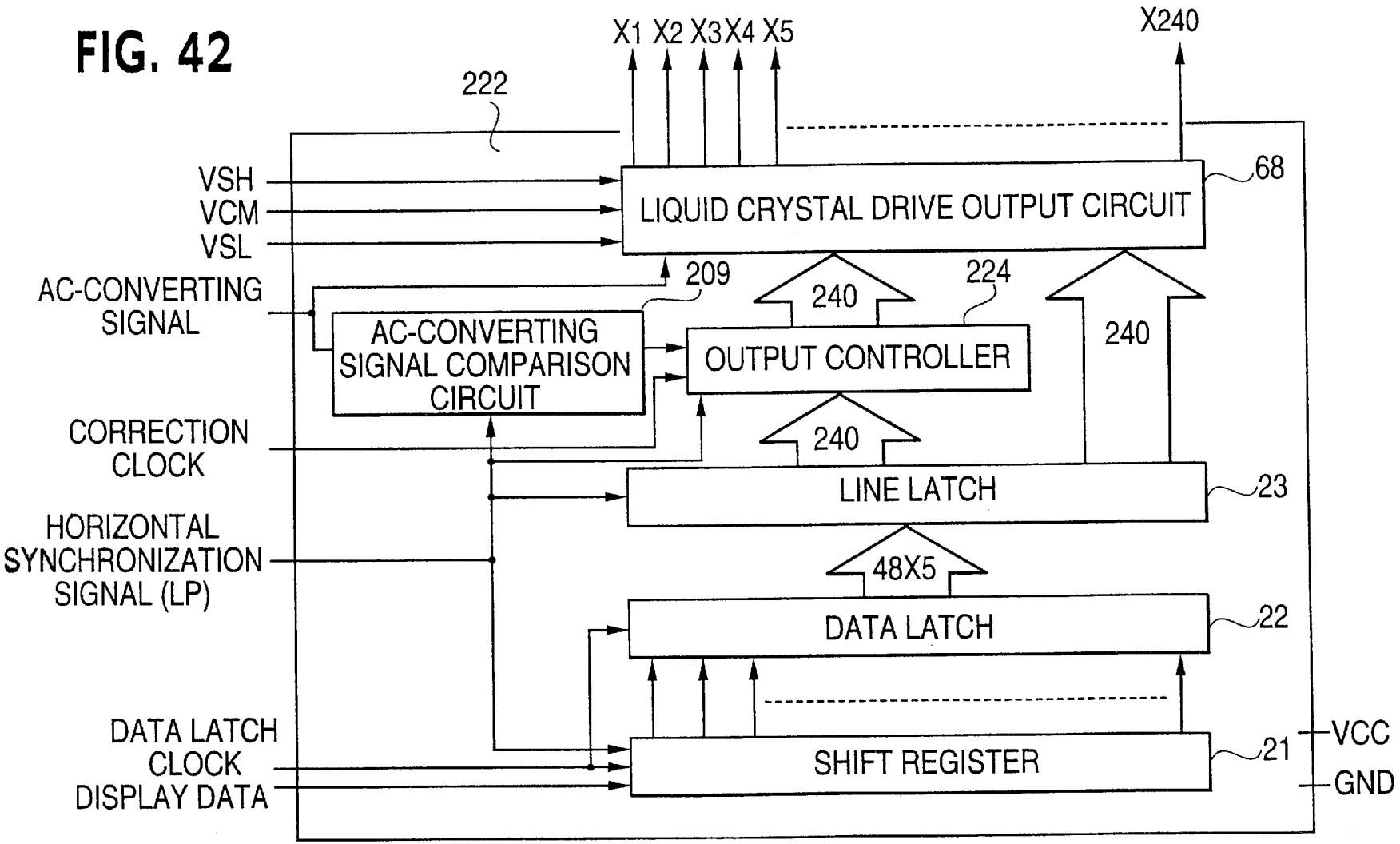
FIG. 42 is a block diagram showing an inner electrical configuration of a segment side drive circuit 222 of an eighth embodiment of the invention.
Figure 43:
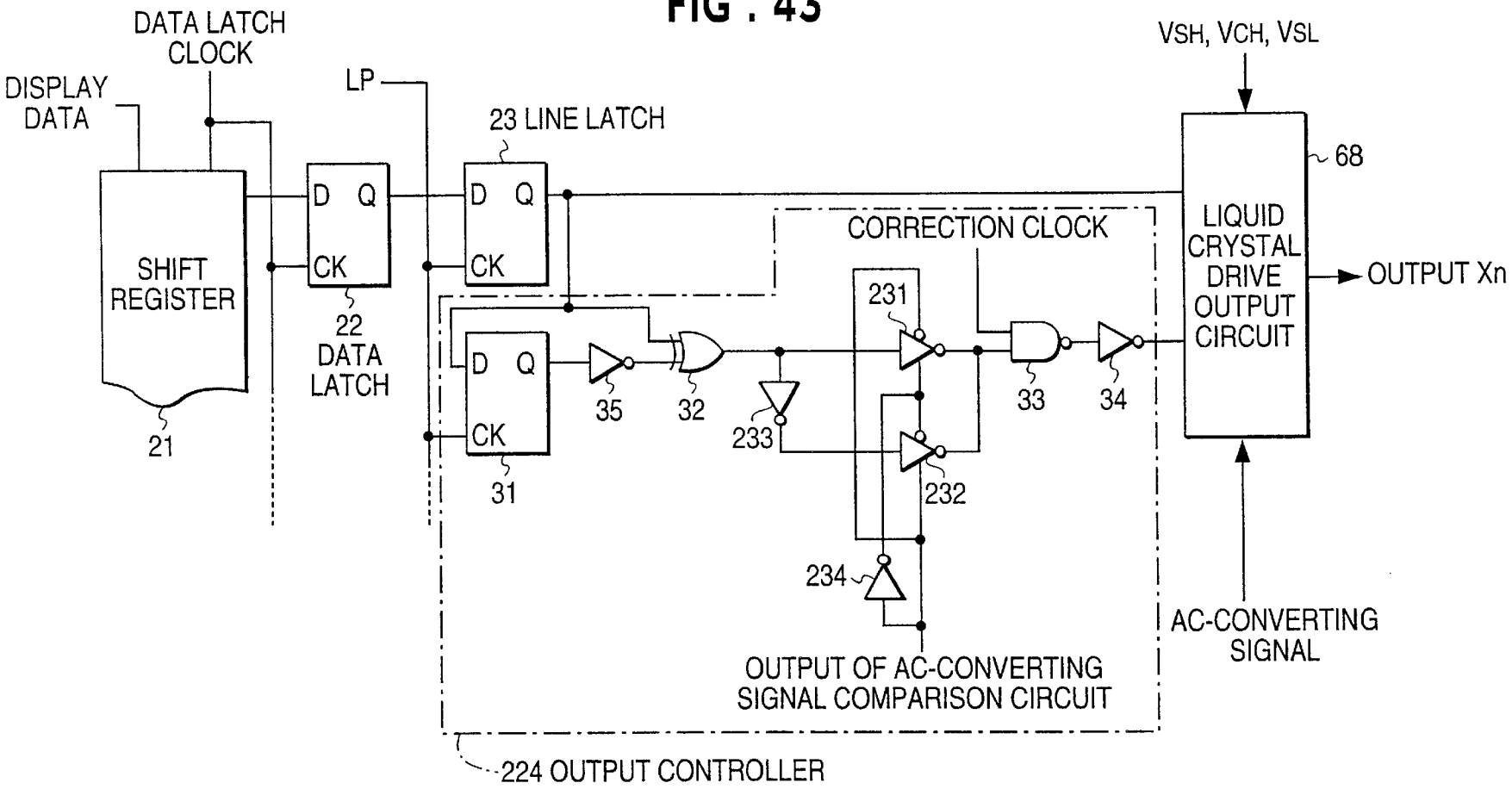
FIG. 43 is a block diagram showing a logical configuration related to an output controller 224 of FIG. 42.

FIG. 42 shows the inner configuration of a segment side drive circuit 222 of an eighth embodiment of the invention. Other sections are similar to those of the second embodiment shown in FIG. 9, and description thereof will be omitted. The output controller 224 of this embodiment receives the result of comparison from an AC-converting signal comparison circuit 209 as shown in FIG. 40. Inner configuration of the output controller 224 and related configuration are shown in FIG. 43. The output controller 224 has a selection circuit based on clocked inverter circuits 231 and 232 being inserted between output of the EXOR circuit 32 and input of the NAND circuit 33, and it is determined whether to supply the output of the EXOR circuit 32 directly to the input of the NAND circuit 33 or supply the output after inverting it, depending on the output of the AC-converting signal comparison circuit 209. Generally in a segment drive circuit based on the 5V drive method, output waveform does not change and the output level is maintained when the display data state changes at the same time the AC-converting signal changes, while the output waveform changes in case the display data signal does not change when the AC-converting signal changes. Therefore such a configuration is employed as, during one scanning period immediately after the AC-converting signal has changed, correction voltage is output when the display in the scanning period is different from that of the previous scanning period, while the correction voltage is not output when the display data is the same.

Figure 44:
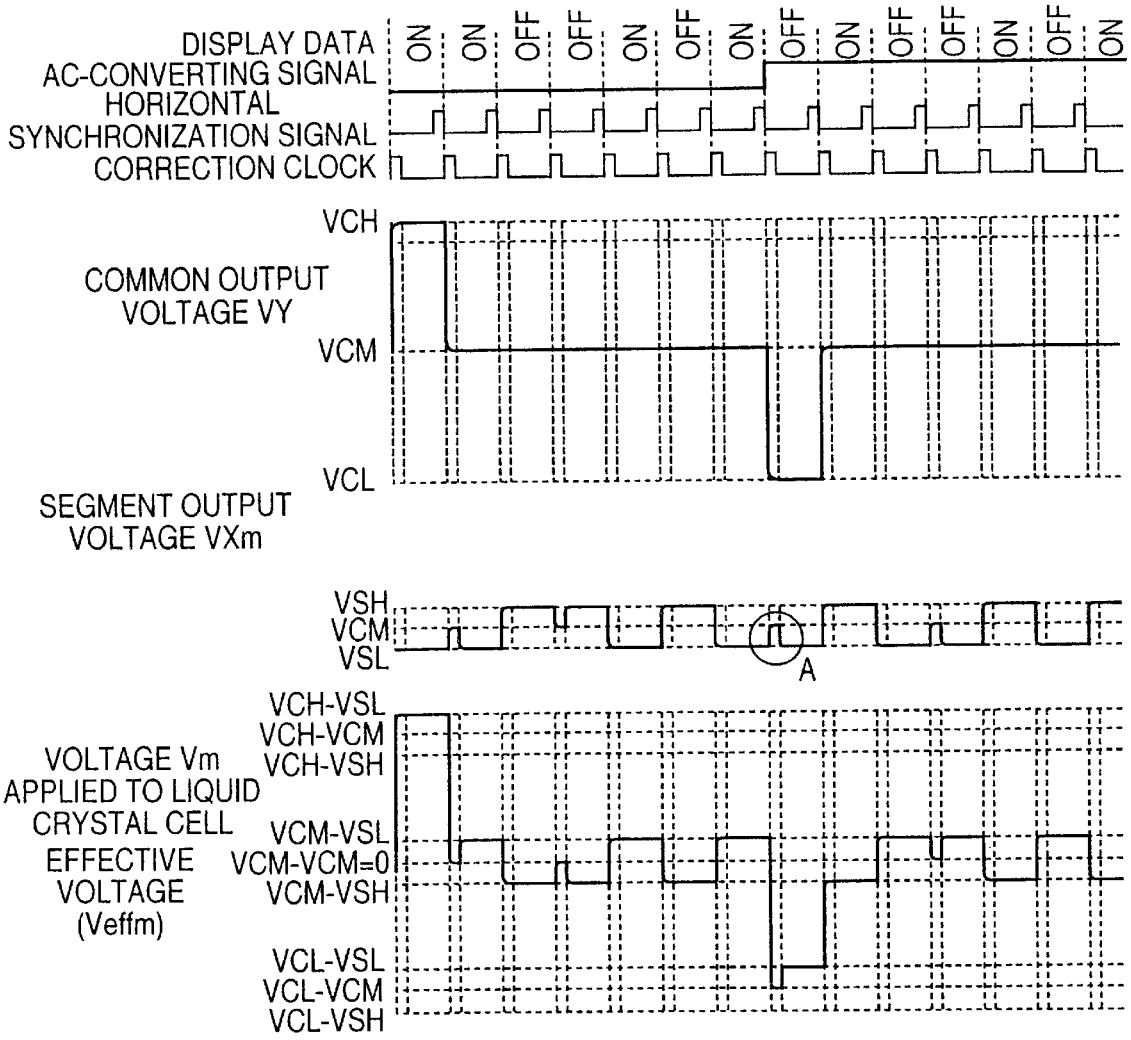
FIG. 44 is a timing chart showing voltage waveforms at various portions of the embodiment of FIG. 42.
Figure 45:
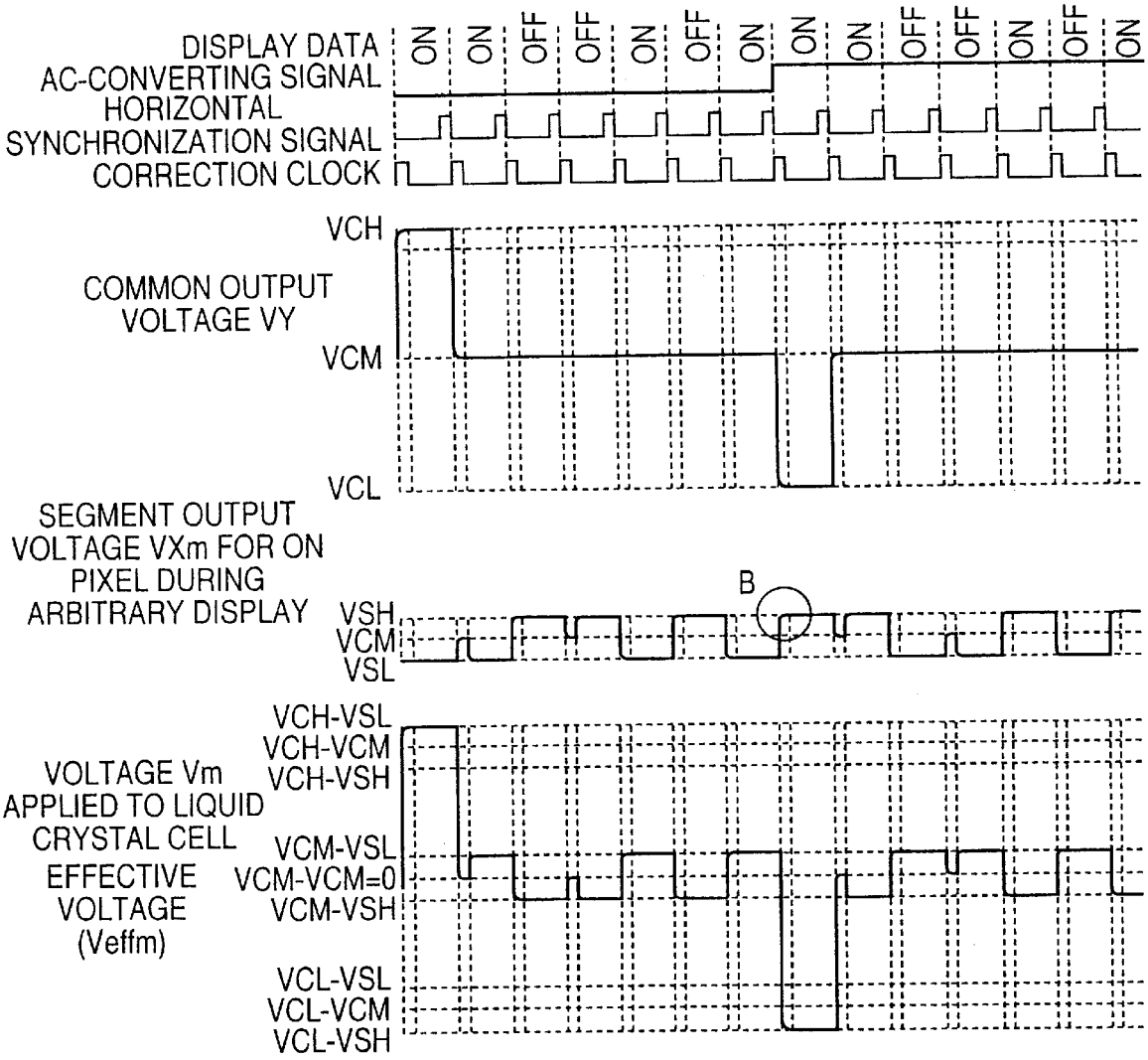
FIG. 45 is a timing chart showing voltage waveforms at various portions of the embodiment of FIG. 42.

FIG. 44 shows output waveforms of the drive circuits and voltage waveform applied to the liquid crystal cell. In this example, because the display data changes from ON to OFF when the AC-converting signal is switched, correction as indicated by A is applied to the segment output voltage. In case the display data remains ON without change when the AC-converting signal changes as shown in FIG. 45, correction is not applied as indicated by B. Such a method of correction when the AC-converting signal changes can be applied similarly to other embodiments.

Although FIGS. 42 and 43 show the configuration of this embodiment which does not include a level shifter, it is possible to achieve the 5V drive method such as level shifters are provided between the output controller 224 and the line latch 23, the liquid crystal drive output circuit 68 and at the input section of the AC-converting signal to the liquid crystal drive output circuit 68, so that the control logic section which is the circuit from the output controller 224 to the line latch 23 and the liquid crystal drive output circuit are driven by separate power sources.

Figure 46:
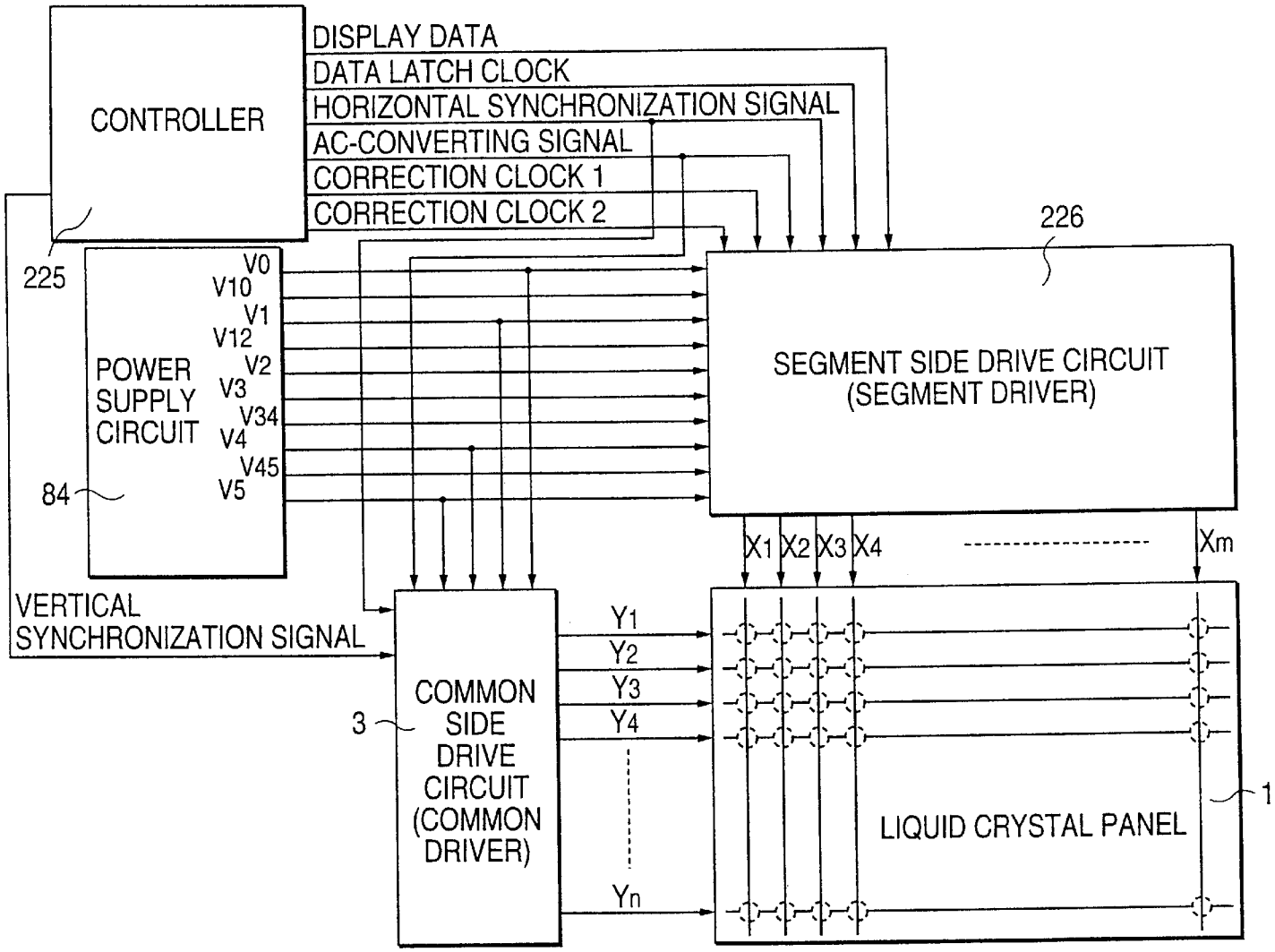
FIG. 46 is a block diagram showing schematic electrical configuration for driving a liquid crystal panel of a ninth embodiment of the invention.

FIG. 46 shows the schematic electrical configuration of a drive device for a liquid crystal panel of a ninth embodiment of the invention. Components corresponding to those of the first through eighth embodiments will be identified with the same numerals, and description thereof will be omitted. This embodiment is characterized in that the controller 225 supplies two correction clocks and two correction periods are provided in one scanning period. The power circuit 84 supplies a segment side drive circuit 226 with ten kinds of voltage from V0 to V5. Configuration of the drive device in this embodiment is the same as that of the third embodiment shown in FIG. 14 except for the controller 225 and the segment side drive circuit 226.

Figure 47:
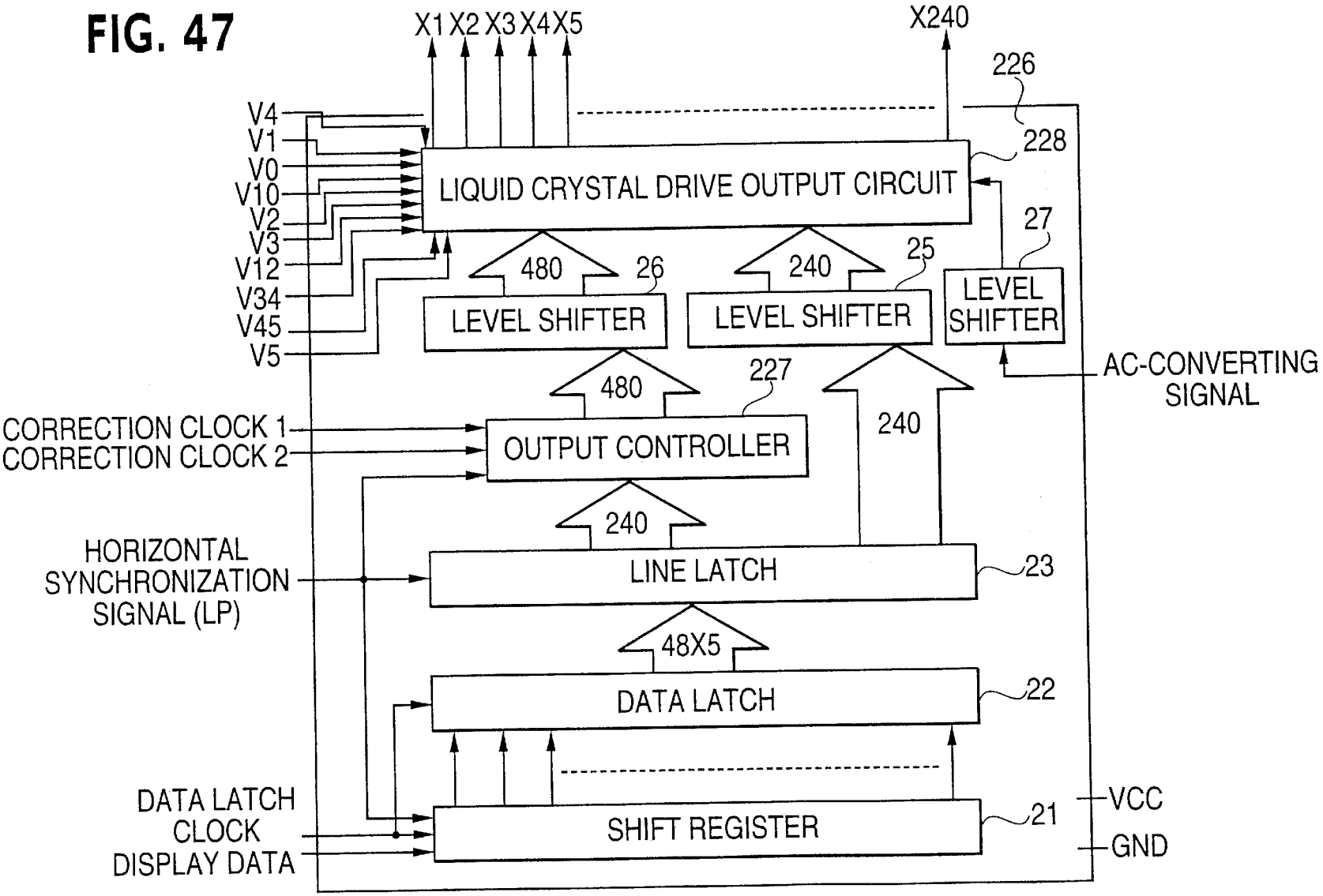
FIG. 47 is a block diagram showing an inner electrical configuration of a segment side drive circuit 226 of FIG. 46.
Figure 48:
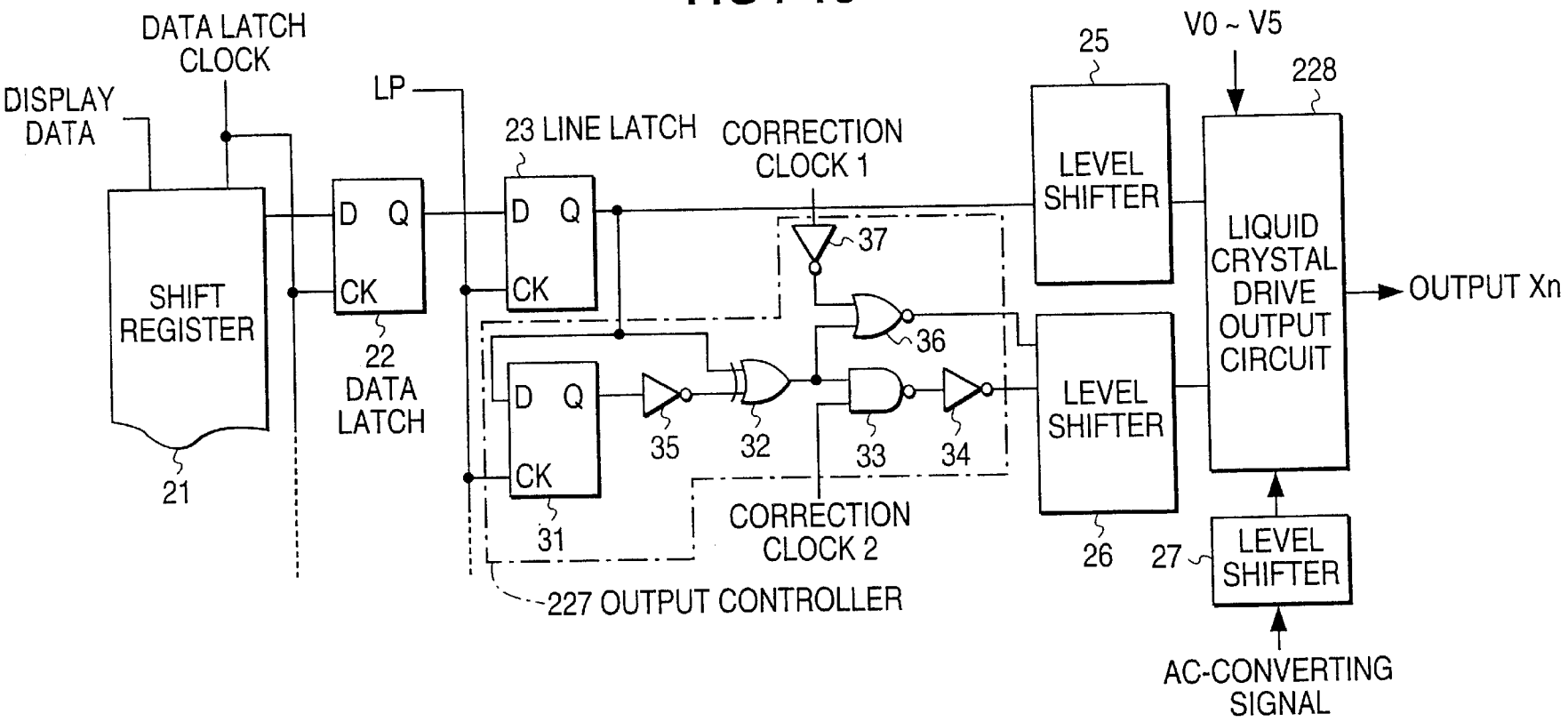
FIG. 48 is a block diagram showing a logical configuration related to an output controller 227 of FIG. 47.

FIG. 47 shows the inner configuration of the segment side drive circuit 226. Configuration of those other than the output controller 227 and the liquid crystal drive output circuit 228 is similar to that of the third embodiment shown in FIG. 15, and therefore description thereof will be omitted. Inner configuration of the output controller 227 and related configuration are shown in FIG. 48. In the output controller 227, output of the EXOR circuit 32 is supplied to one input of the NAND circuit 33 and to one input of the NOR circuit 36. Supplied to the other input of the NOR circuit 36 is first correction clock via the inverter circuit 37. Second correction clock is supplied to the other input of the NAND circuit 33. The D flipflop circuit 31 stores the data of the previous scanning period, while the EXOR circuit 32 compares the data of the previous scanning period and data of the present scanning period obtained from the line latch circuit 23. Only during a period when the data is the same and the second correction clock is high, output of the inverter circuit 34 turns high. When this output is given to the liquid crystal drive output circuit 228 as output (2) via the level shifter 26, voltages V10, V12, V34 and V45 of intermediate levels for correction are output.

The output of the EXOR circuit 32 is supplied also to the NOR circuit 36. Only during a period when the data is different and the first correction clock which is input via the inverter circuit 37 is high, output of the NOR circuit 36 turns high. This output is given to the liquid crystal drive output circuit 228 as output (1) via the level shifter 26.

Figure 49:
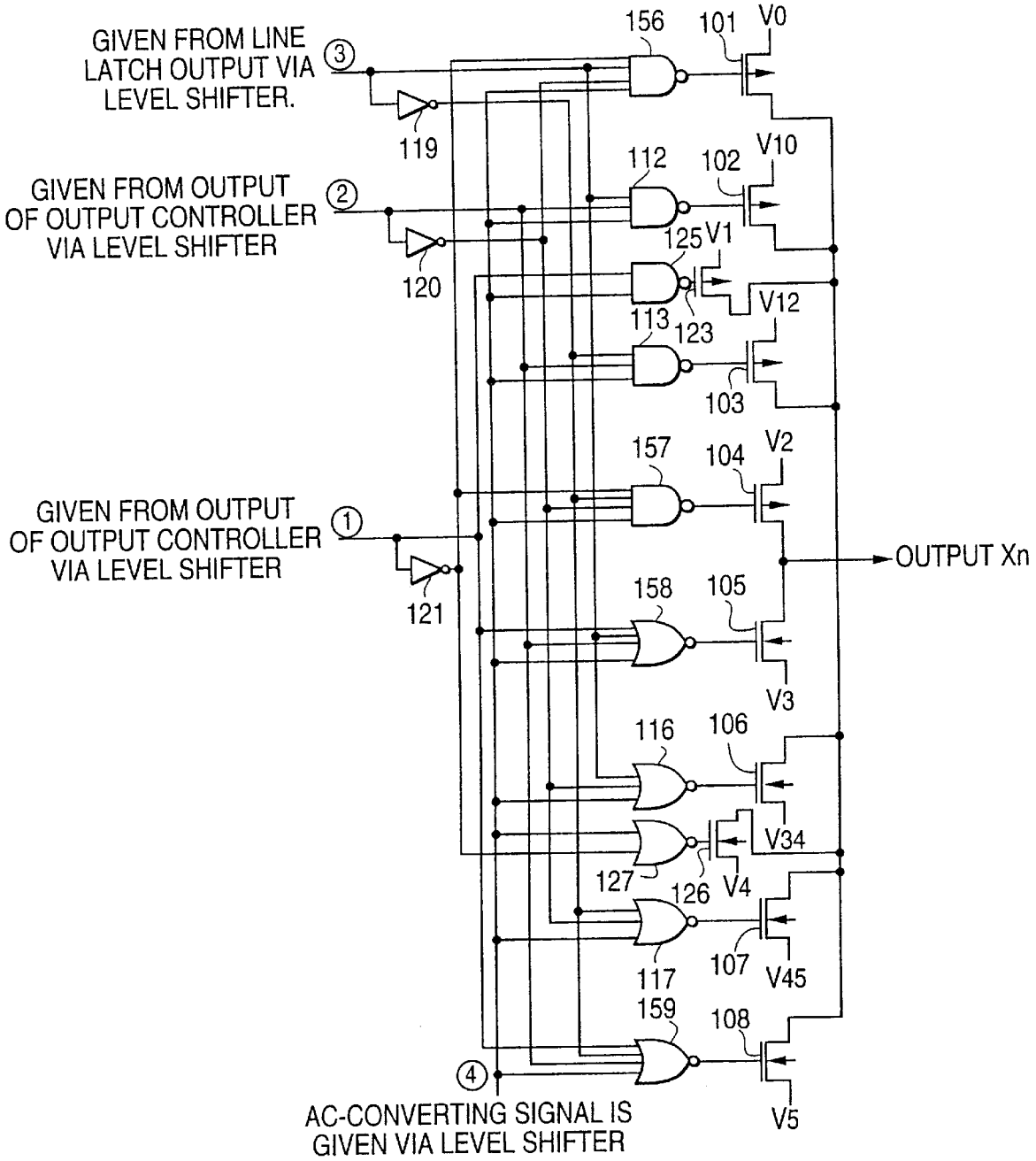
FIG. 49 is an electric circuit diagram of a liquid crystal drive output circuit 228 of FIG. 47.

FIG. 49 shows the circuit configuration for one segment electrode of the liquid crystal drive output circuit 228 of FIG. 47. Connected in common to each segment electrode Xn are drain electrodes of P channel MOS transistors 101, 102, 103, 104 and 123 of which source electrodes are connected to V0, V10, V12, V2 and V1, respectively, and drain electrodes of N channel MOS transistors 105, 106, 107, 108 and 126 of which source electrodes are connected to V3, V34, V45, V5 and V4, respectively. Gate electrodes of the P channel MOS transistors 101, 102, 103, 104 and 123 are connected to the output terminals of the NAND circuits 156, 112, 113, 157 and 125, respectively. Gate electrodes of the N channel MOS transistors 105, 106, 107, 108 and 126 are connected to the output terminals of the NOR circuits 158, 116, 117, 159 and 127, respectively. Supplied to inputs of the NAND circuits 156, 112, 113, 157 and 125 and inputs of the NOR circuits 158, 116, 117, 159 and 127 are outputs (1) and (2) from the inverter circuit 34 of the output controller 227 and the level shifter 26 of the NOR circuit 36, output (3) from the line latch 23 via the level shifter 25 and input (4) obtained by passing the AC-converting signal through the level shifter 27, directly or via the inverter circuits 121, 120 and 119. Table 7 shows the truth values which represent the operations of the logic circuit shown in FIG. 47.

TABLE 7

| ① | ② | ③ | ④ | | Xn |
|---|---|---|---|---|---|
| L | L | H | H | V0 | |
| L | L | L | H | V2 | |
| L | L | L | L | V3 | |
| L | L | H | L | V5 | |
| L | H | H | H | V10 | Correction voltages |
| L | H | L | H | V12 | for correcting |
| L | H | L | L | V34 | shadowing caused by |
| L | H | H | L | V45 | rounding of waveform due to change in the output voltage |
| H | L | — | H | V1 | Correction voltage |
| H | L | — | L | V4 | for dispersing spike noise |

Figure 50:
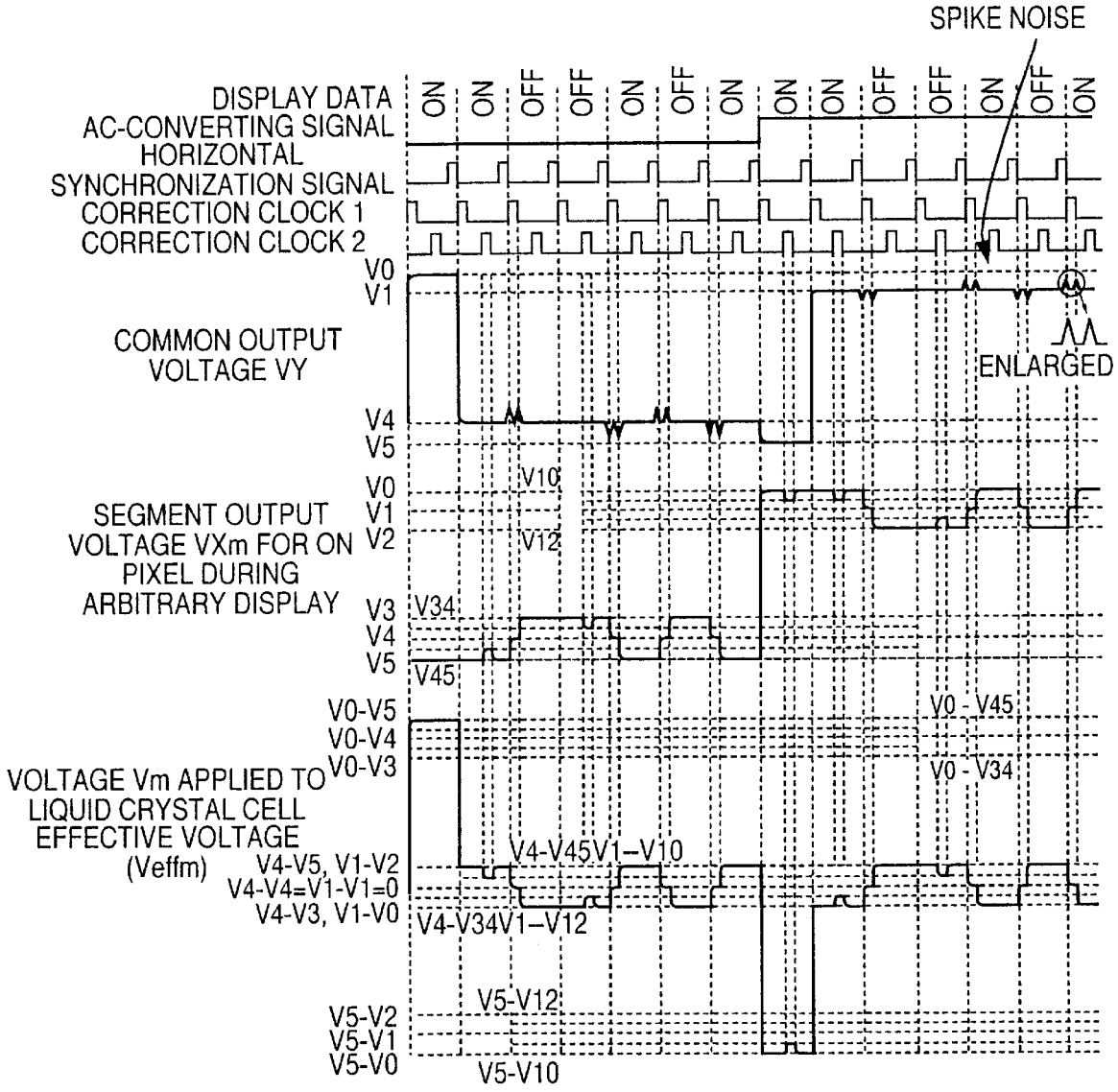
FIG. 50 is a timing chart showing voltage waveforms at various portions of the embodiment of FIG. 46.

FIG. 50 shows output waveforms of the drive circuits and voltage waveform applied to the liquid crystal cell. Because output is retained once at an intermediate level V1 or V4 during the first correction clock when the output changes, spike noise superposed on the common side can be dispersed and difference in the effective voltage can be reduced. This makes it possible to further suppress the luminance unevenness (shadowing).

Figure 51:
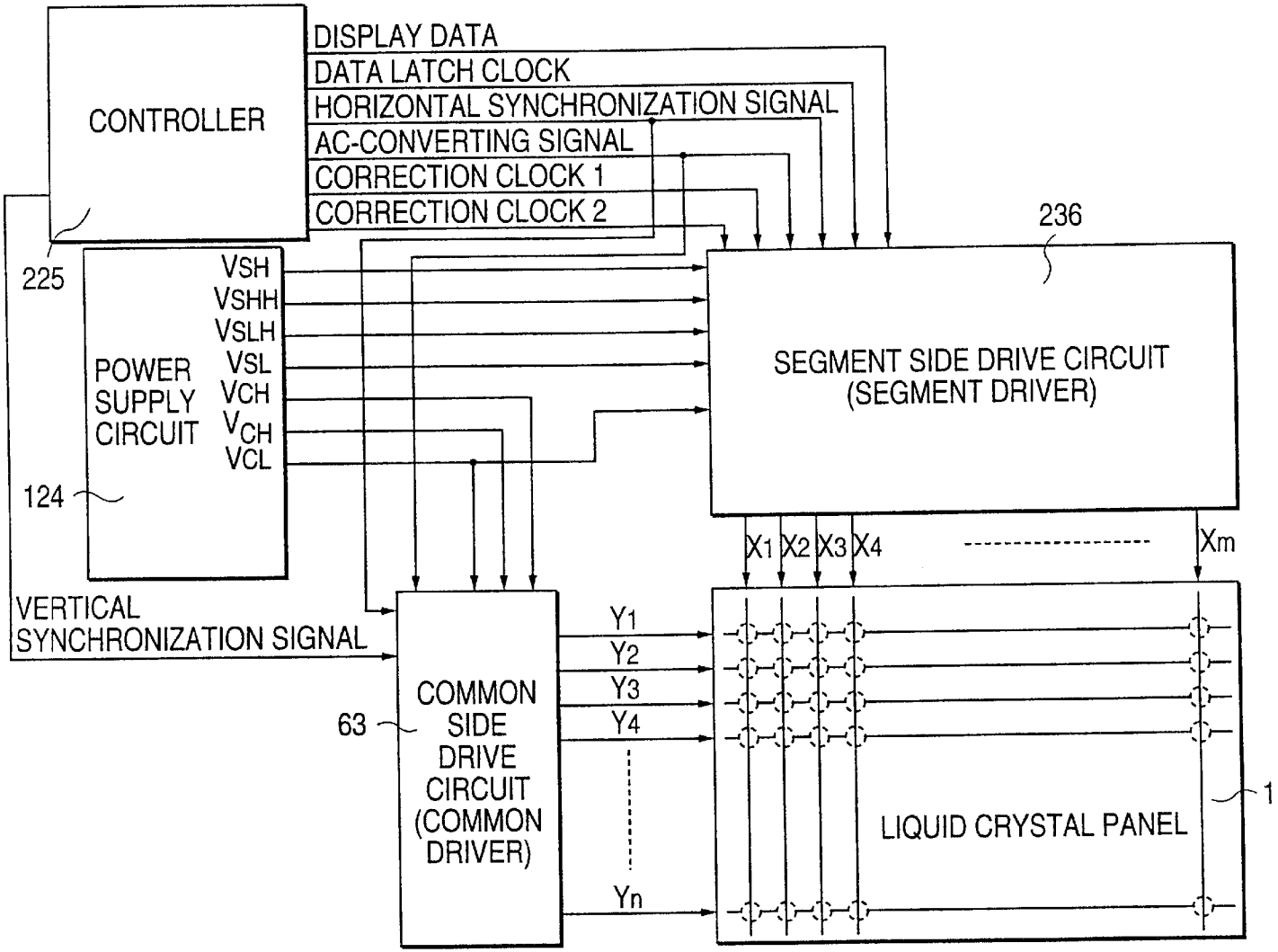
FIG. 51 is a block diagram showing a schematic electrical configuration for driving a liquid crystal panel of a tenth embodiment of the invention.
Figure 52:
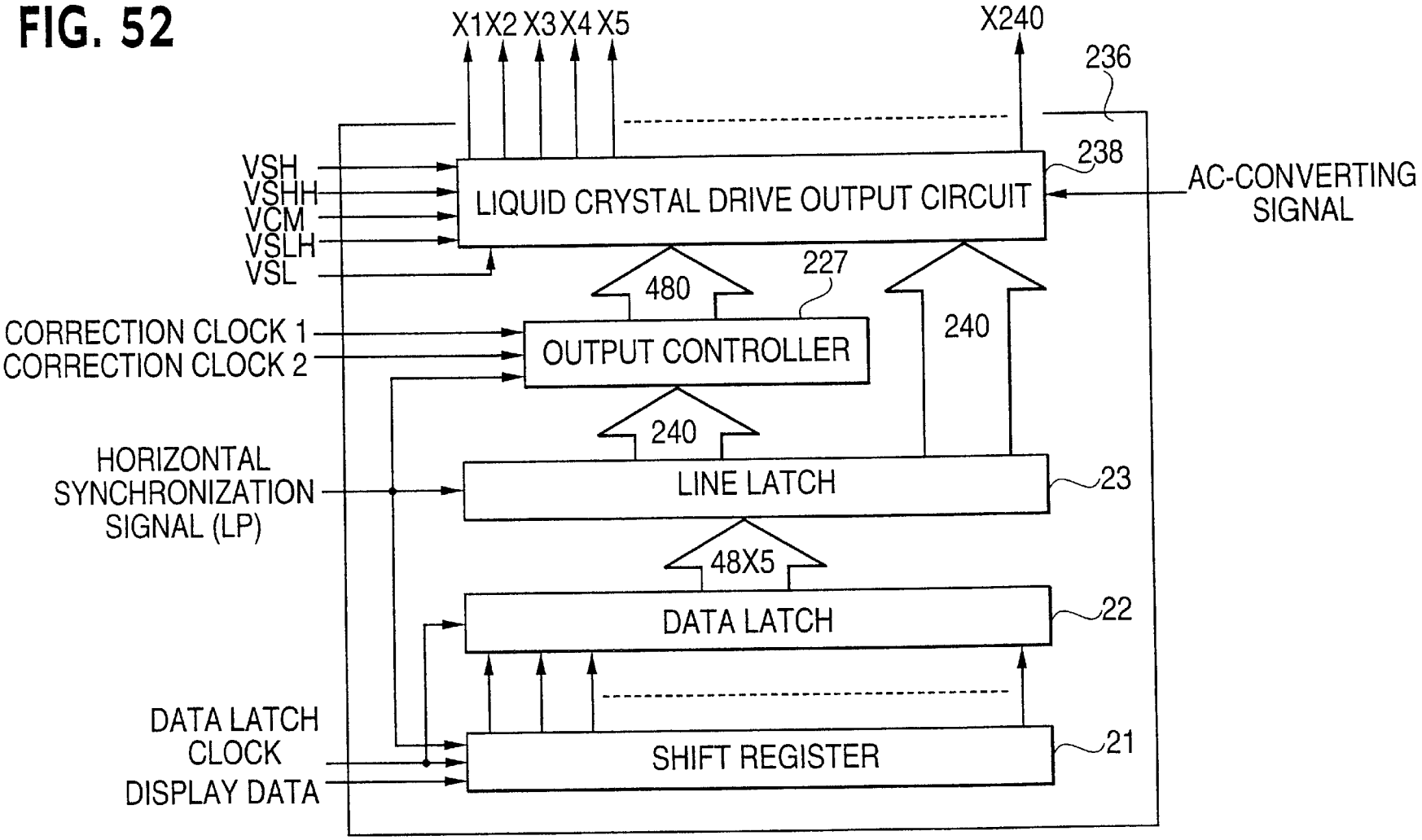
FIG. 52 is a block diagram showing an inner electrical configuration of a segment side drive circuit 236 of FIG. 51.
Figure 53:
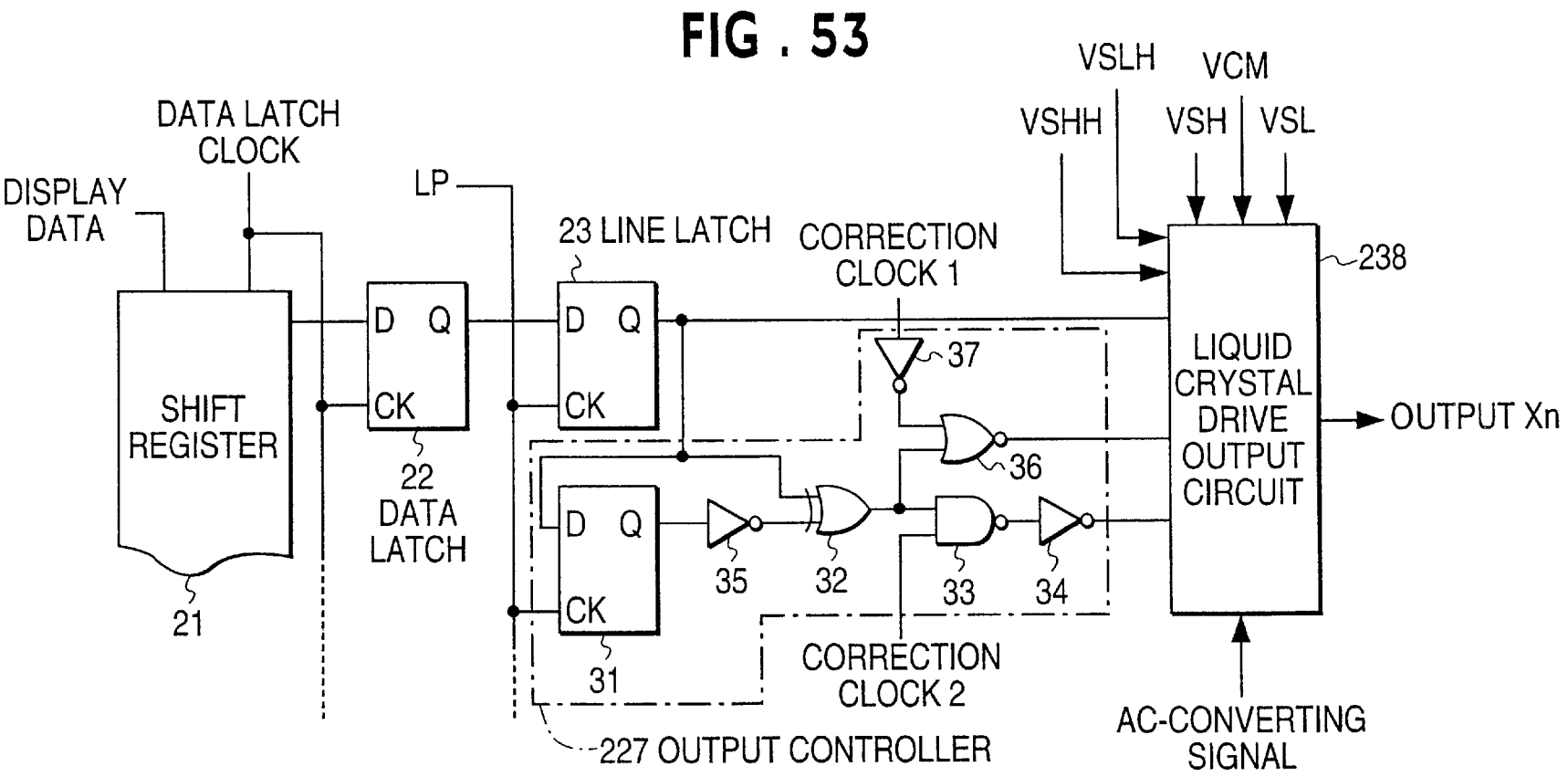
FIG. 53 is a block diagram showing a logical configuration related to an output controller 227 of FIG. 52.

FIG. 51 shows the configuration for achieving the ninth embodiment with the 5V drive method of a tenth embodiment of the invention. Components of this embodiment corresponding to those of the first through ninth embodiments will be identified with the same numerals, and similar description will be omitted. This embodiment is similar to the fourth embodiment shown in FIG. 20, but is different in that a correction clock is added to have two correction clocks. Consequently, configuration of the segment side drive circuit 236 becomes different as shown in FIG. 52. A power circuit 124 supplies five voltages to the segment side drive circuit 236. FIG. 53 shows an example of detailed circuit configuration for one output.

Figure 54:
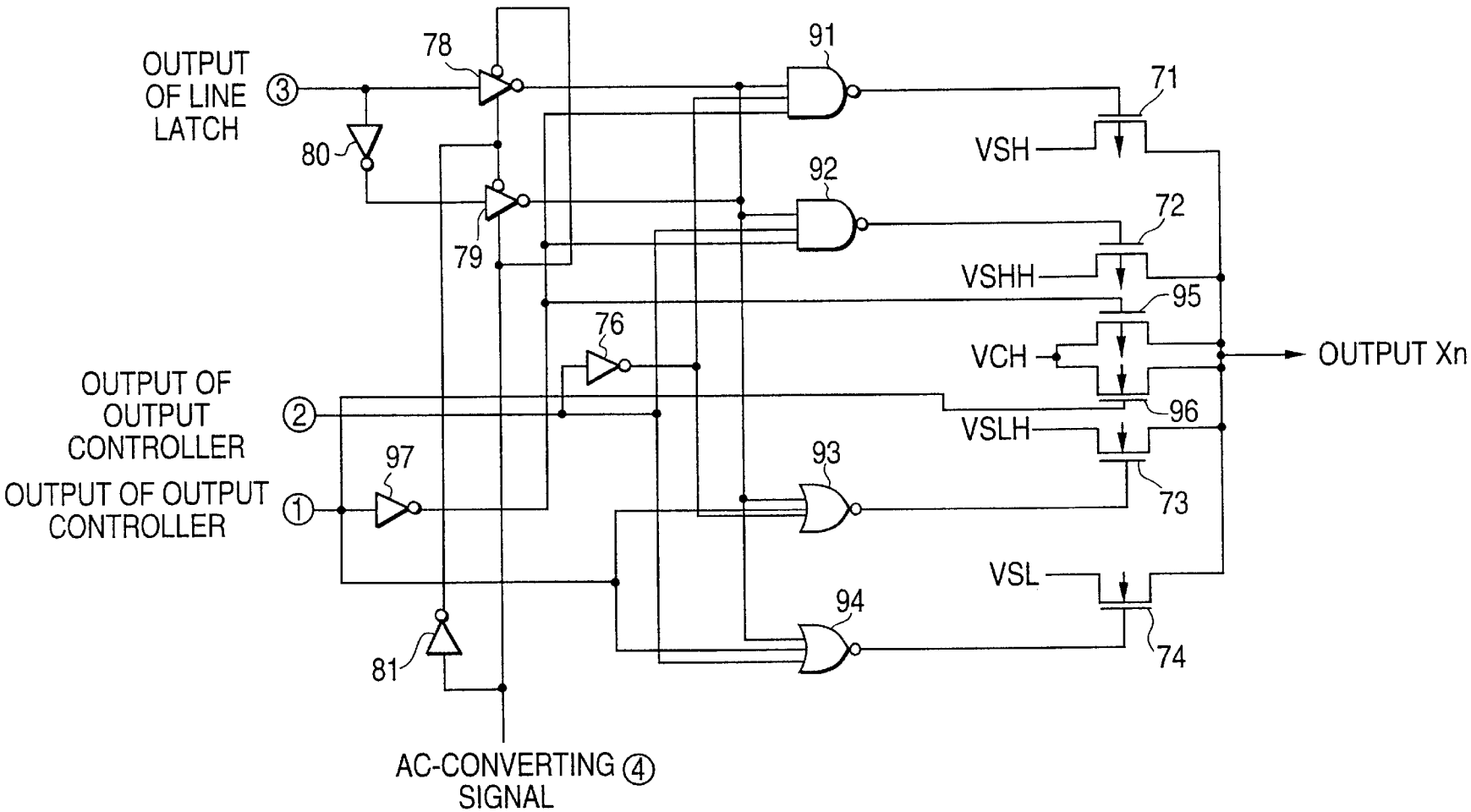
FIG. 54 is an electric circuit diagram of a liquid crystal drive output circuit 238 of FIG. 47.

FIG. 54 shows a circuit configuration for one segment electrode of the liquid crystal drive output circuit 238 of FIG. 52. Connected in common to each segment electrode Xn are drain electrodes of P channel MOS transistors 71, 72 and 95 of which source electrodes are connected to VSH, VSHH and VCM, respectively, and drain electrodes of N channel MOS transistors 73, 74 and 96 of which source electrodes are connected to VSLH, VSL and VCM, respectively. Gate electrodes of the P channel MOS transistors 71 and 72 are connected to the output terminals of the NAND circuits 91 and 92, respectively, and gate electrodes of the N channel MOS transistors 73 and 74 are connected to the output terminals of the NOR circuits 93 and 94, respectively. The NAND circuits 91, 92 and the NOR circuits 93, 94 are supplied with outputs ① and ② from the inverter circuit 34 of the output controller 227 and of the NOR circuit 36, output ③ from the line latch 23 and the AC-converting signal ④ being given to the inputs thereof via the logic circuit comprising the inverter circuits 76, 80, 81 and 97 and the clocked inverter circuits 78 and 79. Table 8 shows the truth values representing the operation of the logic circuit shown in FIG. 54.

TABLE 8

| ① | ② | ③ | ④ | Xn |
|---|---|---|---|---|
| L | L | L | L | VSL |
| L | L | H | L | VSH |
| L | L | H | H | VSH |
| L | L | L | H | VSL |
| L | H | L | L | VSLH |
| L | H | H | L | VSHH |
| L | H | H | H | VSHH |
| L | H | L | H | VSLH |
| H | L | — | — | VCM |

Figure 55:
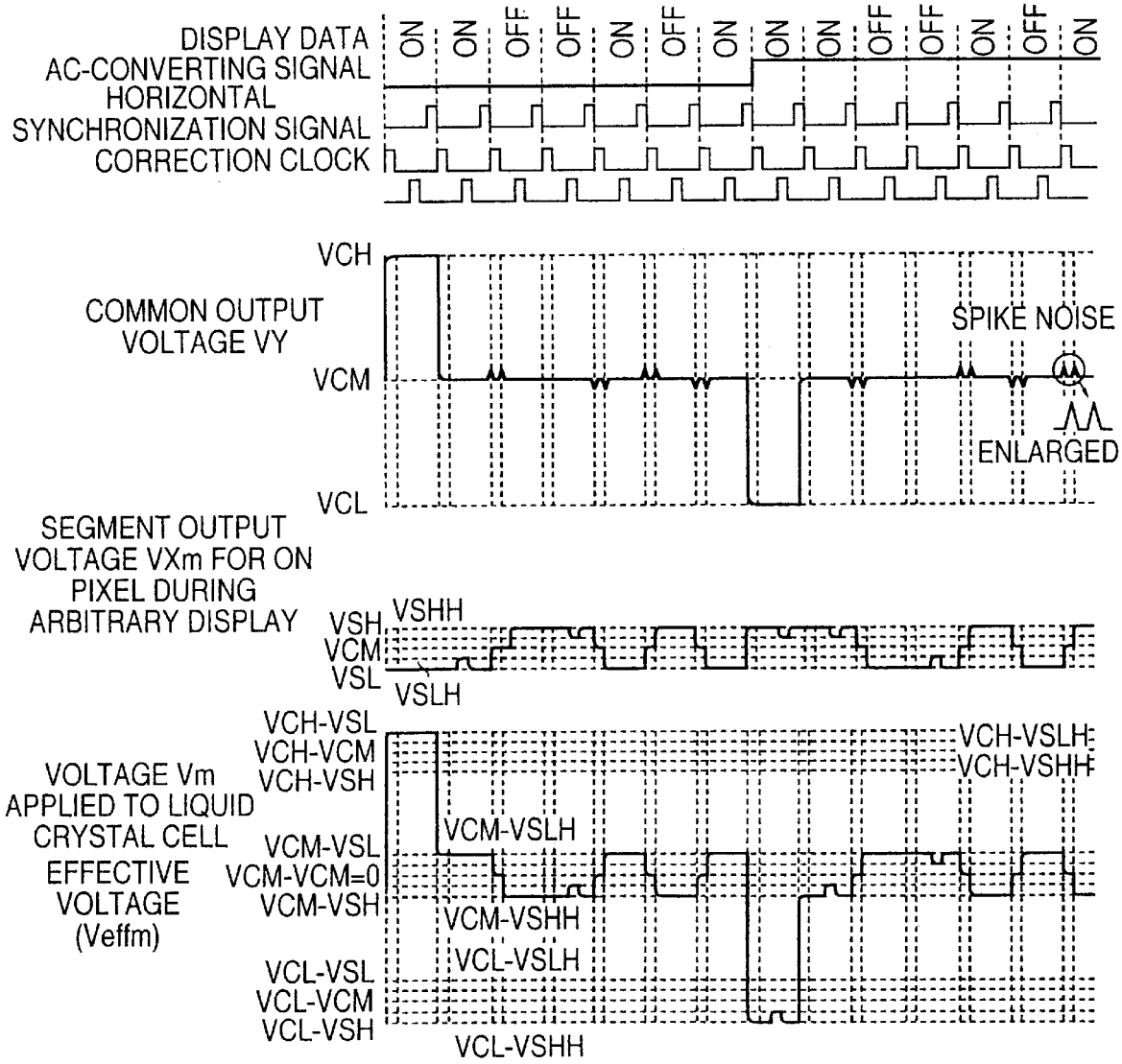
FIG. 55 is a timing chart showing voltage waveforms at various portions of the embodiment of FIG. 51.
Figure 56:
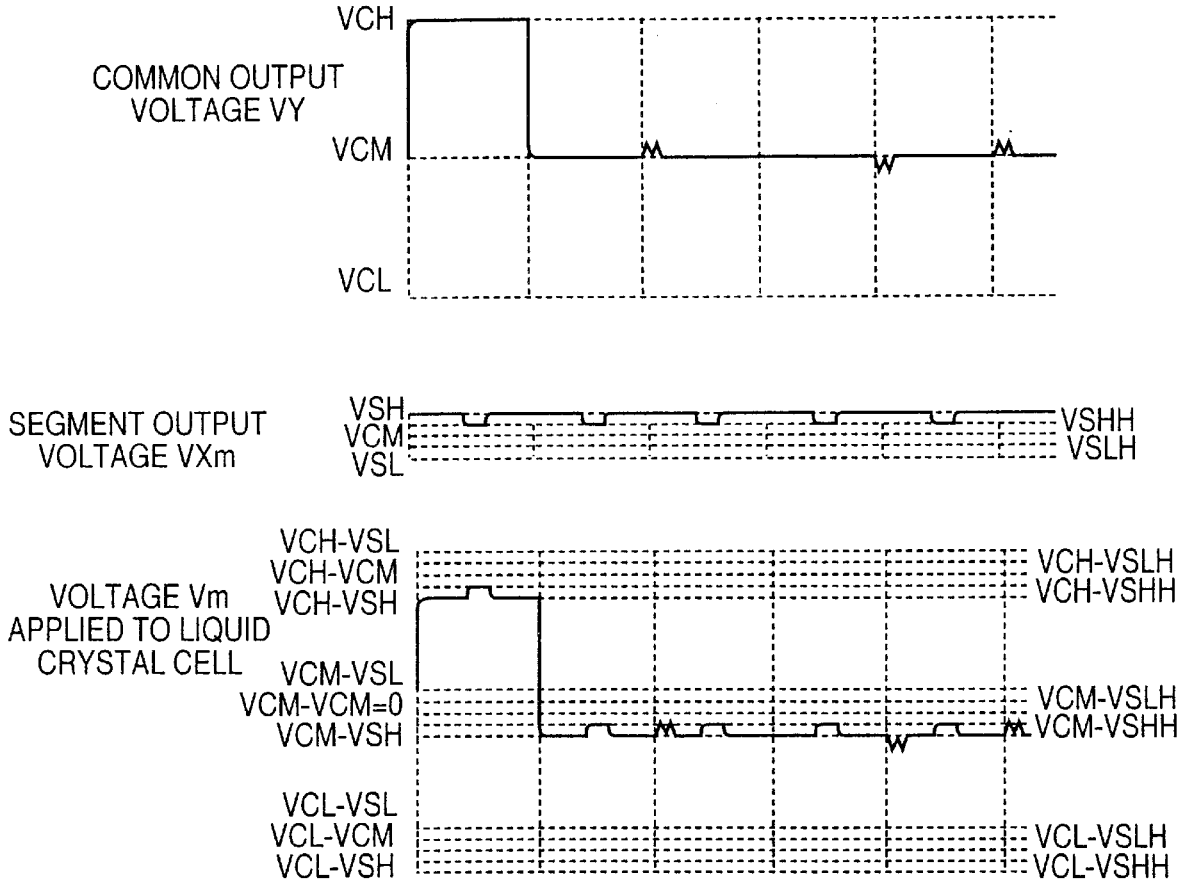
FIG. 56 is a timing chart showing voltage waveforms at various portions of the embodiment of FIG. 51.
Figure 57:
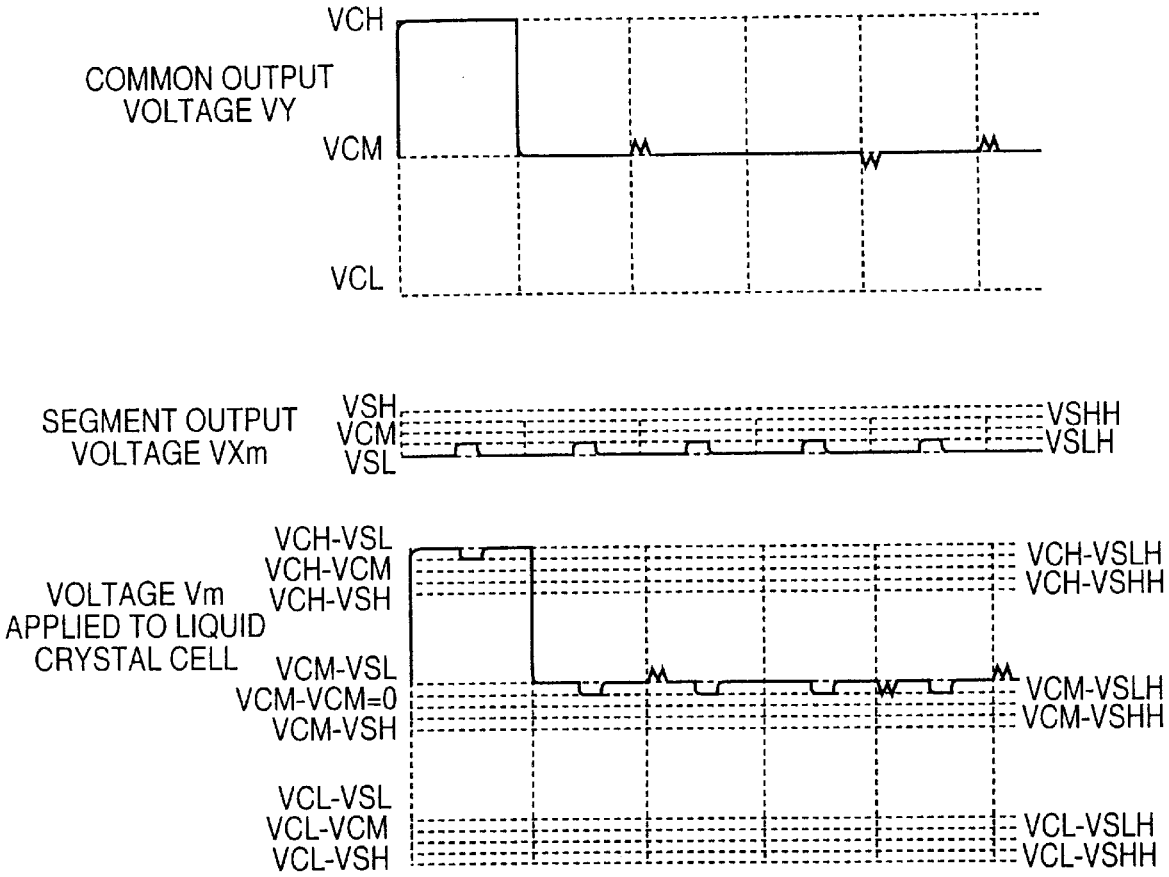
FIG. 57 is a timing chart showing voltage waveforms at various portions of the embodiment of FIG. 51.

FIG. 55 shows voltage waveforms at various points during operation of this embodiment. FIG. 56 and 57 show enlarged waveforms of ON display and OFF display, respectively. Because the output voltage of the segment side is once retained at an intermediate level when changing, spike noise superposed on the common side are dispersed, thus reducing the effect thereof.

Although this embodiment is shown in the configuration without level shifters, it may also be achieved in a configuration which includes level shifters, such that level shifters are provided between the output controller 227 and the line latch 23, the liquid crystal drive output circuit 238 and at the input side of the AC-converting signal to the liquid crystal drive output circuit 238.

Figure 58:
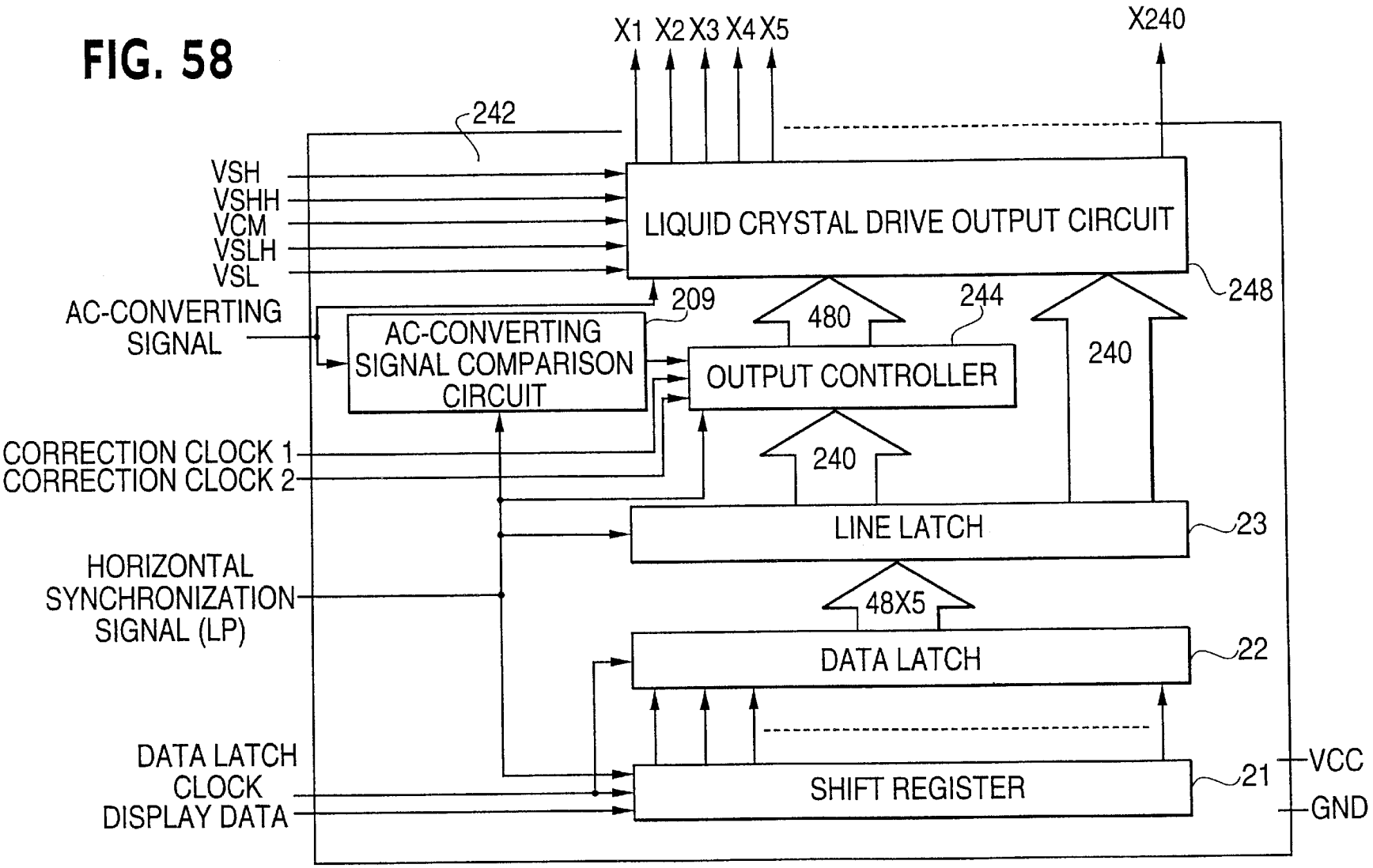
FIG. 58 is a block diagram showing an inner electrical configuration of a segment side drive circuit 242 of an eleventh embodiment of the invention.
Figure 59:
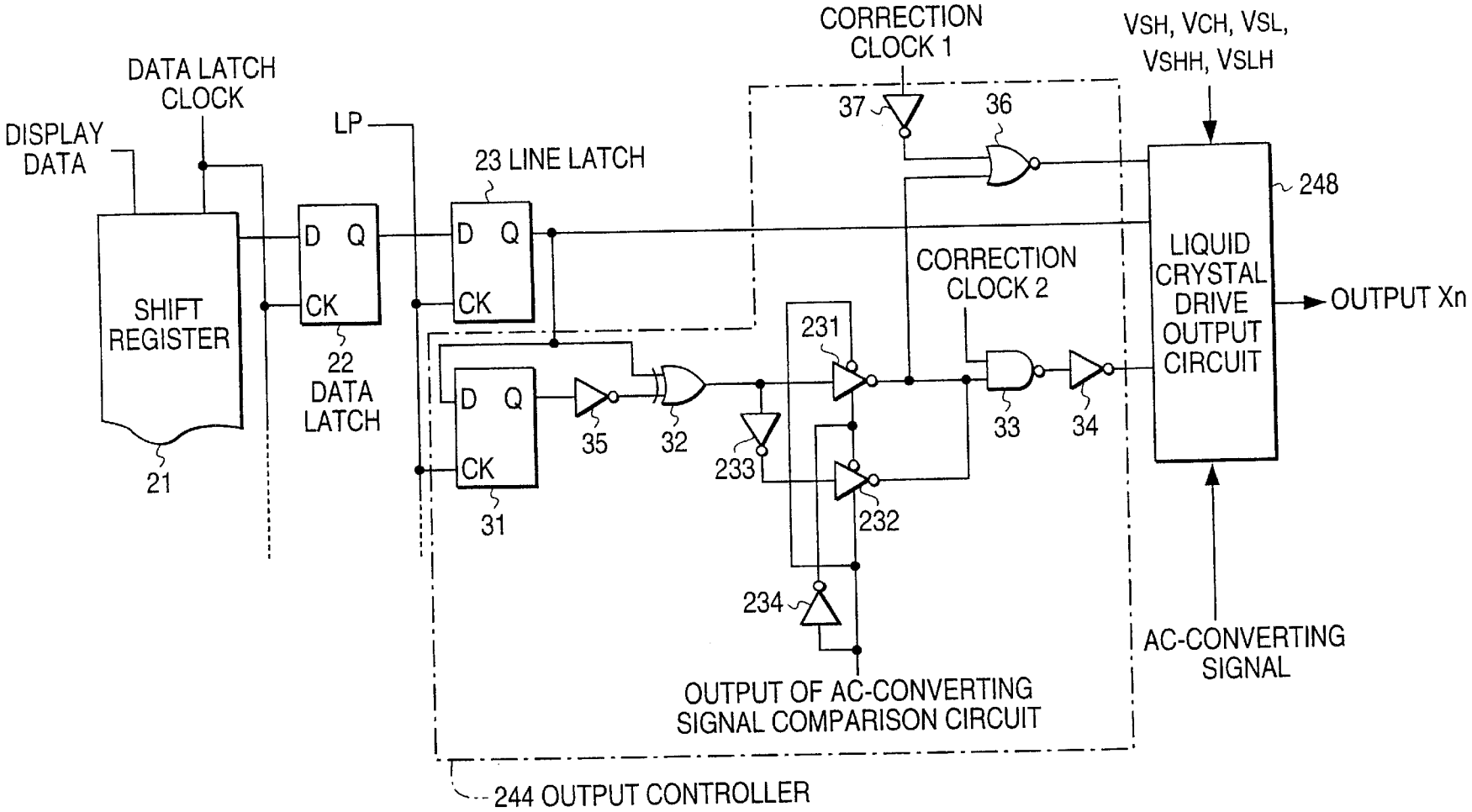
FIG. 59 is a block diagram showing a logical configuration related to an output controller 244 of FIG. 58.

FIG. 58 shows the configuration of a segment side drive circuit 242 of a liquid crystal drive device of an eleventh embodiment of the invention. FIG. 59 shows more detailed inner configuration for one output. In this embodiment, 5V drive method is employed similarly to the segment side drive circuit 222 of the eighth embodiment shown in FIG. 42 while a correction clock is added and five kinds of voltage are supplied to the liquid crystal drive output circuit 248. Provided between the output of the EXOR circuit 32 and inputs of the NAND circuit 33 and the NOR circuit 36 is a logic circuit comprising clocked inverter circuits 231, 232 and inverter circuits 234, 233, while selection is done as to whether the circuit is directly connected or connected after inversion according to output from the AC-converting signal comparison circuit 209. Therefore, when the AC-converting signal changes, output of the output controller 244 causes the liquid crystal drive output circuit 248 to output VCM as an intermediate level during the first correction period in case the display data does not change. This enables it to improve the effect of the change in the AC-converting signal.

Figure 60:
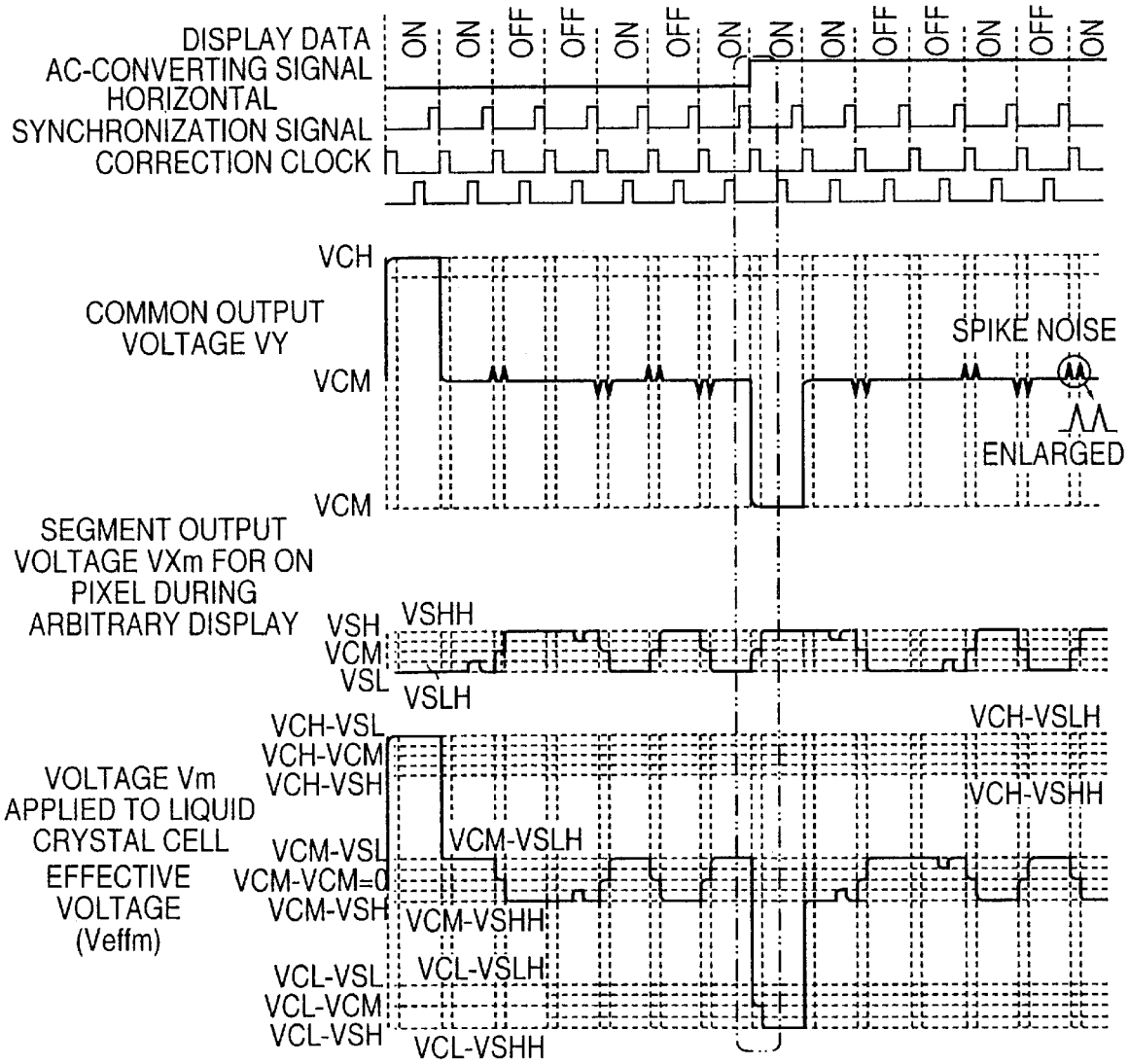
FIG. 60 is a timing chart showing voltage waveforms at various portions of the embodiment of FIG. 59.

FIG. 60 shows voltage waveforms at various portions during operation of this embodiment. Although the display data remains ON without change when the AC-converting signal changes, the segment side output voltage changes further after once changing to the intermediate level VCM. FIG. 55 shows a case of single-step change, not the 2-step changes as described above. Although correction is applied in the second correction period after the AC-converting signal has changed in the case of FIG. 55, correction in the second correction period is not applied in the case of FIG. 60. Although this embodiment is shown in the configuration without level shifters, it may also be achieved in a configuration which includes level shifters. Such a configuration can be made by providing level shifters between the output controller 244 and the line latch 23, the liquid crystal drive output circuit 248 and at the input side of the AC-converting signal to the liquid crystal drive output circuit 248.

Figure 61:
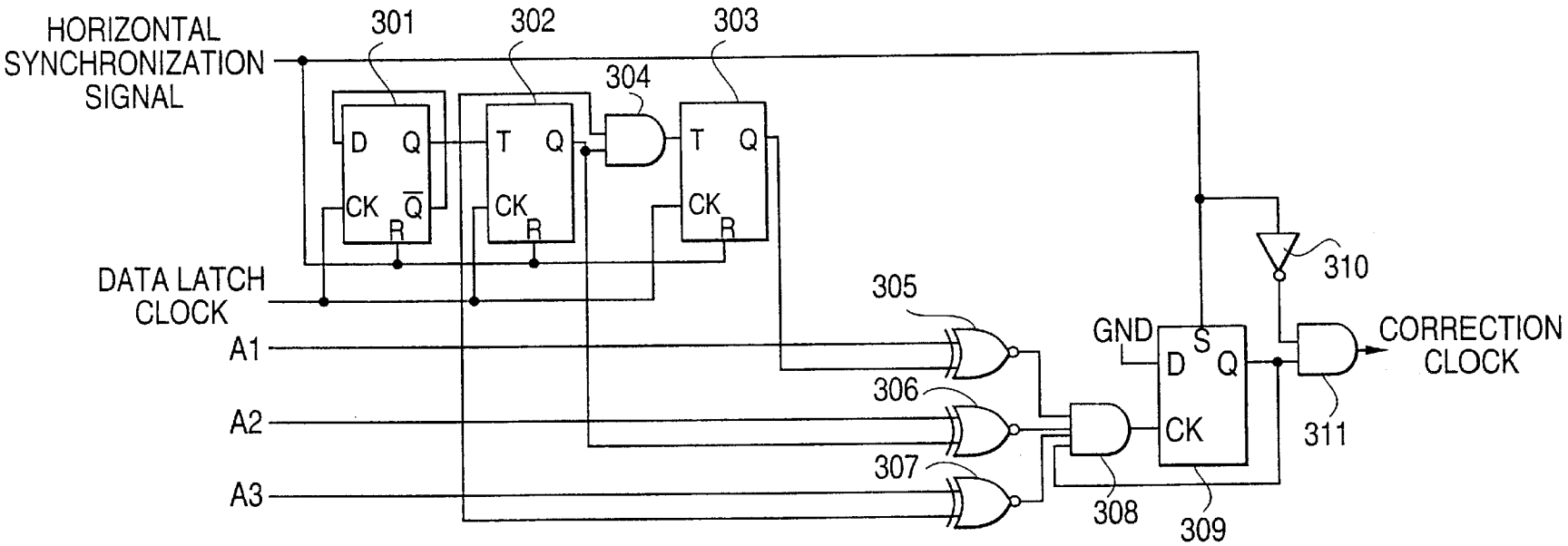
FIG. 61 is a logic circuit diagram showing a circuit configuration of correction clock generating means of a twelfth embodiment of the invention.

Circuit configuration of correction clock generating means for setting the correction period used in the embodiments described above is shown in FIG. 61, and will be described as a twelfth embodiment. The correction clock generating means comprises a D flipflop 301 with reset input, T flipflops with reset input 302, 303, 2-input AND circuits 304, 311, EXOR circuits 305, 306, 307, a 4-input AND circuit 308, a D flipflop with set input 309 and an inverter circuit 310.

Figure 62:
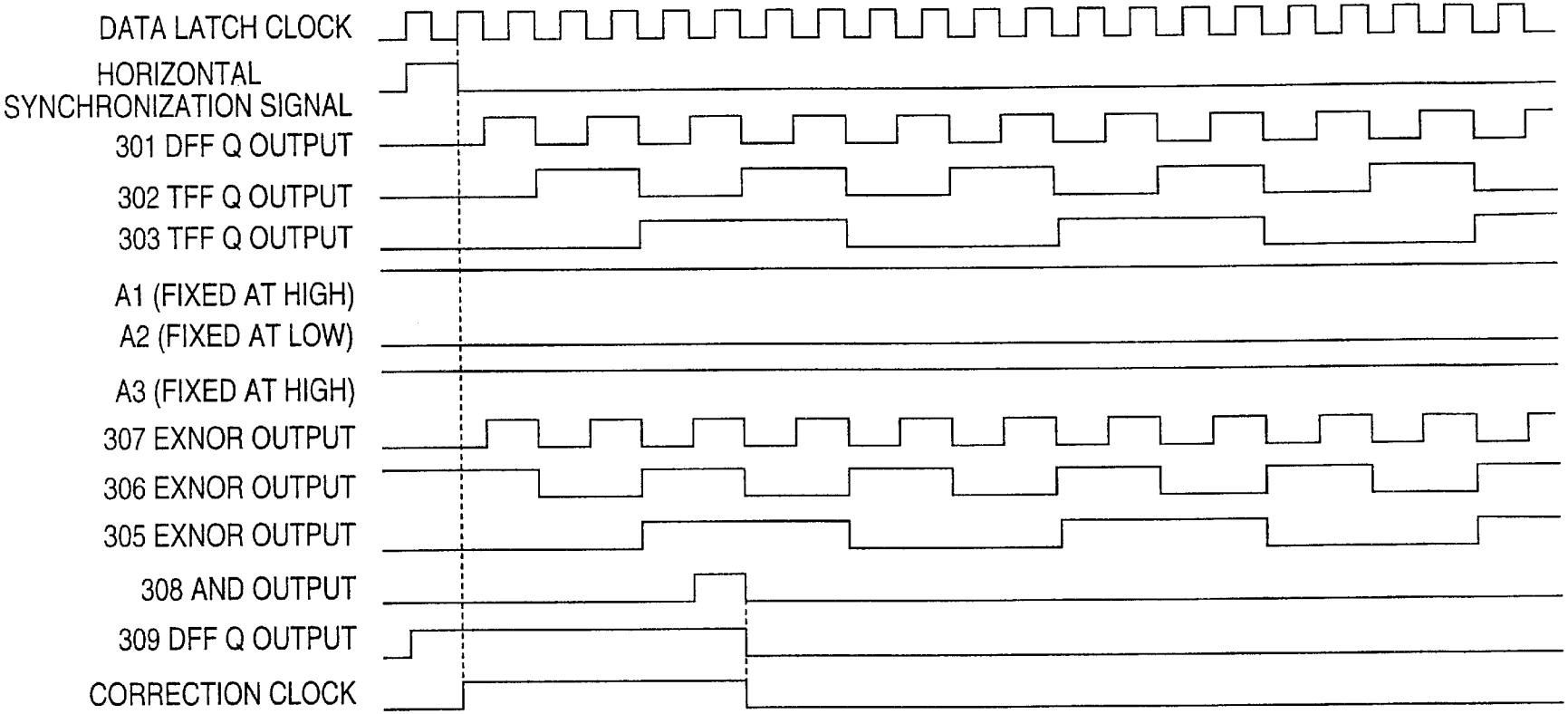
FIG. 62 is a timing chart showing voltage waveforms at various portions of the embodiment of FIG. 61.

Now the circuit operation will be described. The D flipflop 301 and the T flipflops 302, 303 are reset and Q outputs of the flipflops turn to low in a period when the horizontal synchronization signal is high. When the data latch clock changes, the D flipflop circuit 301 outputs a waveform having a frequency obtained by 2-division of the data latch clock and the T flipflops 302, 303 output waveforms having frequencies obtained by 4-division and 8-division of the data latch clock from the Q output thereof, respectively. 3-bit comparison values A1, A2 and A3 are fixed at high or low level. Duration of the correction clock can be changed by selecting the level at which A1 through A3 are fixed. Although it is assumed that A1 and A3 are fixed at high level and A2 is fixed at low level for the convenience of description, other arrangement may be employed according to the correction period required. Q outputs of the D flipflop 301 and of the T flipflops and A1 through A3 are compared in the EXNOR circuits 305 through 307. The D flipflop 309 is set in a period when the horizontal synchronization signal is high, so that Q output turns to high level. According to outputs of the EXNOR circuits 305 through 307 which are the results of comparison and the Q output of the D flipflop 309, output of the 4-input AND circuit 308 changes. This change causes the Q output of the D flipflop 309 to change to low level, so that the correction clock can be obtained from the AND circuit 311 which generates a logical product with the signal which is the output of the inverter circuit 310 which inverts the horizontal synchronization signal. The operation described above is shown in FIG. 62.

Although the 2-division circuit in 3-step operation and 3-bit comparison are assumed in this embodiment, a correction clock of a larger width can be obtained by increasing the number of comparison bits according to the width of the correction clock. Further the circuit of this embodiment may also be incorporated in the segment side drive circuit and formed in the controller.

Although the correction clock is generated immediately after the horizontal synchronization signal changes in the twelfth embodiment, the correction period may be provided at any timing provided that it is within one scanning period. Therefore, a method of generating the correction clock at other timing than immediately after the horizontal synchronization signal changes will be described below as a thirteenth embodiment of the invention.

Figure 63:
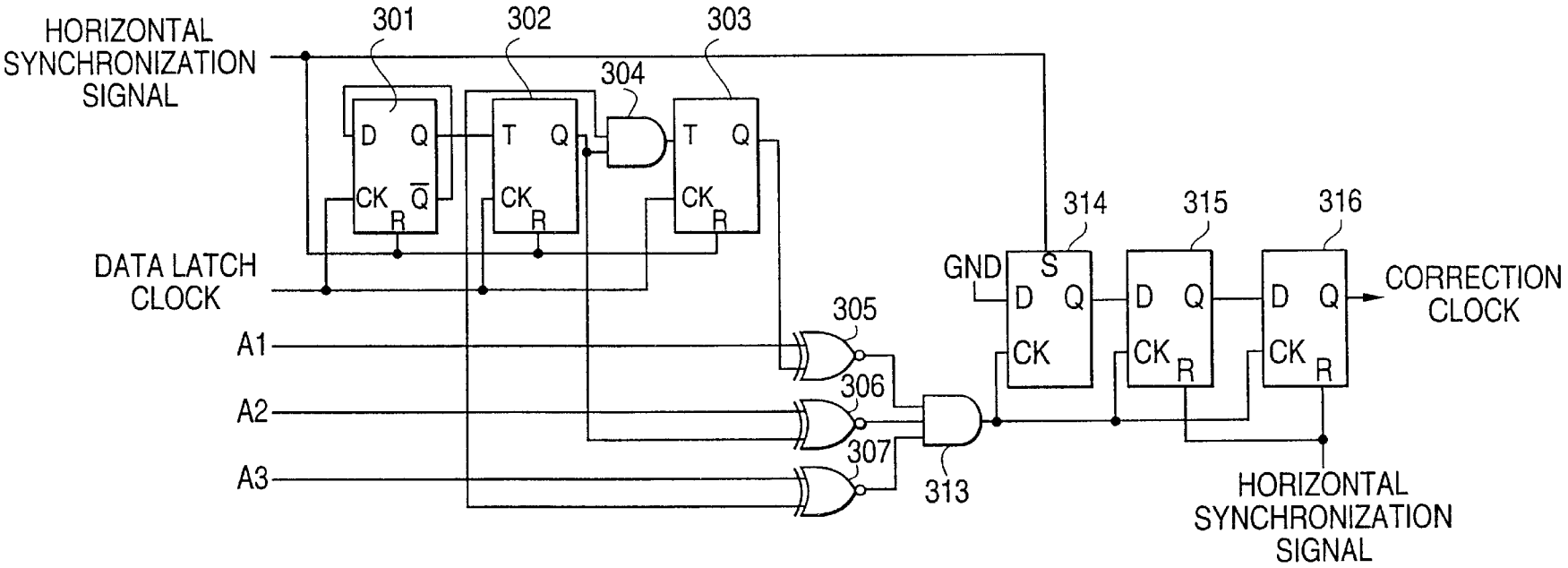
FIG. 63 is a logic circuit diagram showing a circuit configuration of correction clock generating means of a thirteenth embodiment of the invention.

Circuit configuration for generating the correction clock according to this embodiment is shown in FIG. 63. Components identical with those of the twelfth embodiment will be identified with the same numerals, and description thereof will be omitted. This embodiment is different from the twelfth embodiment in that the result of comparison is input to a 3-input AND circuit 313 and that a shift register circuit is constituted of a D flipflop 314 with set input and D flipflops with reset input 315, 316.

Figure 64:
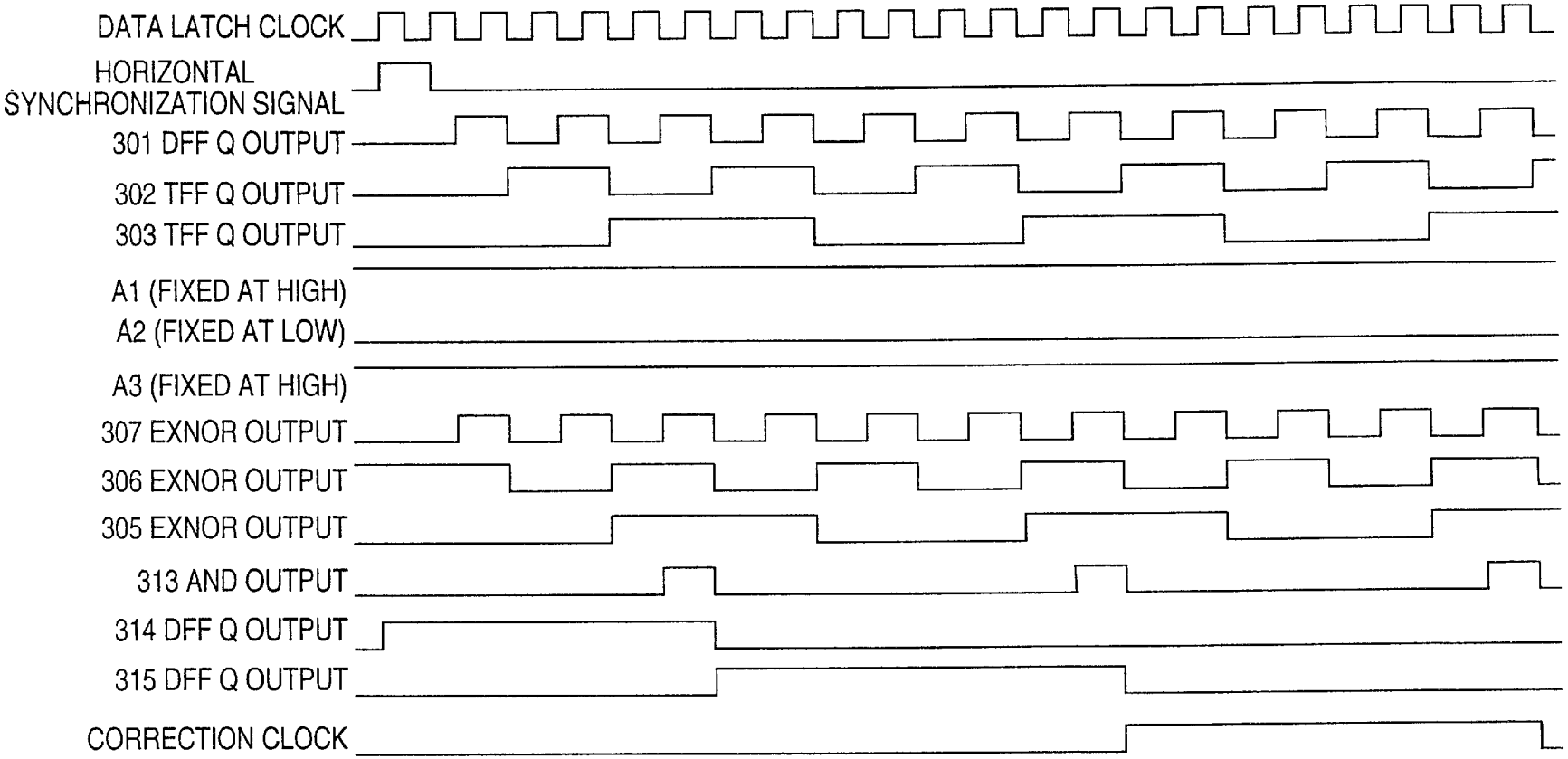
FIG. 64 is a timing chart showing voltage waveforms at various portions of the embodiment of FIG. 63.

Timing chart of the circuit operation is shown in FIG. 64. Output of the 3-input AND circuit 313 changes according to the results of comparison by the EXNOR circuits 305 through 307, and high level data of the D flipflop 314, which is set in the period when the horizontal synchronization signal is high, is shifted successively to the D flipflops 315, 316 by means of the output signal of the 3-input AND circuit 313 thereby to obtain the correction clock. The period from the time of change of the horizontal synchronization signal to the start point of the correction period can be increased by increasing the size of the level shifter comprising the D flipflops 314 and 315, 316. Duration and position of the correction period can also be changed by selecting various combinations of the levels at which A1 through A3 are fixed. Although the 2-division circuit in 3-step operation and 3-bit comparison are employed in this embodiment, a correction clock of a large width can be obtained by increasing the number of comparison bits according to the width of the correction clock. Further the circuit of this embodiment may also be incorporated in the segment side drive circuit, in addition to the configuration of incorporating in the controller.

Figure 65:
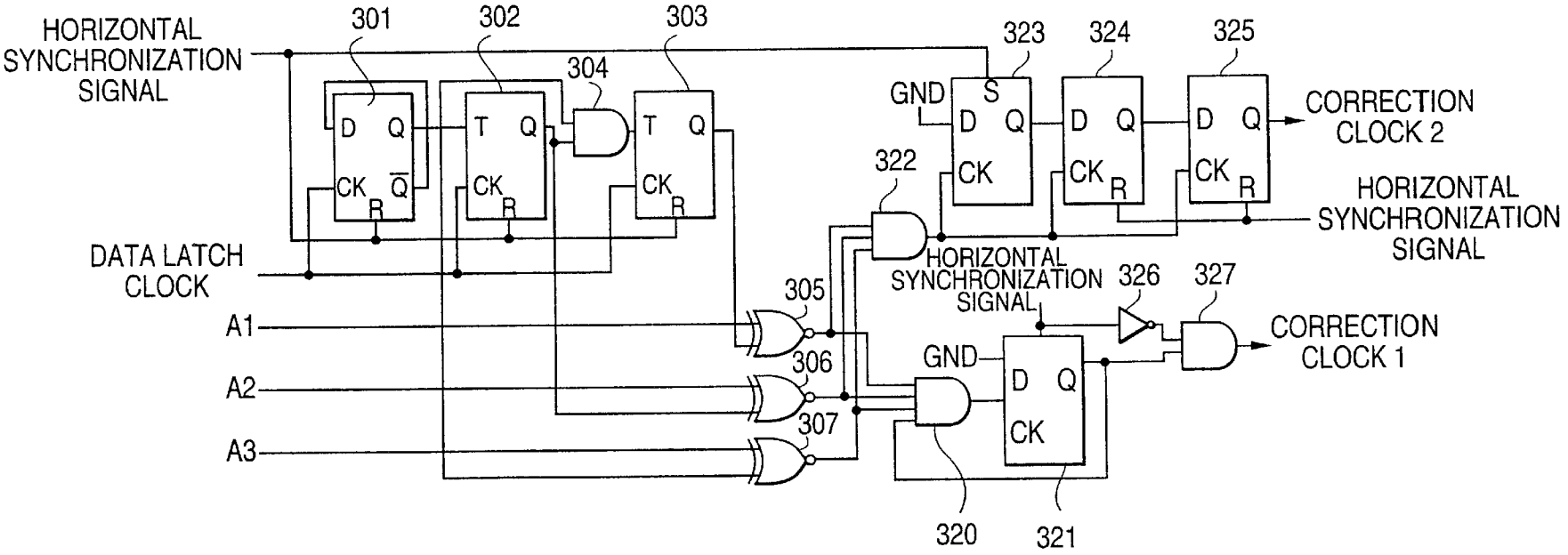
FIG. 65 is a logic circuit diagram showing a circuit configuration of correction clock generating means of a fourteenth embodiment of the invention.

FIG. 65 shows two kinds of correction clock generating circuit for setting two kinds of correction period in one scanning period of a fourteenth embodiment of the invention.

Figure 66:
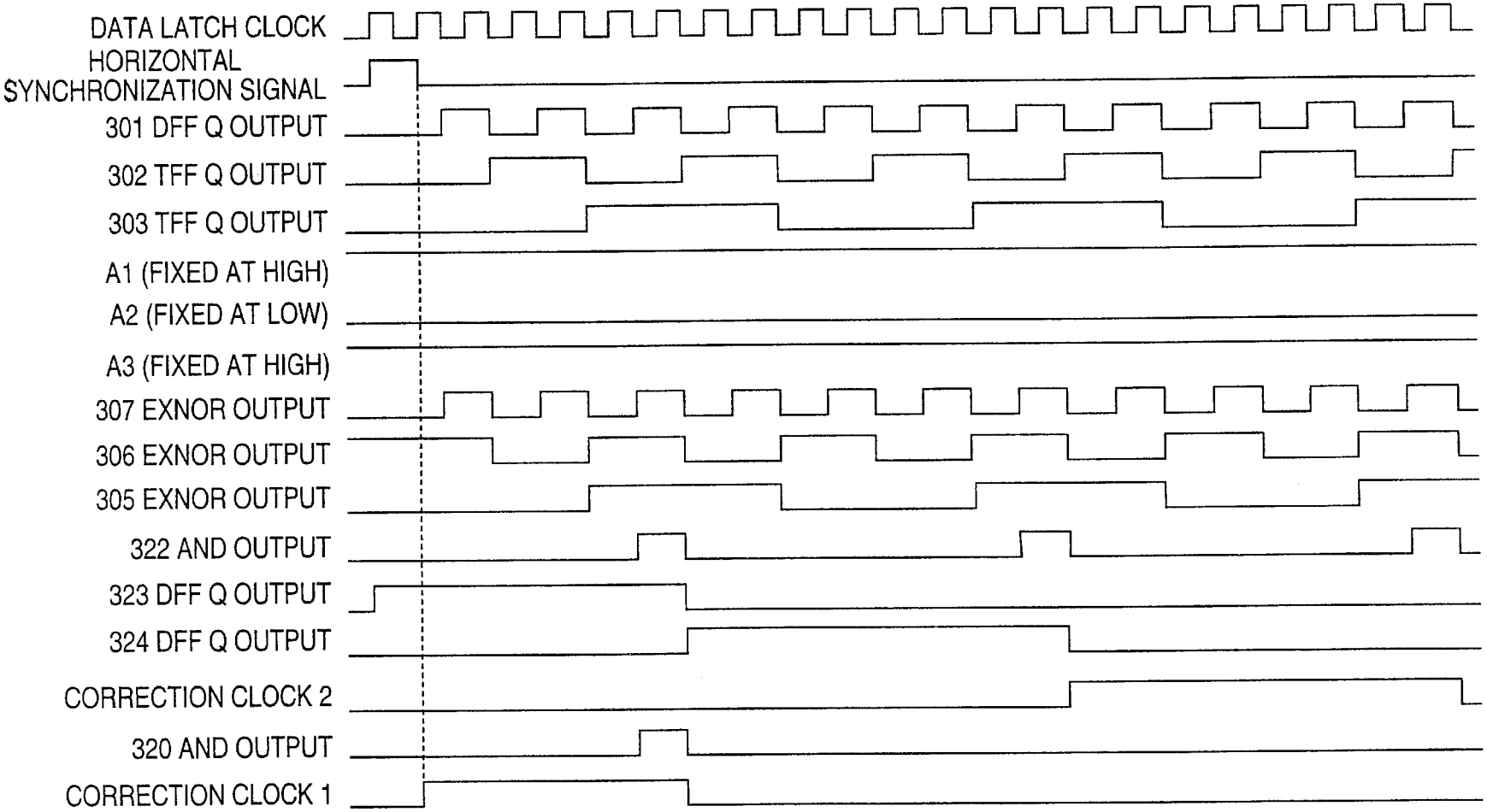
FIG. 66 is a timing chart showing voltage waveforms at various portions of the embodiment of FIG. 65.

This embodiment has a configuration which combines the twelfth embodiment and the thirteenth embodiment, with the timing of operation as shown in FIG. 66. The same correction clock as that of the twelfth embodiment can be obtained as correction clock 1 which is the first correction clock. The same correction clock as that of the thirteenth embodiment can be obtained as correction clock 2 which is the second correction clock. Although the correction clock 1 and the correction clock 2 are generated according to the result of a common comparison operation in this embodiment, they may also be generated according to the results of different comparison operations. The position and duration of the correction period can be changed freely by changing the number of steps of the frequency division circuit, number of comparison bits, circuit size of the level shifter, combination of the levels at which A1 through A3 are fixed, and other factors. Further, the circuit of this embodiment may also be incorporated in the segment side drive circuit, in addition to the configuration of incorporating in the controller.

Figure 67:
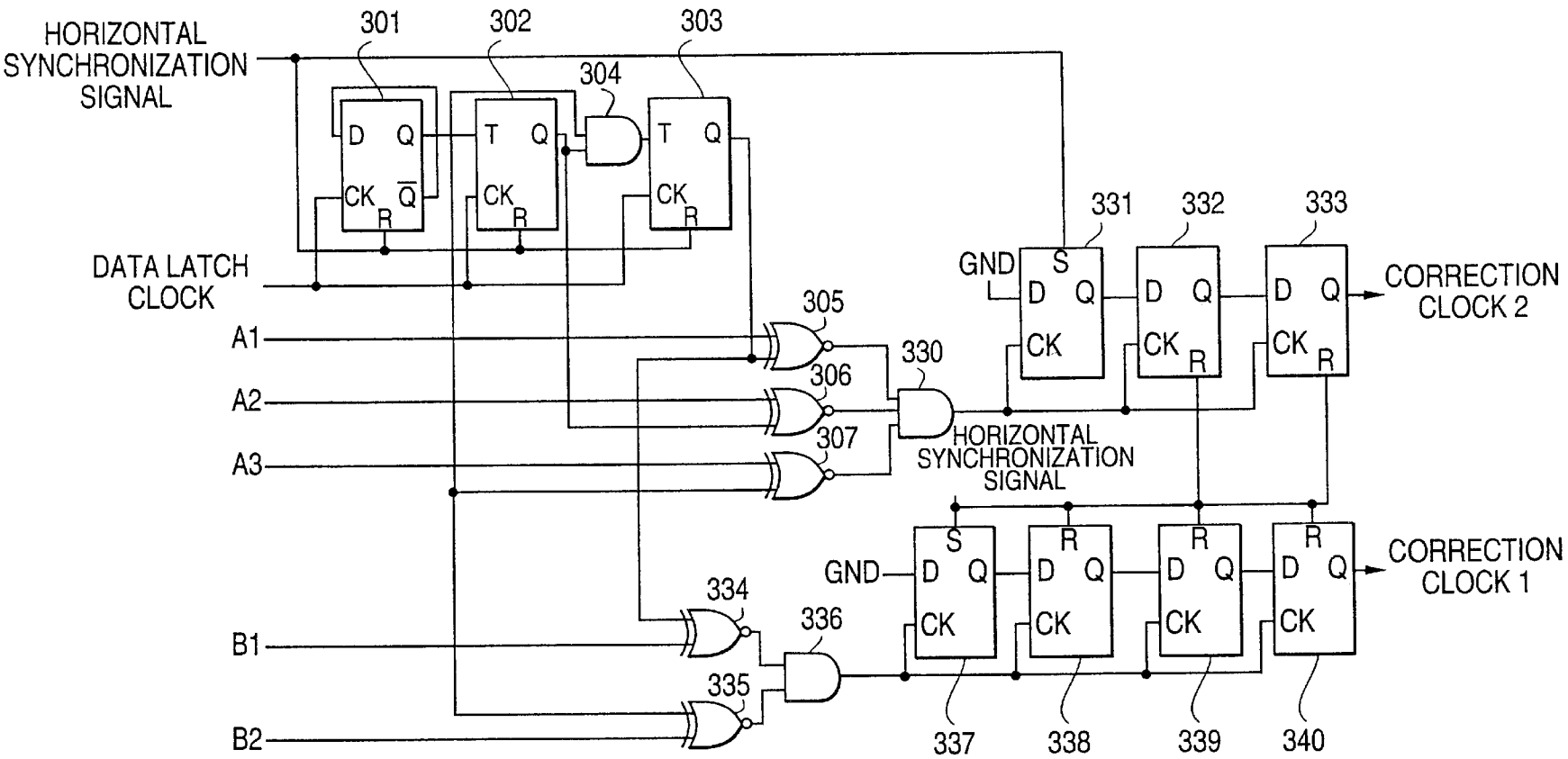
FIG. 67 is a logic circuit diagram showing a circuit configuration of correction clock generating means of a fifteenth embodiment of the invention.
Figure 68:
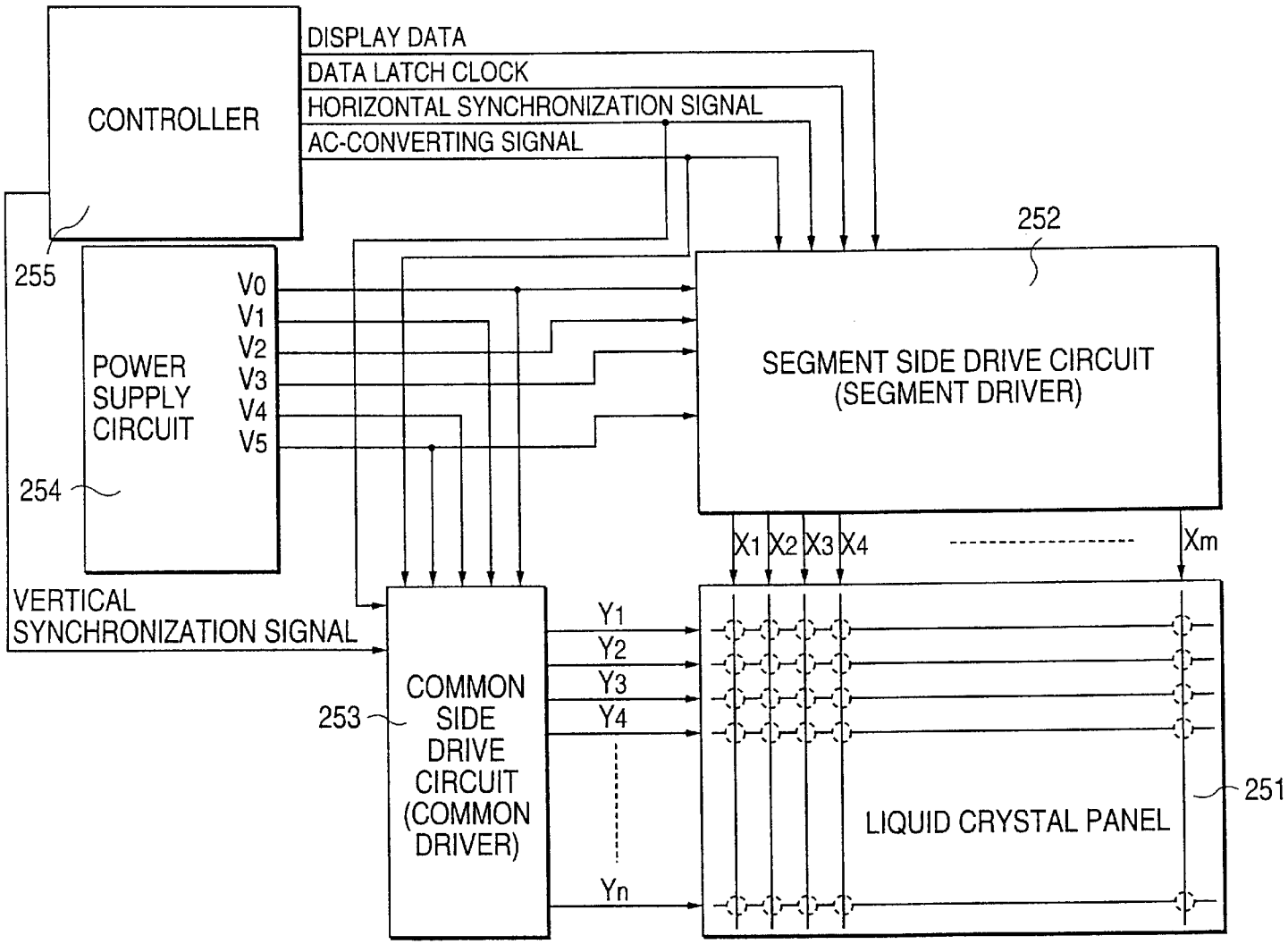
FIG. 68 (PRIOR ART)
FIG. 68 is a block diagram showing a schematic electrical configuration for driving a liquid crystal panel of the prior art.
Figure 69:
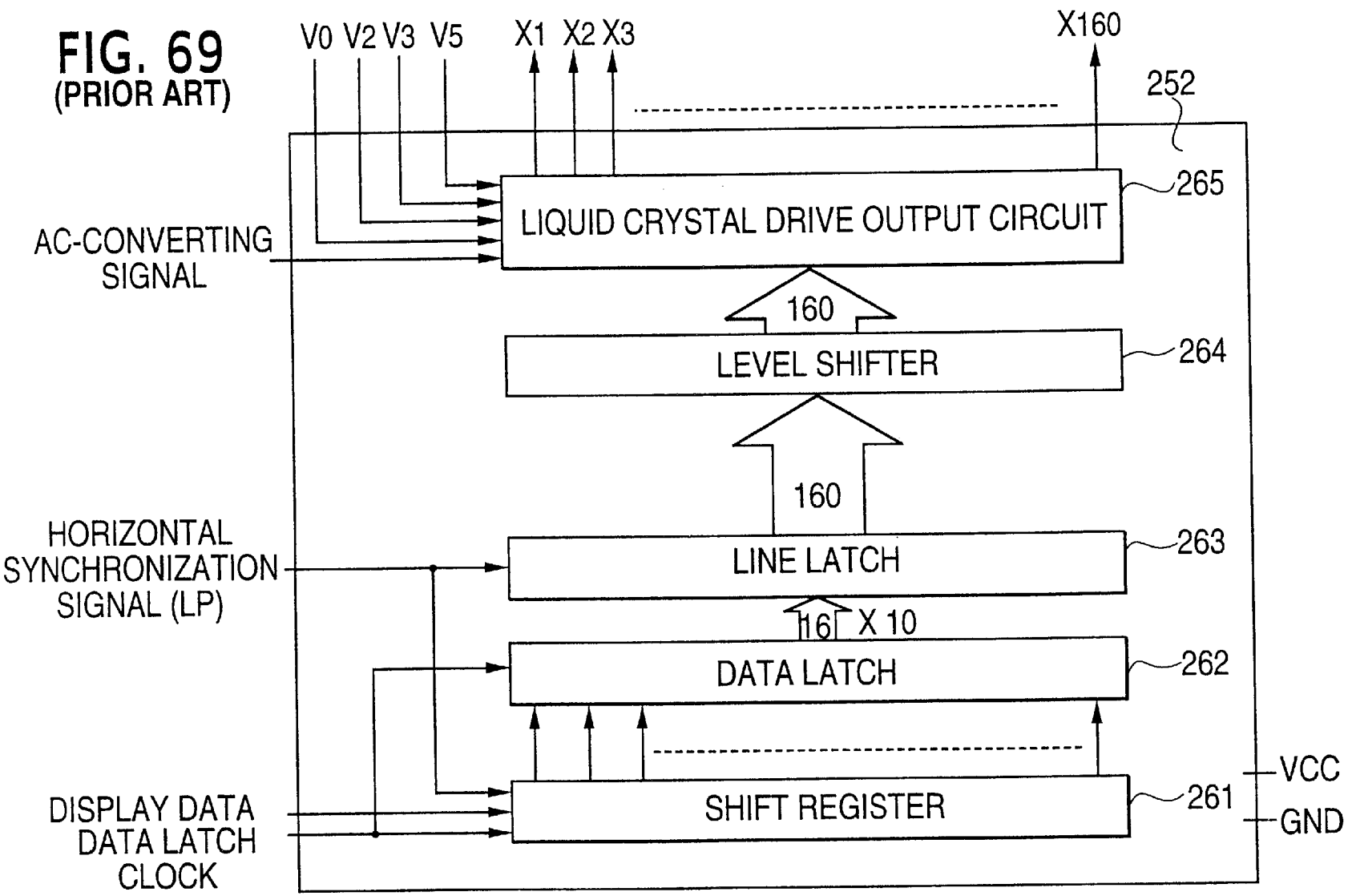
FIG. 69 (PRIOR ART)
FIG. 69 is a block diagram showing an inner electrical configuration of a segment side drive circuit 252 of FIG. 68.
Figure 70:
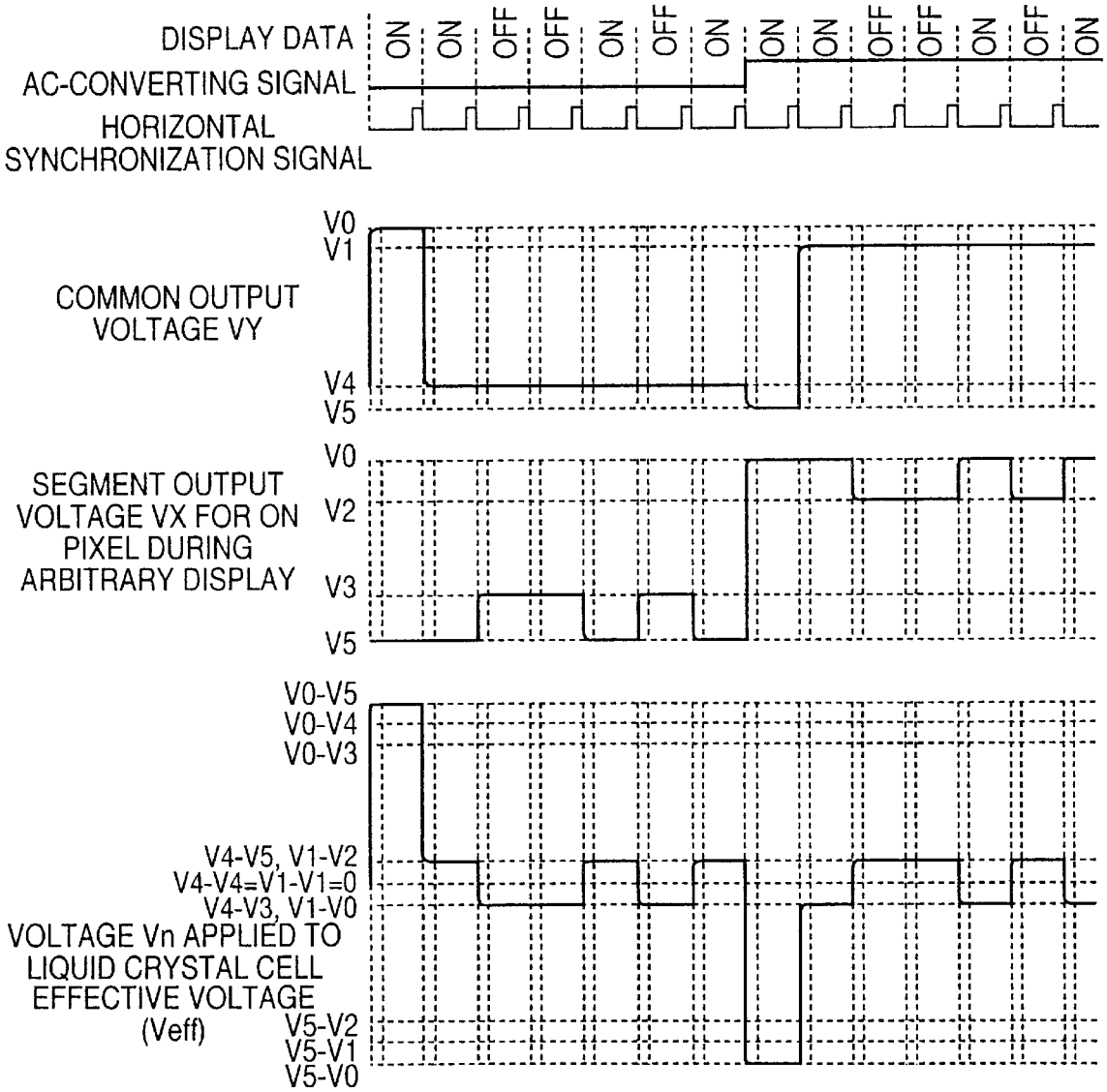
FIG. 70 (PRIOR ART)
FIG. 70 is a timing chart showing voltage waveforms at various portions of the configuration of FIG. 68.
Figure 71:
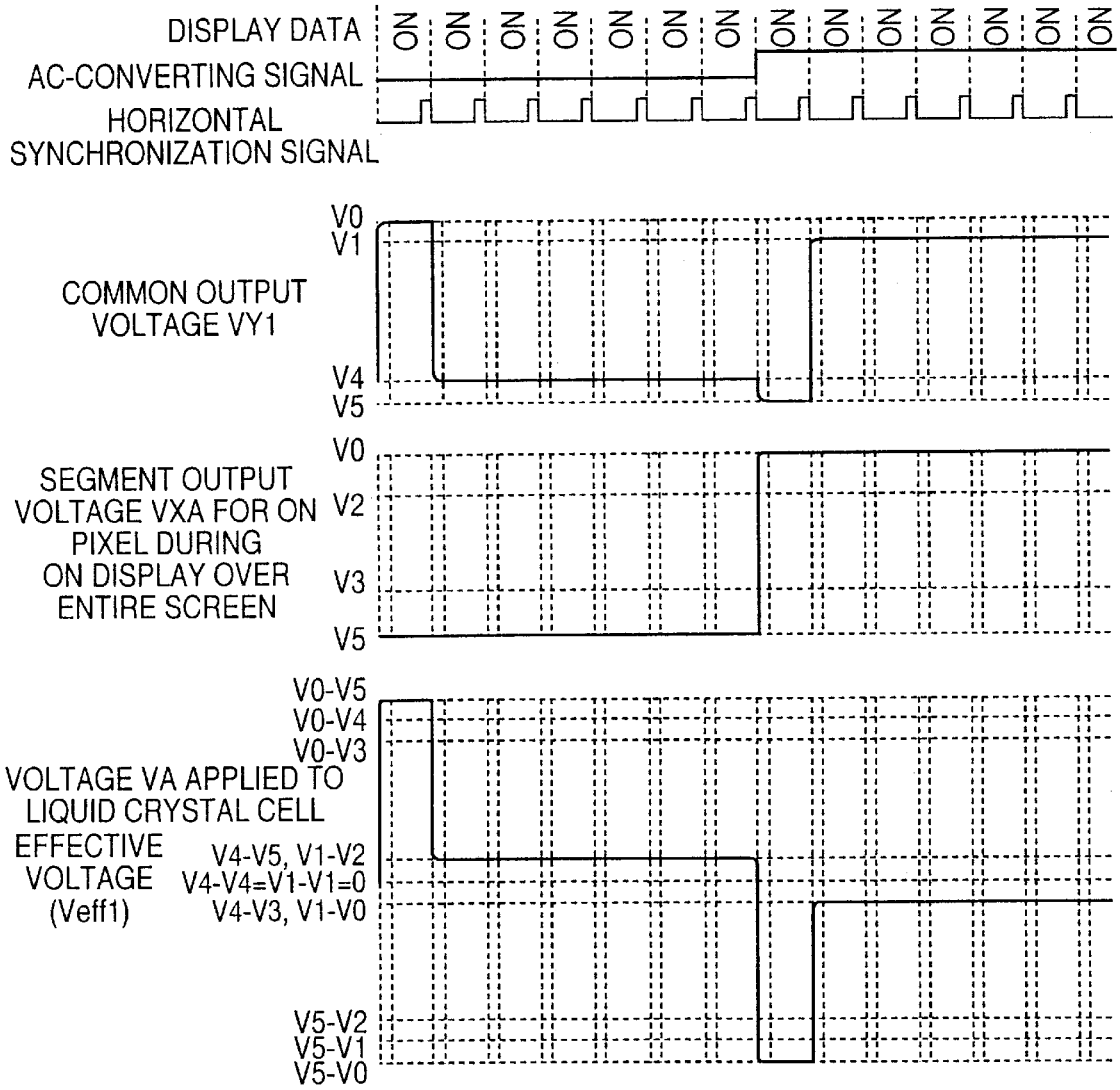
FIG. 71 (PRIOR ART)
FIG. 71 is a timing chart showing voltage waveforms at various portions of the configuration of FIG. 68.
Figure 72:
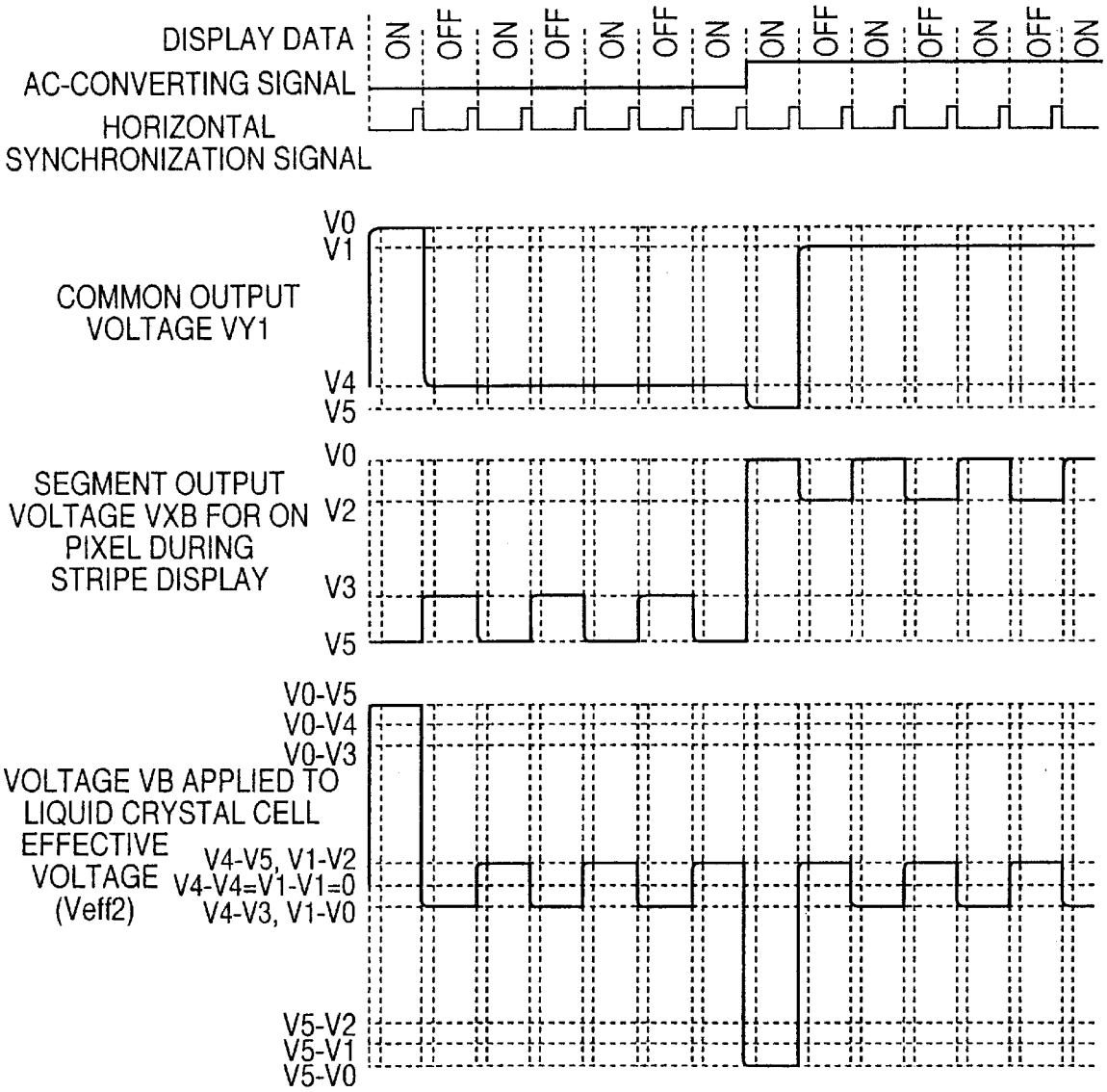
FIG. 72 (PRIOR ART)
FIG. 72 is a timing chart showing voltage waveforms at various portions of the configuration of FIG. 68.
Figure 73:
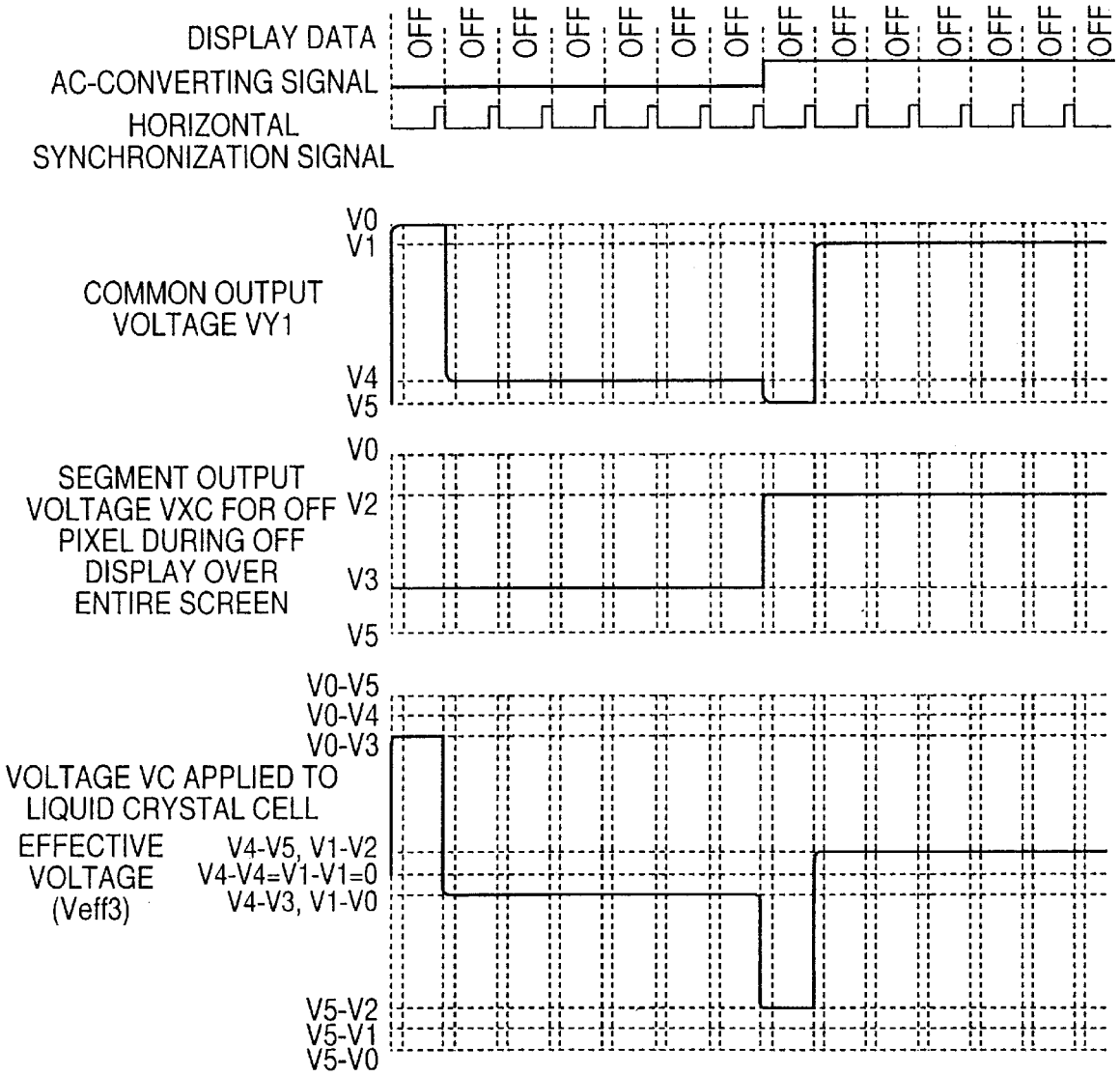
FIG. 73 (PRIOR ART)
FIG. 73 is a timing chart showing voltage waveforms at various portions of the configuration of FIG. 68.
Figure 74:
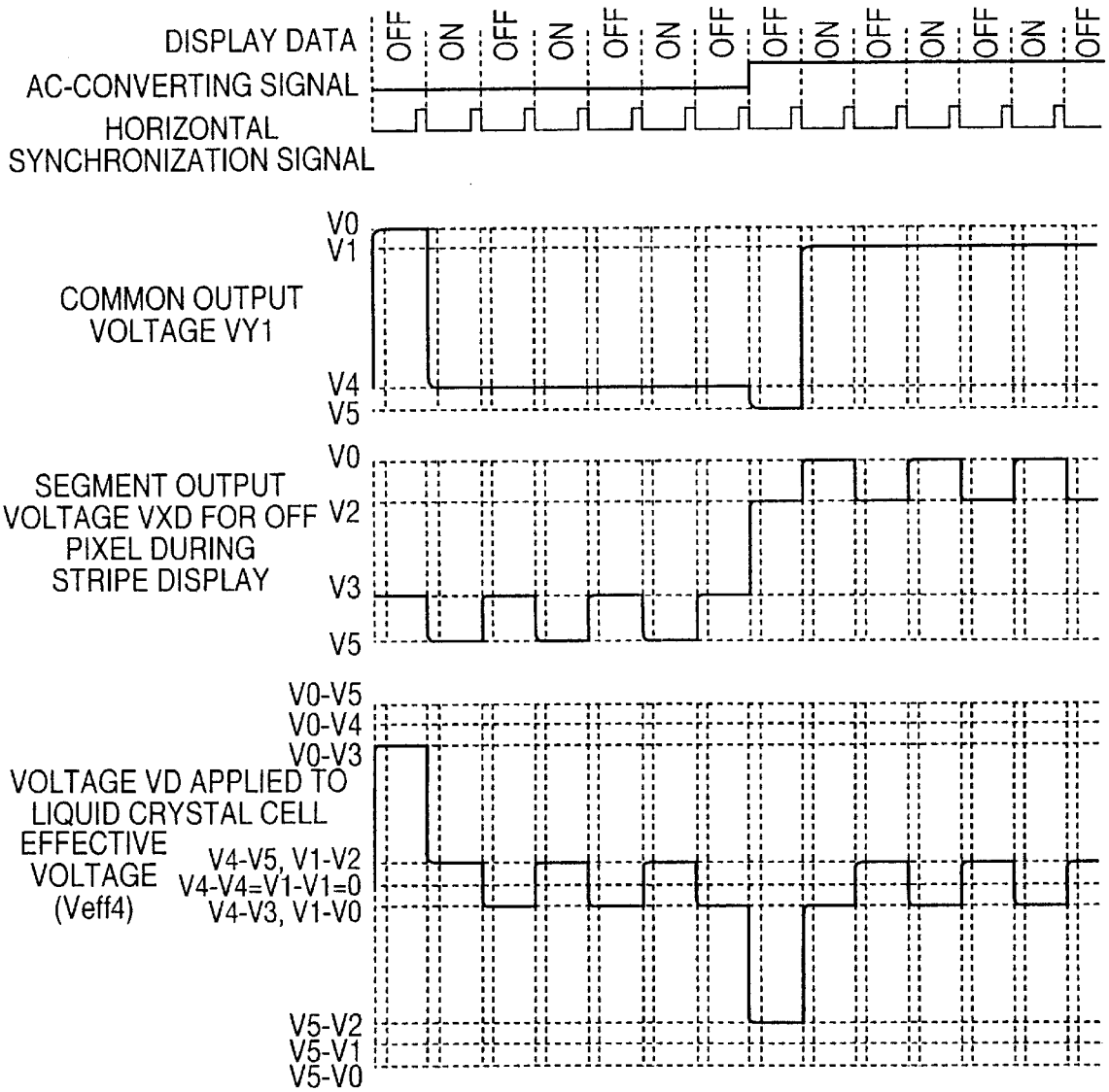
FIG. 74 (PRIOR ART)
FIG. 74 is a timing chart showing voltage waveforms at various portions of the configuration of FIG. 68.
Figure 75:
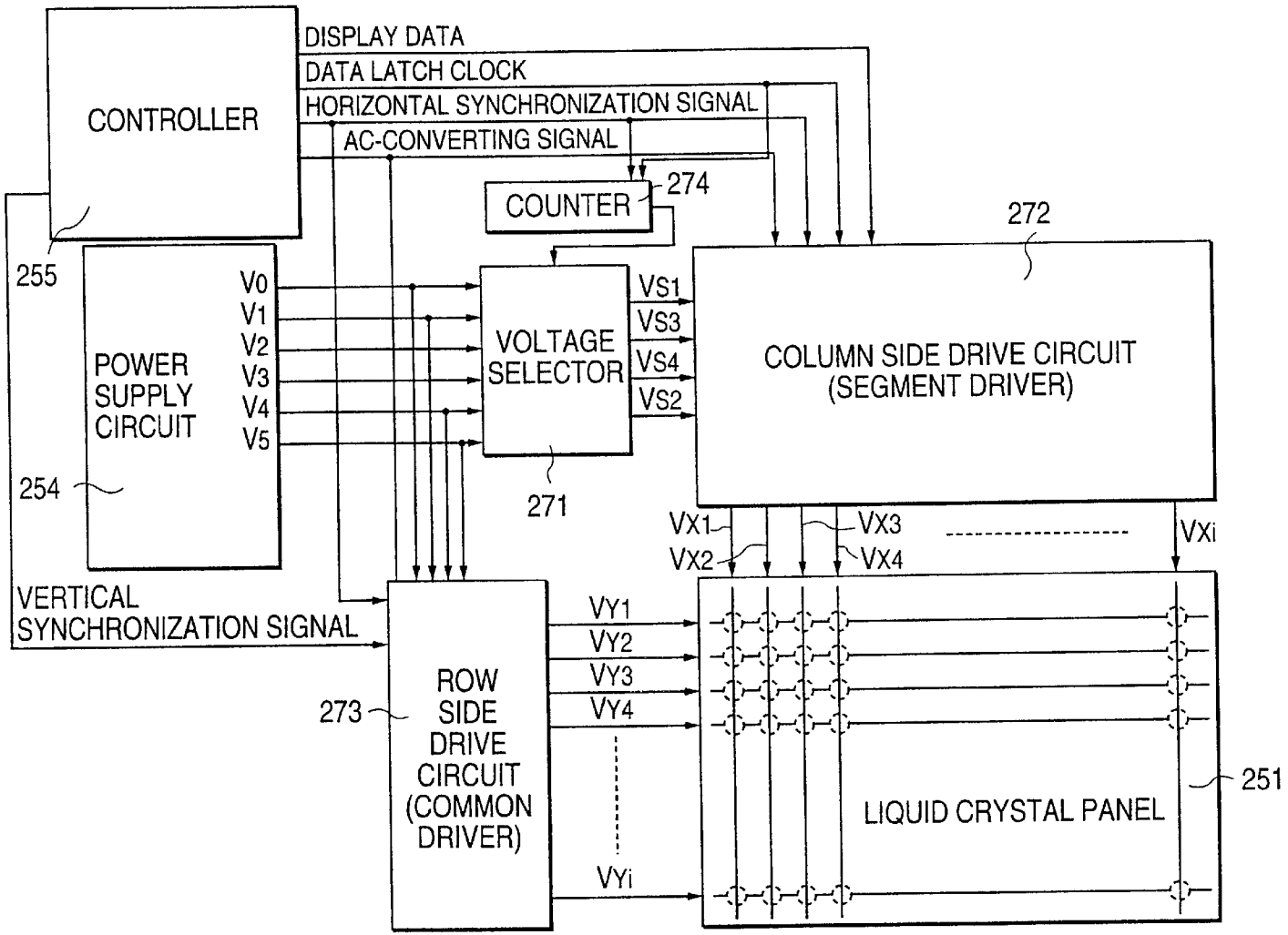
FIG. 75 (PRIOR ART)
FIG. 75 is a block diagram showing a schematic electrical configuration for driving a liquid crystal panel of a prior art for eliminating unevenness in display.
Figure 76:
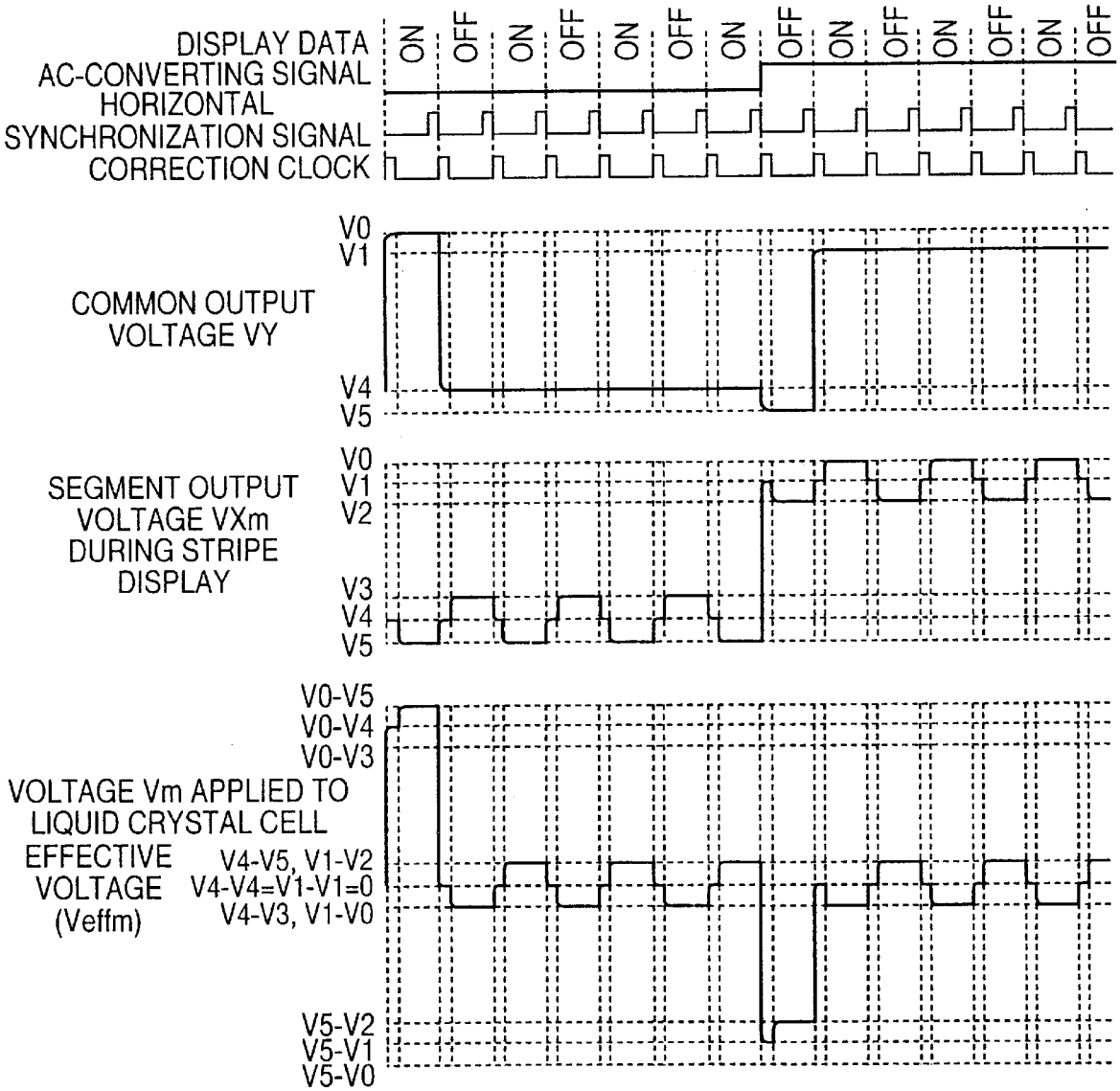
FIG. 76 (PRIOR ART)
FIG. 76 is a timing chart showing voltage waveforms during operation of various portions of the prior art of FIG. 75.
Figure 77:
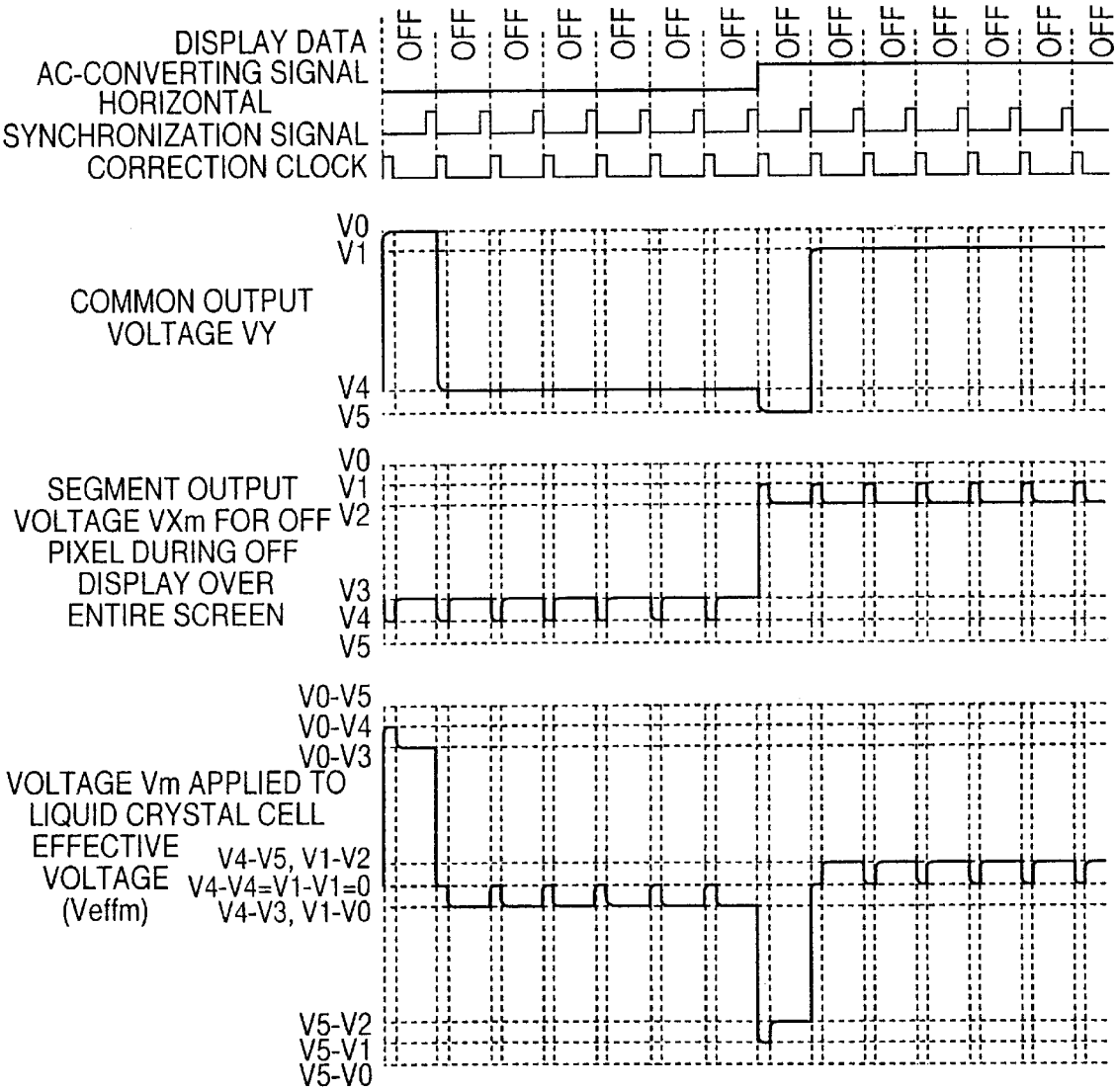
FIG. 77 (PRIOR ART)
FIG. 77 is a timing chart showing voltage waveforms during operation of various portions of the prior art of FIG. 75.
Figure 78:
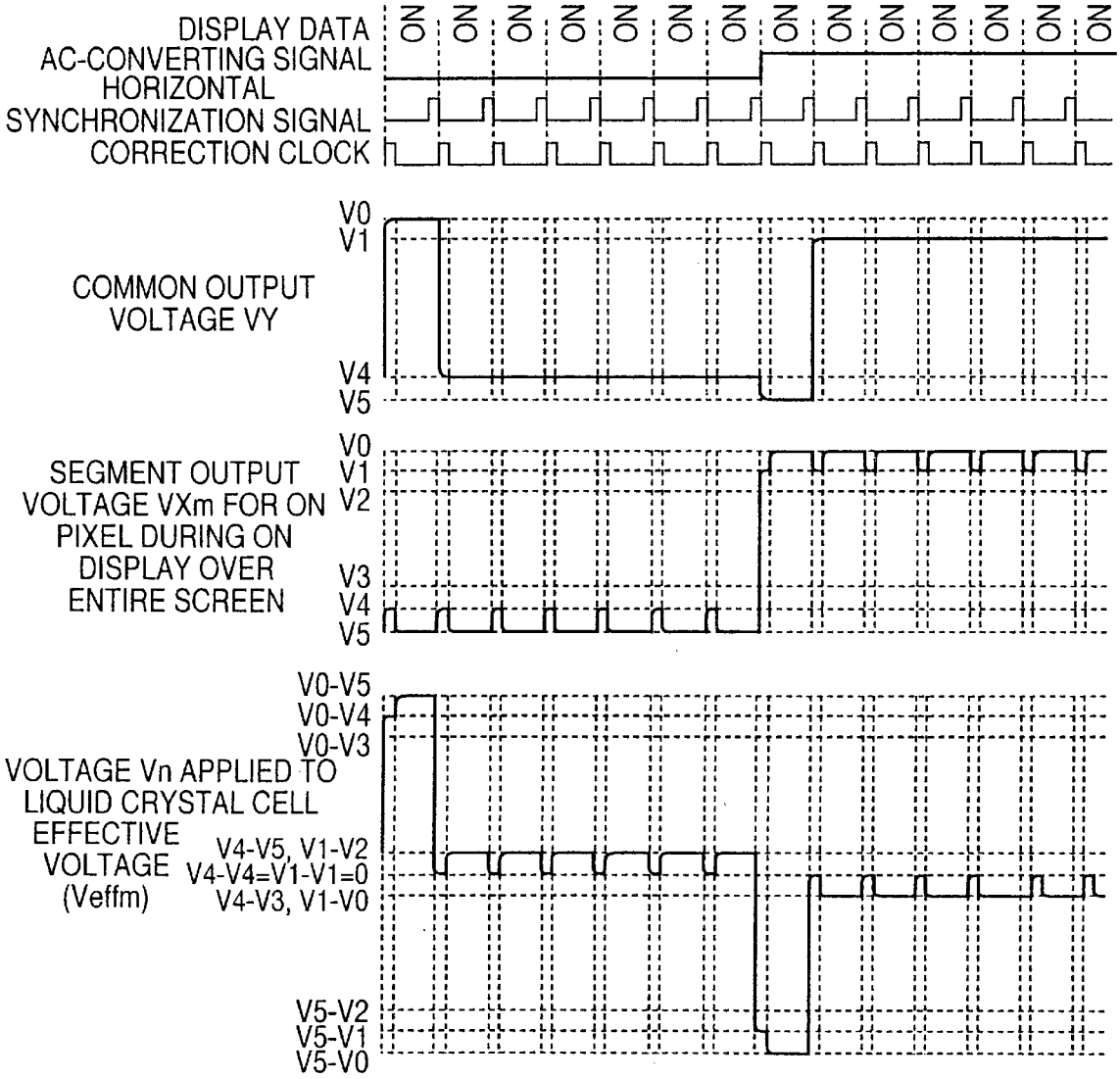
FIG. 78 (PRIOR ART)
FIG. 78 is a timing chart showing voltage waveforms during operation of various portions of the prior art of FIG. 75.
Figure 79:
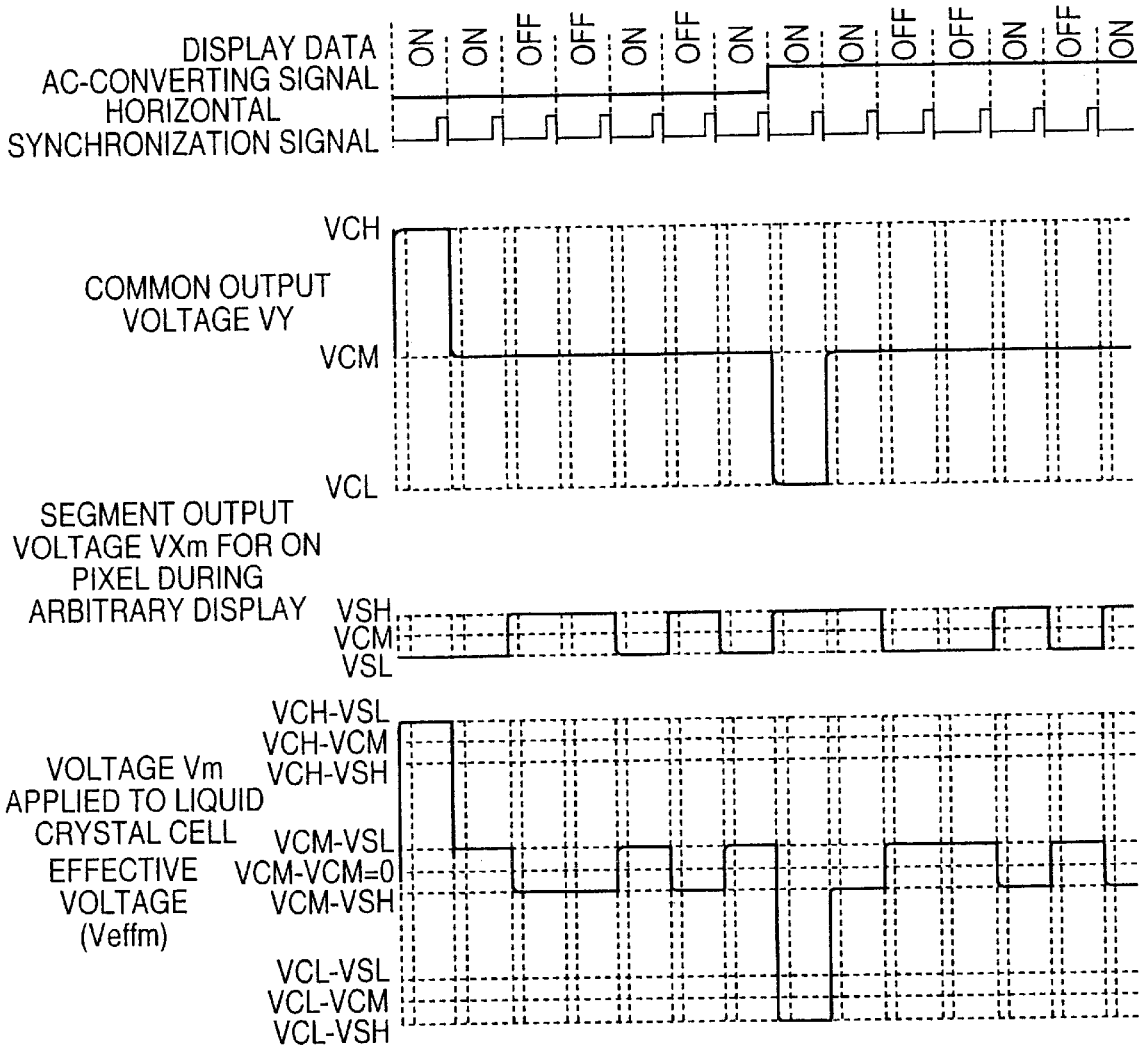
FIG. 79 (PRIOR ART)
FIG. 79 is a timing chart showing voltage waveforms during operation of various portions of the prior art of FIG. 75.
Figure 80:
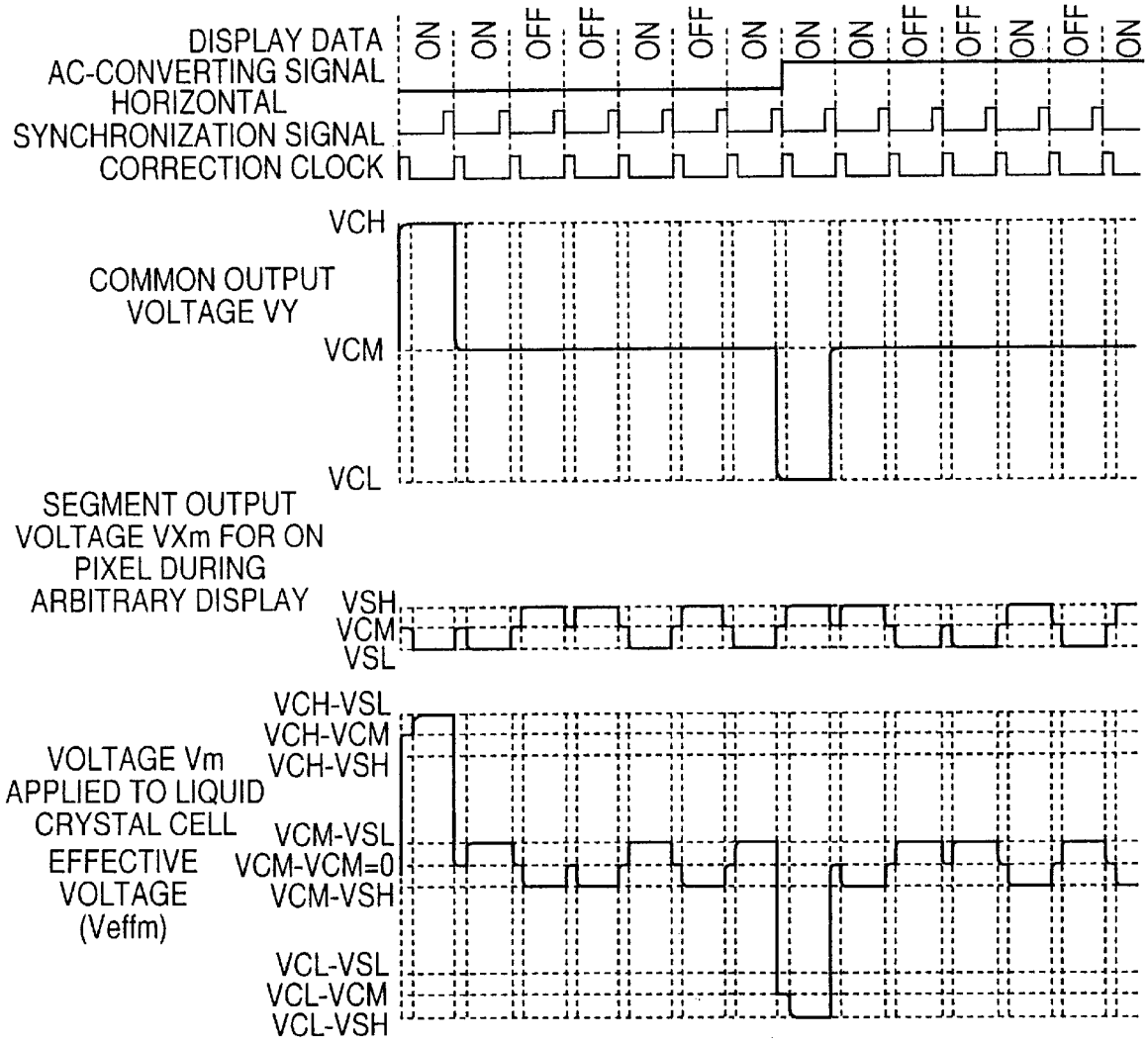
FIG. 80 (PRIOR ART)
FIG. 80 is a timing chart showing voltage waveforms during operation of various portions of the prior art of FIG. 75.
Figure 81:
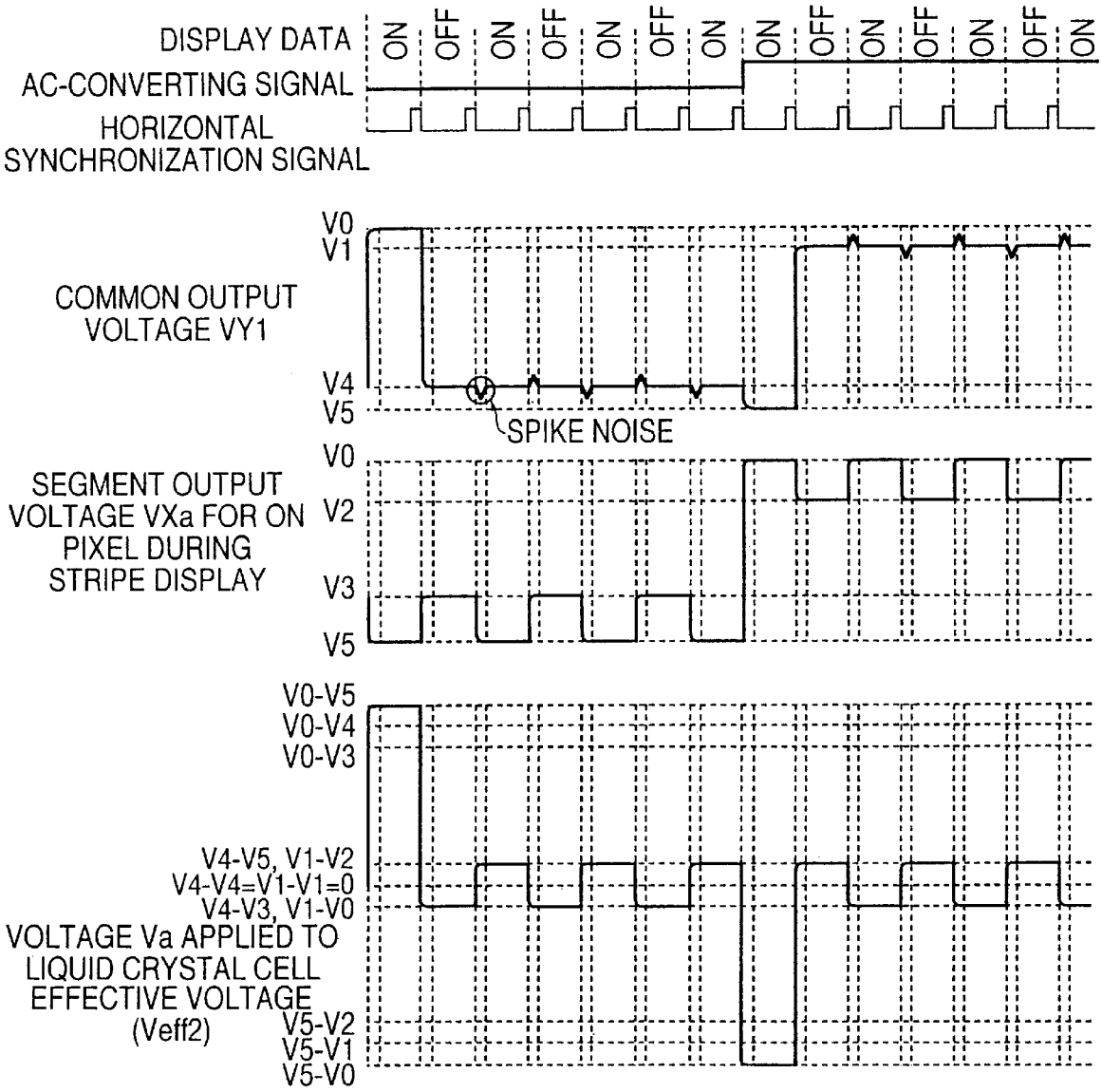
FIG. 81 (PRIOR ART)
FIG. 81 is a timing chart showing voltage waveforms during operation of various portions of the prior art of FIG. 75.
Figure 82:
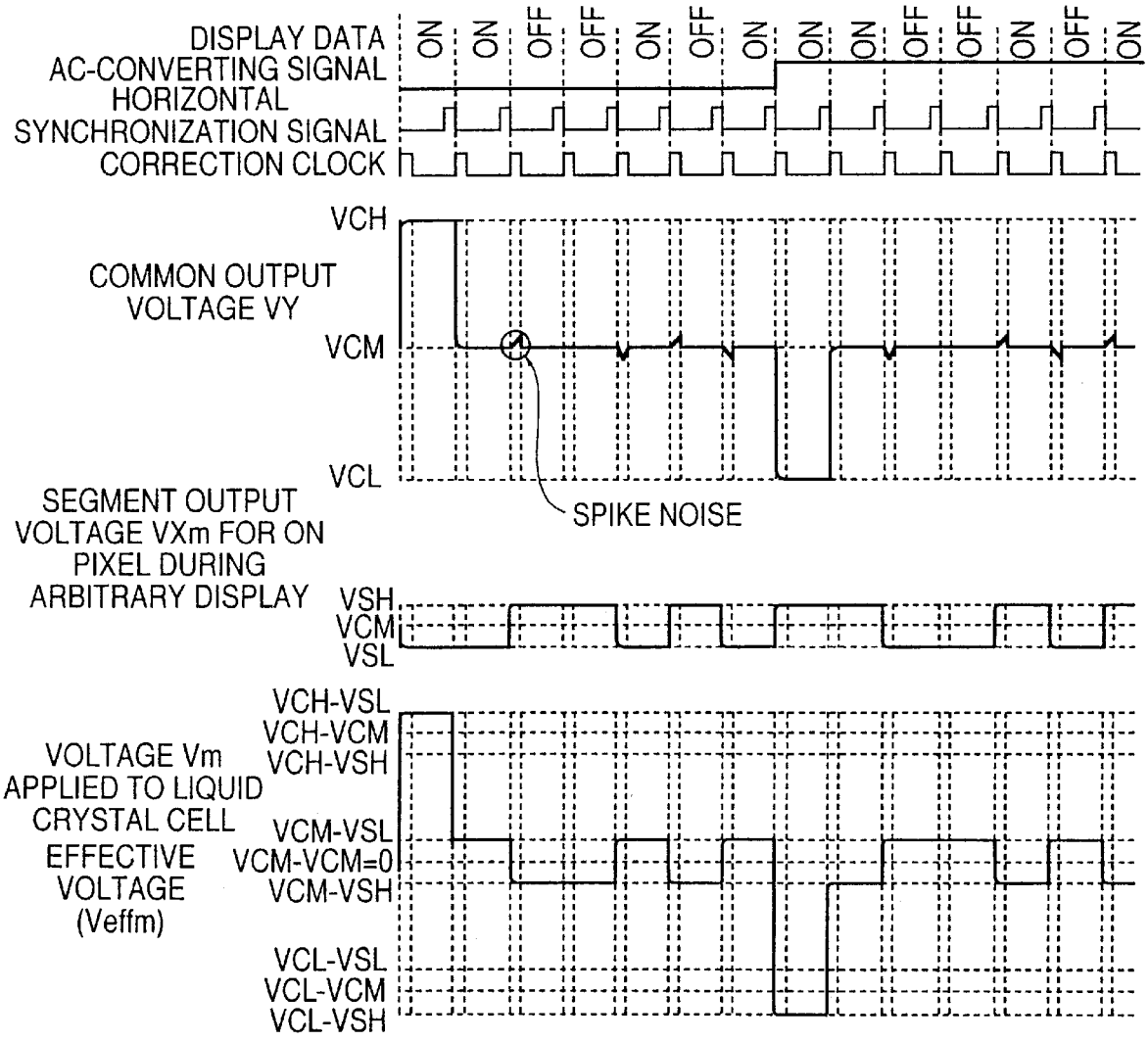
FIG. 82 (PRIOR ART)
FIG. 82 is a timing chart showing voltage waveforms during operation of various portions of the prior art of FIG. 75.
Figure 83:
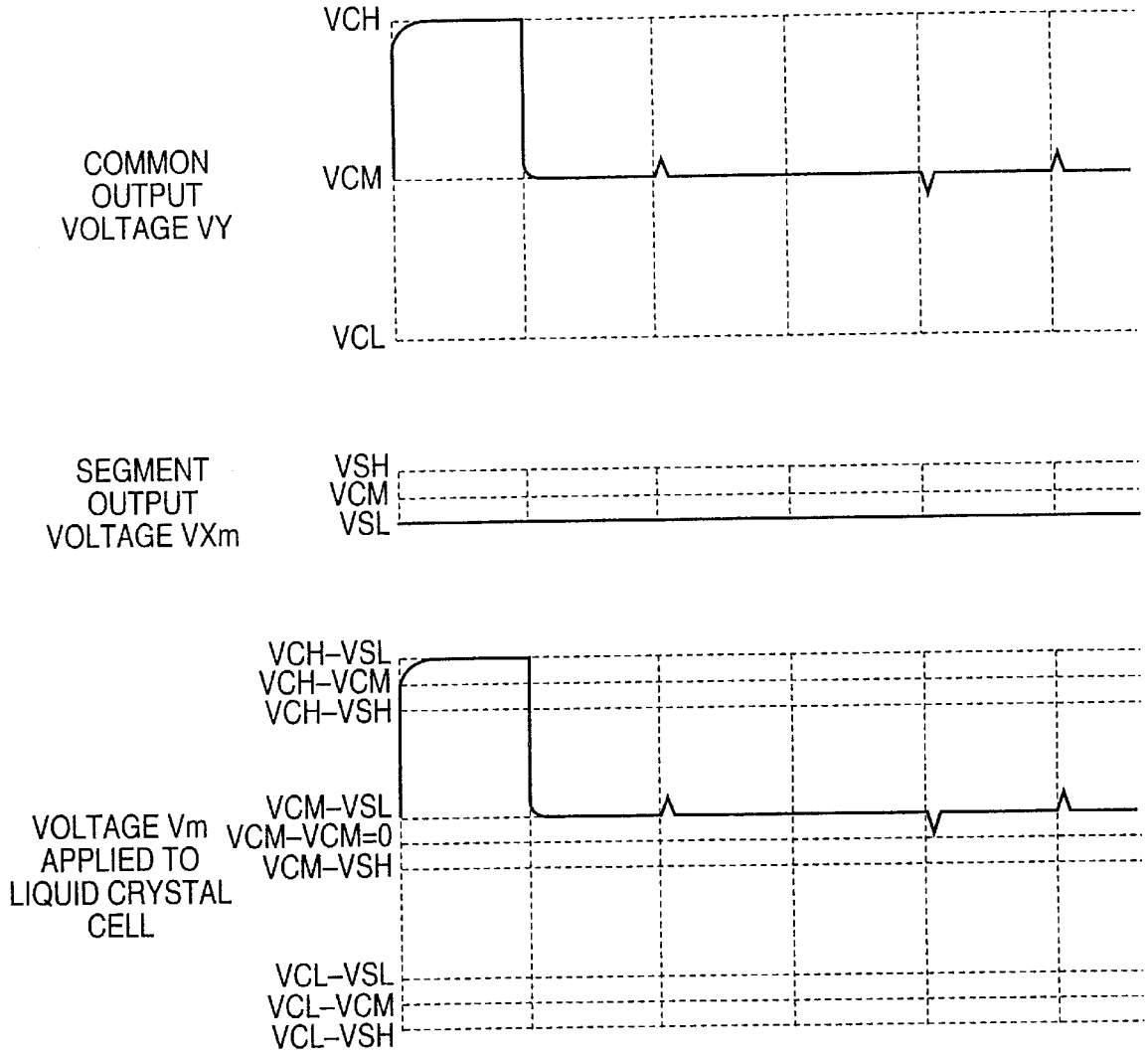
FIG. 83 (PRIOR ART)
FIG. 83 is a timing chart showing voltage waveforms during operation of various portions of the prior art of FIG. 75.
Figure 84:
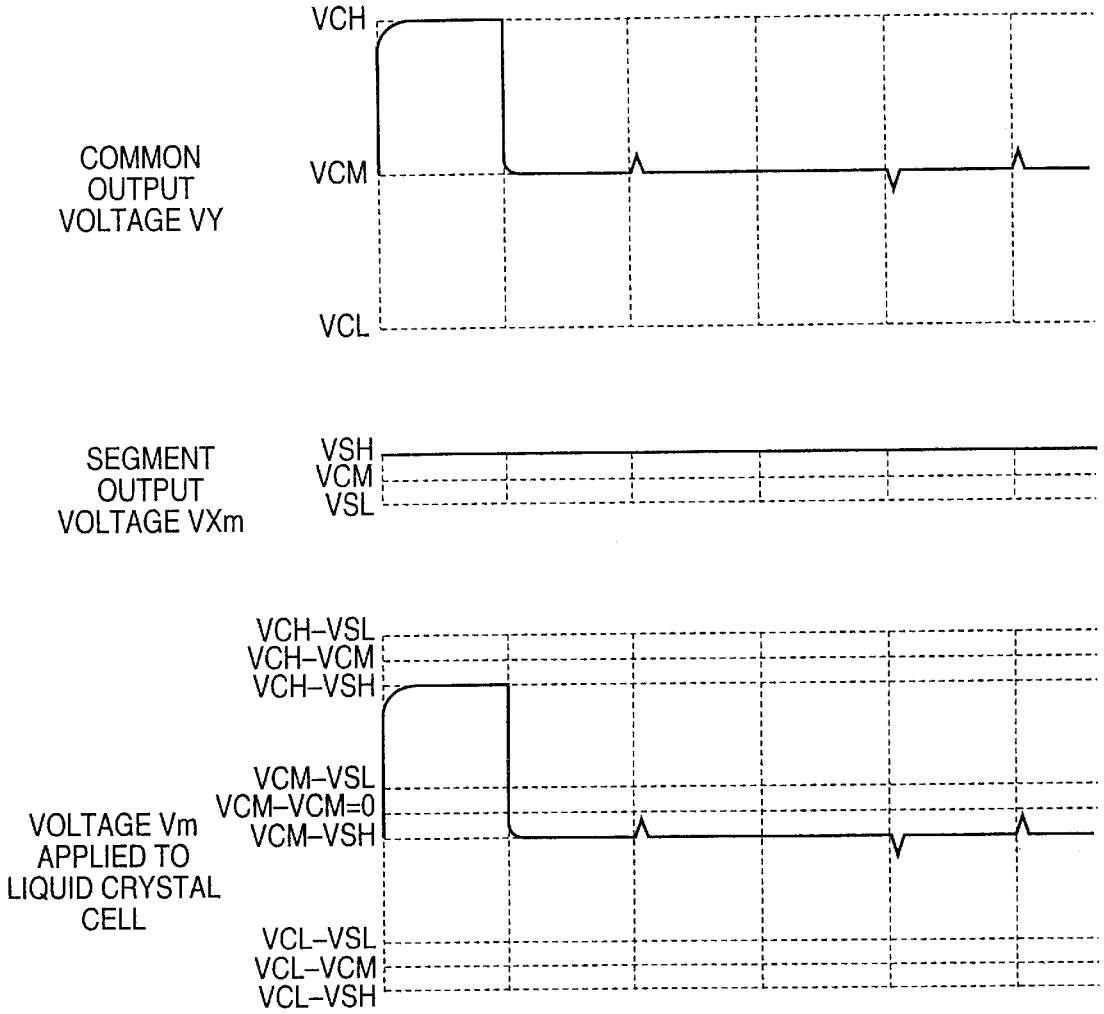
FIG. 84 (PRIOR ART)
FIG. 84 is a timing chart showing voltage waveforms during operation of various portions of the prior art of FIG. 75.
Figure 85:
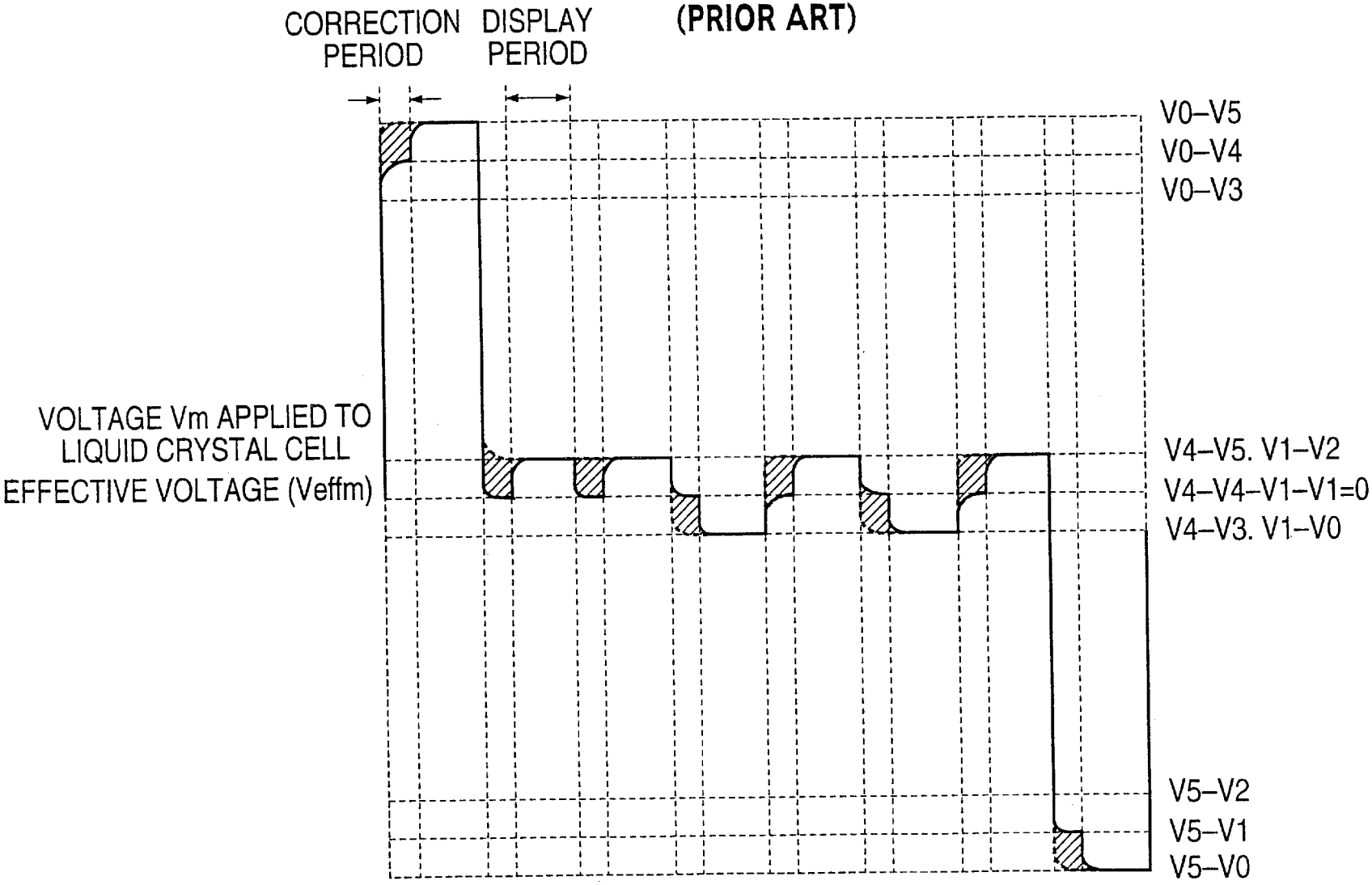
FIG. 85 (PRIOR ART)
FIG. 85 is a timing chart showing voltage waveforms during operation of various portions of the prior art of FIG. 75.

As the fifteenth embodiment of the invention, such a configuration may be employed as shown in FIG. 67, where two kinds of shift register comprising D flipflops 331, 332, 333 and D flipflops 337, 338, 339, 340 are used for two correction clocks while EXNOR circuits 305, 306, 307 and a 3-input AND circuit 330 are provided for the 3-bit comparison values A1, A2, A3 and EXNOR circuits 334, 335 and a 2-input AND circuit 336 are provided for 2-bit comparison values B1, B2, thereby to carry out comparison separately. Further, the circuit of this embodiment may also be incorporated in the segment side drive circuit, instead of inside the controller.

Terminals for the comparison values A1, A2, A3, B1 and B2 described in conjunction with the twelfth through fifteenth embodiments of the invention may be fixed by shorting to a power voltage or ground voltage in the semiconductor integrated circuit, instead of being led out as external terminals. Further the relevant portions and the power supply may also be shorted by means of wire bonding, inner lead wiring on a tape carrier package or the like in the assembly process during manufacture of the semiconductor integrated circuit.

Although the invention is applied to the drive of the liquid crystal panel 1 of simple matrix type in the embodiments described above, similar correction can be applied to the drive of signal lines in an active matrix type liquid crystal panel, thereby reducing luminance unevenness.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A drive device for a liquid crystal display apparatus including a segment side drive circuit to drive pixel columns arranged in a scanning direction according to display data, and a common side drive circuit to drive scanning lines selectively and sequentially in every scanning period, wherein display is performed on a matrix type liquid crystal panel, the drive device comprising:

display data comparison means for comparing display data for a pixel to be driven in one scanning period with display data for the pixel in a previous scanning period: and output control means, in response to a result of the comparison by the display data comparison means, for controlling a level of an output voltage of the segment side drive circuit, when the display data of the two scanning periods is identical, in a correction period within the one scanning period so as to be changed to an intermediate level between an ON display voltage level and an OFF display voltage level.

2. The drive device for a liquid crystal display apparatus of claim 1, wherein the output control means controls the intermediate level to be changed during the correction period, so that different voltage levels are selected depending upon whether the output voltage of the segment side drive circuit is at the ON display voltage level or at the OFF display voltage level.

3. The drive device for a liquid crystal display apparatus of claim 1, wherein the output control means controls the intermediate level to be changed during the correction period, so as to be a non-selective voltage used by the common side drive circuit to set the scanning lines in a non-selected state.

4. The drive device for a liquid crystal display apparatus of claim 1, wherein the output control means controls a length of the correction period so as to differ depending upon whether the output voltage from the segment side drive circuit is at the ON display voltage level or at the OFF display voltage level.

5. The drive device for a liquid crystal display apparatus of claim 1, wherein the output control means does not control the level of the output voltage of the segment side drive circuit to be changed to the intermediate level when an AC-converting signal, used in alternate driving of the liquid crystal panel, changes, even when the comparison by the display data comparison means results in the display data being identical.

6. The drive device for a liquid crystal display apparatus of claim 5, wherein the output control means controls the level of the output voltage of the segment side drive circuit so as to be changed to the intermediate level when an AC-converting signal used for alternate driving of the liquid crystal panel changes, when a comparison by the display data comparison means results in the display data being different.

7. The drive device for a liquid crystal display apparatus of claim 1, the drive device further comprising voltage selecting means for selecting a voltage for display according to display data and for selecting a voltage which has been changed to the intermediate level during the correction period, and for supplying the selected voltages to the segment side drive circuit.

8. The drive device for a liquid crystal display apparatus of claim 1, wherein the output control means sets two correction periods within each scanning period so that a first correction period of the two correction periods is relatively closer to a start point of the scanning period than a second correction period of the two correction periods, and either changes the output voltage of the segment side drive circuit to the intermediate level in the first correction period when the display data are different, or changes it to the intermediate level in the second correction period when the display data are identical, in response to the comparison result by the display data comparison means.

9. The drive device for a liquid crystal display apparatus of claim 8, wherein, when an AC-converting signal for alternate drive of the liquid crystal panel changes, the output control means either changes the output voltage of the segment side drive circuit to the intermediate level in the first correction period when the display data are identical, or changes it to the intermediate level in the second correction period when the display data are different, in response to the comparison result by the display data comparison means.

10. The drive device for a liquid crystal display apparatus of claim 8, wherein the output control means sets the second correction period to be relatively longer than the first correction period.

11. The drive device for a liquid crystal display apparatus of claim 1, wherein the segment side drive circuit includes correction clock generating means for setting the correction period, incorporated therein.

12. A drive method for a liquid crystal display apparatus including a segment side drive circuit to drive pixel columns arranged in a scanning direction according to display data and a common side drive circuit to selectively drive scanning lines in sequence in each scanning period to perform display on a matrix type liquid crystal panel, the drive method comprising the steps of:

comparing display data for a pixel to be driven in one scanning period with display data for the pixel in a previous scanning period; and changing an output voltage of the segment side drive circuit to an intermediate level between an ON display voltage level and an OFF display voltage level, when the display data of the two scanning periods is identical, in a correction period within the one scanning period.

13. The drive method for a liquid crystal display apparatus of claim 12, wherein the output voltage of the segment side drive circuit is not changed to the intermediate level, even when display data of two consecutive scanning periods are identical, when an AC-converting signal for alternate drive of the liquid crystal panel, changes.

14. The drive method for a liquid crystal display apparatus of claim 13, wherein when the AC-converting signal for alternate drive of the liquid crystal panel changes, the output voltage of the segment side drive circuit is changed to the intermediate level when the comparison indicates that the display data of two consecutive scanning periods is different.

15. The drive method for a liquid crystal display apparatus of claim 12, wherein two correction periods are provided in one scanning period, and when the comparison indicates the display data to be different, the voltage is changed to the intermediate level in a first correction period of the two correction periods which is relatively closer to a start point of the scanning period at the time of changing, and when the comparison indicates the display data to be identical, the voltage is changed to the intermediate level in a second correction period of the two correction periods which starts relatively later than the first correction period.

* * * * *

UNITED STATES PATENT AND TRADEMARK OFFICE

CERTIFICATE OF CORRECTION

PATENT NO : 6,100,867

DATED : August 8, 2000

INVENTOR(S) : Seijirou Gyouten

It is certified that error appears in the above-identified patent and that said Letters Patent are hereby corrected as shown below:

In item [30], foreign Application Priority Date, change "Aug. 23, 1996 [JP] Japan ..... 8-22773" to:"

--Aug.23, 1996 [JP] Japan ..... 8-222773--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*